United States Patent [19]

Tsutsui et al.

[11] Patent Number: 4,819,587

[45] Date of Patent: Apr. 11, 1989

[54] MULTIPLE-PURPOSE INSTANTANEOUS GAS WATER HEATER

[75] Inventors: Osamu Tsutsui; Hideki Kawaguchi; Keiji Hayashi; Masahiro Kayano; Shingo Tanaka, all of Fukuoka; Hiroshi Kobayashi, Shiga; Hisashi Nakamura, Shiga; Atsuo Makita, Shiga, all of Japan

[73] Assignee: Toto Ltd., Fukuoka, Japan

[21] Appl. No.: 883,773

[22] Filed: Jul. 9, 1986

[30] Foreign Application Priority Data

| | | | |
|---|---|---|---|
| Jul. 15, 1985 | [JP] | Japan | 60-156593 |
| Jul. 19, 1985 | [JP] | Japan | 60-160770 |
| Jul. 26, 1985 | [JP] | Japan | 60-166983 |
| Oct. 24, 1985 | [JP] | Japan | 60-238850 |
| Jan. 10, 1986 | [JP] | Japan | 61-3153 |
| Jan. 10, 1986 | [JP] | Japan | 61-3154 |

[51] Int. Cl.[4] ..... F22B 37/42

[52] U.S. Cl. ..... 122/488 R; 126/351; 236/14; 237/19

[58] Field of Search ..... 122/446, 447, 448 R, 122/451 R, 452; 126/351; 236/23, 24, 25 R; 237/19

[56] References Cited

U.S. PATENT DOCUMENTS

| | | | |
|---|---|---|---|
| 3,887,325 | 6/1975 | Finger et al. | 122/448 R X |
| 4,184,457 | 1/1980 | Trotter et al. | 122/448 R X |
| 4,429,682 | 2/1984 | Huang | 126/351 |
| 4,501,261 | 2/1985 | Tsutsui et al. | 126/351 |
| 4,505,253 | 3/1985 | Mizuno et al. | 122/448 R X |
| 4,627,416 | 12/1986 | Ito et al. | 122/448 R X |

FOREIGN PATENT DOCUMENTS

| | | | |
|---|---|---|---|
| 108042 | 8/1979 | Japan | 122/446 |
| 149546 | 11/1981 | Japan | 126/351 |
| 31249 | 2/1983 | Japan | 126/351 |

*Primary Examiner*—Steven E. Warner

*Attorney, Agent, or Firm*—Sandler & Greenblum

[57] ABSTRACT

A multiple purpose instantaneous gas water heater comprises a combination of a larger combustion capacity type first burner with a smaller combustion capacity type second burner. Each of the burners can be controlled by a proportional combustion control method and/or an intermittent combustion control method. It is possible to combine these functions within a microcomputer system so as to use each or both burners selectively, or both together, so that it is possible to select water from a wide range of hot water temperatures or to select a target temperature.

27 Claims, 23 Drawing Sheets a : NO.2 BURNER ON-OFF MINIMUM b : NO.2 BURNER ON-OFF MAXIMUM
NO.2 BURNER PROPORTIONAL MINIMUM c : NO.2 BURNER PROPORTIONAL MAXIMUM
NO.1 BURNER PROPORTIONAL MINIMUM d : (NO.1 + NO.2) BURNERS PROPORTIONAL MINIMUM e : (NO.1 + NO.2) BURNERS PROPORTIONAL MAXIMUM

○○○○ ○○○○ D-ZONE : NO.1, NO.2 BURNERS COMBUSTION

X X X X X X X X B-ZONE : NO.2 BURNER COMBUSTION

△△△△ △△△△ C-ZONE : NO.1 BURNER COMBUSTION

※※※※ ※※※※ A-ZONE : NO.2 BURNER INTERMITTENT COMBUSTION

UNDER EXTINGUISHING

MULTIPLE-PURPOSE INSTANTANEOUS GAS WATER HEATER

BACKGROUND OF THE DISCLOSURE 1. Field of the Invention

The present invention relates to an improved multiple purpose instantaneous gas water heater, and particularly to an improved operation of such a heater, and to multiple uses for a gas water heater, such as a shower and the like.

2. Discussion of Prior Art

Previously, a variety of instantaneous gas water heaters were used. Among such water heaters are instantaneous gas water heaters having proportional gas operations; this type of water heater controls heat gain in response to controlled volume feeding of gas. Such a device, although often used, was not always satisfactory. Further, if could be used only for hot water supply, however, and such a device could not be satisfactorily used for multiple purposes, however.

In view of the disadvantages of such conventional devices, the present invention is directed to a multiple-purpose instantaneous gas water heater having a high capability for multiple uses, and is adapted to be responsive to the needs of consumers.

First, conventional devices in the form of proportional gas operated water heaters are limited in that they have only limited control, in the sense that they only control the volume of gas fed. Accordingly, once the volume of water being fed exceeds the highest limit of control for the volume of gas being fed, e.g., when the water pressure of the water being supplied source is higher than a predetermined value, it is quite difficult for the hot water temperature to reach a set up temperature (this would occur, for example, when a temperature drop in the water being fed is extremely severe, as occurs during the winter season). In fact, it is so unlikely that the temperature will reach such a set up temperature under these circumstances that a user had to throttle a source faucet by hand in order to control the volume of water being fed as a countermeasure, i.e., a user could only obtain a desired temperature of hot water by touching the water.

In order to resolve such a disadvantage, the inventor of the present invention previously offered such a device with the following improvement; this was designed for devices where the hot water temperature was virtually uncontrollable because it could only be controlled by the volume of gas used with respect to a set up temperature. In this device, an automatic valve was provided for throttling excess water flow greater than a limited range of water volume so that it would not enter a heat exchanger when within a set up temperature. This device is illustrated in U.S. Pat. No. 4,501,261.

In the type of water heater in which the feeding gas volume and feeding water volume are controlled a new method of controlling a burner has been introduced. That is, in view of the structure of conventional burners, previously the lowest limit of combustion was approximately 20% or 25% of the level of the highest limit of combustion, so that when the highest limit was increased, the lower limit also increased.

SUMMARY OF THE INVENTION

Accordingly, the present invention is directed to a type of water heater in which two burner units are provided adjacent to a heat exchanger. The two burner units include a No. 1 (hereinafter first) burner having a relatively larger ability and a No. 2 (hereinafter second) burner with a relatively smaller ability which has its highest limit of combustion adjusted to a value which is equal to or slightly greater than the lowest limit of the first burner; and, in response to a necessary heat load, the No. 1 and No. 2 burners are proportionally controlled, either alone or together simultaneously; and, when a necessary or required heat load is smaller than a predetermined standard value, the No. 2 burner will be used, which will operate in an intermittent combustion with a cycle responsive to the necessary heat load in order to make the lowest limit value of the combustion to be much less than its highest limit value of the combustion.

Accordingly, this type of an instantaneous gas water heater is necessary to establish a standard value and in order to determine which of the burners will be used for a given necessary heat load; as well as which control method for the burners is to be used.

On the other hand, the necessary heat load is determined by a water flow rate, a set up temperature, and a water temperature. However, a detector is used to monitor each of the factors, and non-uniform errors in measurement are thus often introduced. Accordingly, some amount of tolerance must be taken into account when the necessary heat load is determined, and at some times the necessary heat load will fluctuate from a value upwardly and downwardly about a standard value to the standard value discussed above. In such case, the burner being used or the method of burner control will be frequently changed due to fluctuations in the necessary heat load; as a result, the temperature characteristics would not be correct during the time that the burners are being switched, or when the method of controlling the heat value of the burners is changing.

1. Problem to be Resolved

The present invention is adapted to resolve the problems of the prior art by making a standard value with an appropriate allowance for switching between the burners being used or the method of controlling the heat value; the burners are switched, or the control method changed, when the necessary heat load exceeds the highest limit of the allowance when the heat load is increasing; or, vice versa, when the necessary heat load exceeds the lowest limit of the allowance, i.e., when the necessary heat load is decreasing.

In summary, the present invention is intended to improve on the various multiple uses and functions of operation of the device, and also make it more convenient in practice than prior art devices.

2. Means of Resolving Problem 1

The present invention involves a device which is adapted to overcome the above-mentioned problems and which includes a No. 1 or first burner which is positioned against a heat exchanger, and a No. 2 or second burner which has a smaller capability than the first burner. The device also includes means for detecting water volume and means for detecting water temperature, both of which detecting means are arranged, respectively, along the upstream side of the heat exchanger and along a feeding water pipeline which extends through the heat exchanger. Further, means for detecting the discharge of hot water is arranged along the downstream side of the heat exchanger. A temperature setting means is positioned in a control panel, and operations means are provided for calculating the necessary heat load via an arithmetic and logic unit in accordance with the temperature setting and operations means, i.e., the heat load is calculated in response to receipt of a setting temperature, the water volume, the water temperature, and the hot water temperature. When the necessary heat load established is less than a predetermined standard value for the heat load, the No. 2 burner is selected by having an electrical valve perform an on-off switching action in a cycle responsive to the value of the necessary heat load. Further, when the value of the necessary heat load calculated is greater than the standard value, either the No. 1 or the No. 2 burner is selected; or, otherwise, both of the burners are selected and the electrical valve is forced to open in accordance with a standard value established in response to the necessary heat load. Further, a selecting device or means is provided for selecting and commanding the opening ratio of a proportional gas valve which is controllable in response to the necessary heat load. This selecting means or device has different standard values for selecting the preferred burner and a method of controlling the heat value in accordance with when the necessary heat load varies, i.e., when it increases, and to the contrary, when it decreases. The standard value of the heat load will be established at a lower value when it decreases than when it increases.

3. Function of Means No. 2

Thus, in accordance with the present invention, the necessary heat load is divided into an increasing direction and a decreasing direction, respectively. As a result, the system results in two different types of values, i.e., a standard value which is lower when the heat load decreases and higher when it is increasing. Accordingly, when the necessary heat load increases, it will exceed a predetermined standard value, and the burner being used will be switched or stepped upwardly; however, in contrast, if the necessary heat load begins to vary inversely, i.e., if it decreases, the burner used will not be switched until the value of the variation decreases beyond a second standard value which has been established in the decreasing direction.

BRIEF DESCRIPTION OF THE DRAWINGS

FIG. 38 is a flow chart illustrating a program used in accordance with the G-type device.

TAILED DESCRIPTION OF THE DRAWINGS

Hereinafter, the practical or working examples of the present invention will be described in detail based upon all of the accompanying drawings.

Figure 1A:
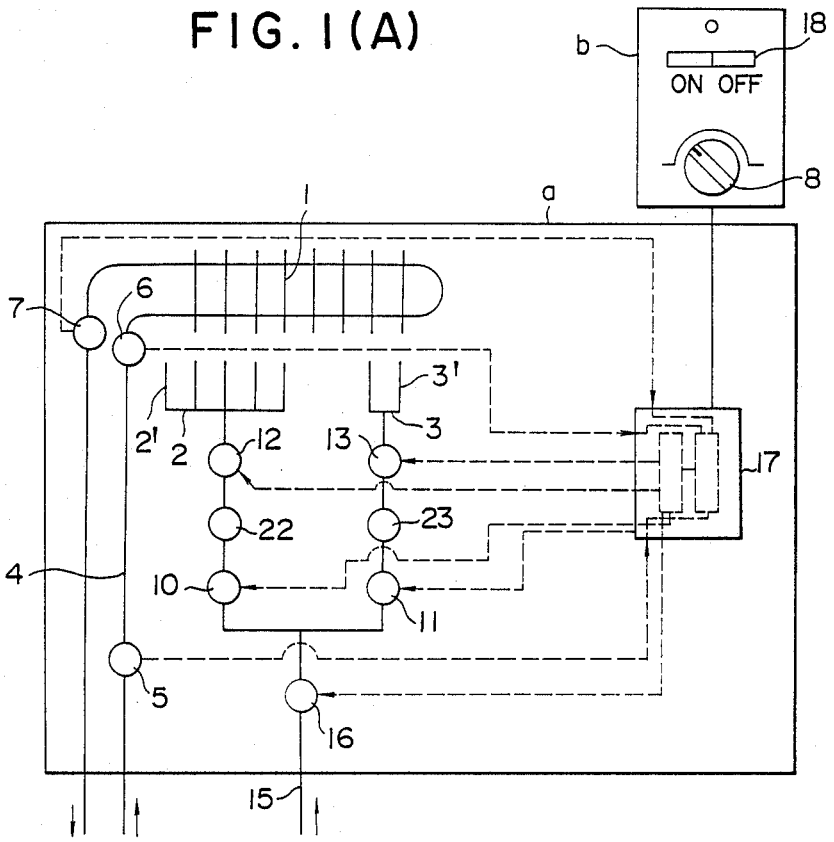
FIG. 1A is a schematic view illustrating the basic apparatus of the present invention.
Figure 1B:
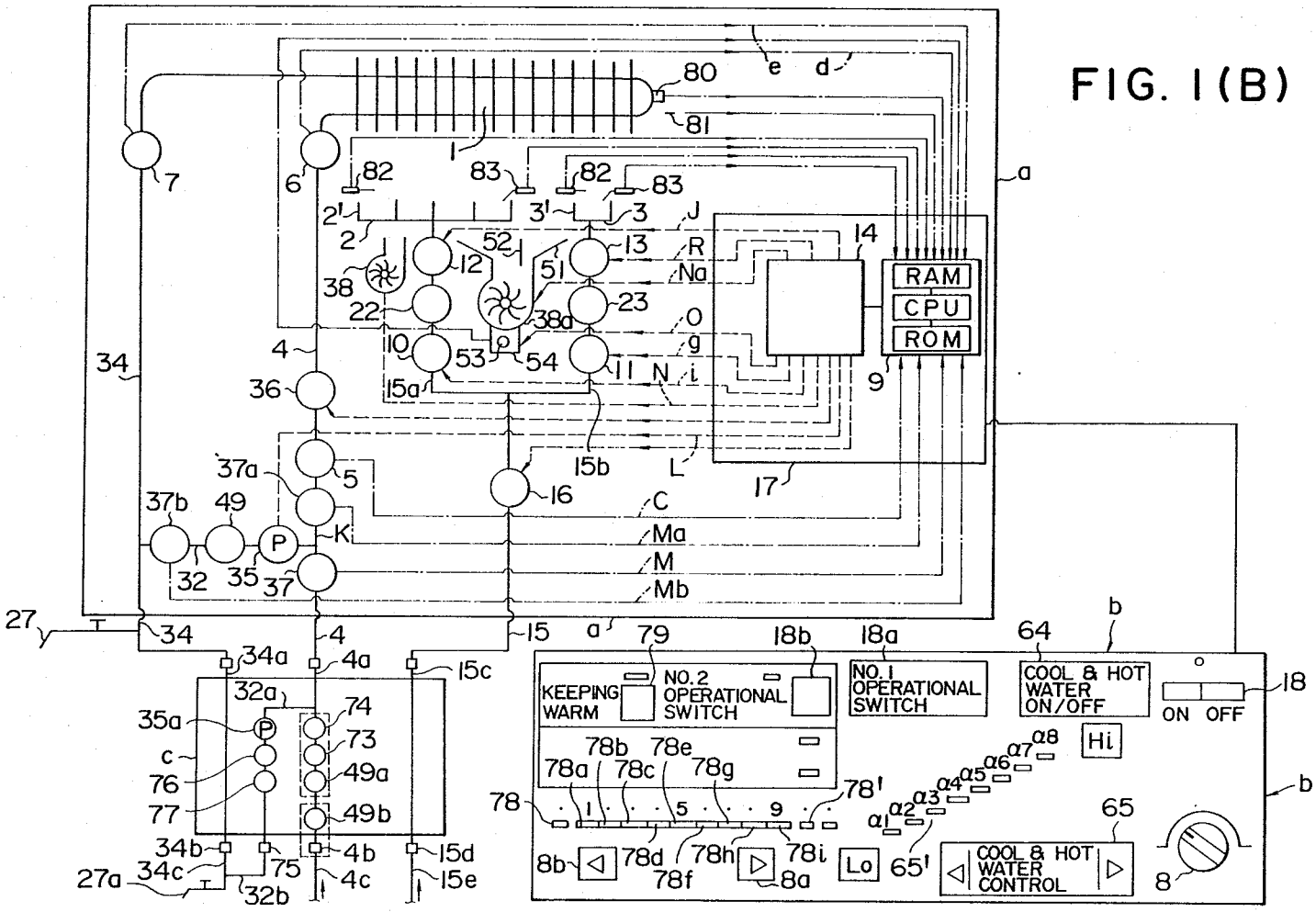
FIG. 1B is a schematic view illustrating the present invention of FIG. 1A in more detail.

FIGS. 1A and 1B disclose a water heater (a) and a control panel (b). The water heater includes two burners which are positioned against, i.e., adjacent to, a heat exchanger unit 1. More specifically, a first or No. 1 burner 2 and a second or No. 2 burner 3 are provided. A fuel gas is adapted to be fed into the first burner and/or the second burner through a feeding gas pipeline 15, then combustion occurs, and water flowing into feeding water pipeline 4 is heated within heat exchanger 1.

The gas pipeline 15 then branches off at a halfway or mid point position into a first or No. 1 gas pipeline 15*a* which is connected to the first burner 2 and a second or No. 2 gas pipeline 15*b* connected to the second burner 3, respectively. A source or electrical valve 16 is arranged upstream of the area where the gas pipeline branches into sections 15*a* and 15*b*. A first or No. 1 electrical valve 10 and a first or No. 1 proportional control valve 12 are arranged along the first gas pipeline 15*a;* and a second or No. 2 electrical valve 11 and a second or No. 2 proportional control valve 13 are arranged along the second gas pipeline 15*b;* all of the valves are arranged upstream of the source electrical valve 16 and the branched area of pipeline 15.

As a result, the first burner 2 and the second burner 3 will be fed an amount of fuel gas in response to the predetermined opening ratio of the No. 1 and No. 2 proportional control valves 12 and 13 when the first and second electrical valves 10 and 11 are first opened. In this manner, the heat capacity is kept within a controllable range of the first and second proportional control valves 12 and 13 by changing their opening ratio and the feeding gas volumes of values 12 and 13. Hereinafter, this method of controlling the heat capacity will be referred to as "proportional control".

Source electrical valve 16 and electrical valves 10 and 11 can comprise, e.g., solenoid valves. However, other types of valves driven by a motor or the like will also be adaptable for use in this invention.

The first and second burners 2 and 3 will effect intermittent combustion as a result of a repetitive on-off action of valves 10 and 11. Therefore, the system will be able to control the heat capacity within a wide range between the highest heat capacity (when, with a continuous combustion, both proportional control valves 12 and 13 are maintained at a constant full opening and both electrical valves 10 and 11 respond to such opening with their longest on-time in comparison to their off-time,) and, in contrast, the lowest heat capacity, even near a value of zero (when the on-time of both electrical valves 10 and 11 is quite reduced, i.e., near zero, in comparison to the off-time of the valves). Hereinafter, this method of controlling the heat capacity is referred to as "intermittent combustion control".

The first and second burners 2 and 3 are adapted to have different capacities, one larger than the other, and the lowest limit combustion capacity of the burner having the larger capacity is arranged to be smaller than the highest limit combustion capacity of the other burner, which has a small capacity which is proportionally controlled by a proportional control valve.

Further, in this working embodiment, the first burner 2 comprises five burner nozzle sections so as to attain a No. 4 combustion capacity at the lowest level and a No. 15 combustion capacity at the highest level. Further, the second burner 3 comprises two burner nozzle sections so as to have a No. 1.6 combustion capacity at the lowest level and a No. 6 combustion capacity at its highest level.

The combustion capacities referred to relate to the Japanese manufacturer's private classification numbers of burner size, and is based upon an output unit such that a No. 1 combustion capacity is equal to 25 Kcal per minute; therefore, e.g., the No. 4 combustion capacity is 100 Kcal per minute.

As a result, water heater (a) will be able to control heat capacity within a range between No. 1.6 and No. 6 of the combustion capacity when the second burner 3 is used and is under proportional control, and within a range between No. 4 and No. 15 combustion capacities when the first burner 2 is used alone and is under proportional control. Further, the system can control heat capacity within a range between No. 15 and No. 21 combustion capacities when both the first and second burners are used and are under proportional control.

Further, water heater (a) will be capable of controlling heat capacity within a range between No. 0 and No. 1.6 combustion capacities when second burner 3 is used alone, with the second or No. 2 proportional control valve 13 being maintained at a reasonable opening; this device can be suited, e.g., to the No. 3 combustion capacity when, for example, the on-off action of the second electrical valve 11 is repeated, and, accordingly, when intermittent combustion is effected by varying the on-off time ratio.

As a result, water heater (a) can control heat capacity within a range between No. 0 and No. 21 combustion capacities via a suitable combination of burners and selected switching between the burners; as well a by switching between proportional control and intermittent combustion control of burners 2 and 3.

On the other hand, a water volume sensor 5 is positioned upstream of heat exchanger 1 along feeding water pipeline 4. A feeding water temperature sensor 6 is arranged on the upstream side of the heat exchanger also, and further, a discharge hot water temperature sensor is arranged downstream of the heat exchanger 1 adjacent an exit of the heat exchanger.

Electrical valve 10, proportional control valve 12, electrical valve 11, proportional control valve 13, water volume sensor 5, feeding water temperature sensor 6, and discharging hot water temperature sensor 7 are respectively electrically connected to a microprocessor 17. Water volume sensor 5 will detect the water volume, in the form of a water flow rate shown by a Q-value, which water flows into feeding water pipeline 4, and the value will be transmitted into microprocessor 1 7 as detected data.

The water volume detected above is regulated by a faucet and/or a separate instrument for hot-water supply 27 (hereinafter this apparatus is referred to as a faucet and the like 27, or faucet 27) in which the end of feeding water pipeline 4 is positioned.

Feeding water temperature sensor 6 will detect the feeding water temperature and will show the same as a value Tc which is to be fed into heat exchanger 1. Discharging hot water temperature sensor 7 will detect the temperature of hot water discharged from heat exchanger 1 in the form of a value Th. The electrical signals which result from both of these sensors will be transmitted into an analog-digital convertor as a voltage, will be converted into data as Tc- and Th-values via the A/D convertor, which values will be transmitted into microprocessor 17.

Furthermore, control panel (b) includes a power source switch 18 and a temperature setting device 8. The temperature setting means establishes a value Ts for a set up temperature, which is transmitted into an A/D convertor 19, illustrated in FIG. 2. Although the above Ts-value is simply a sort of voltage at this stage, it is thereafter converted to Ts-value data via the A/D convertor, and is transmitted into microprocessor 17.

Figure 2:
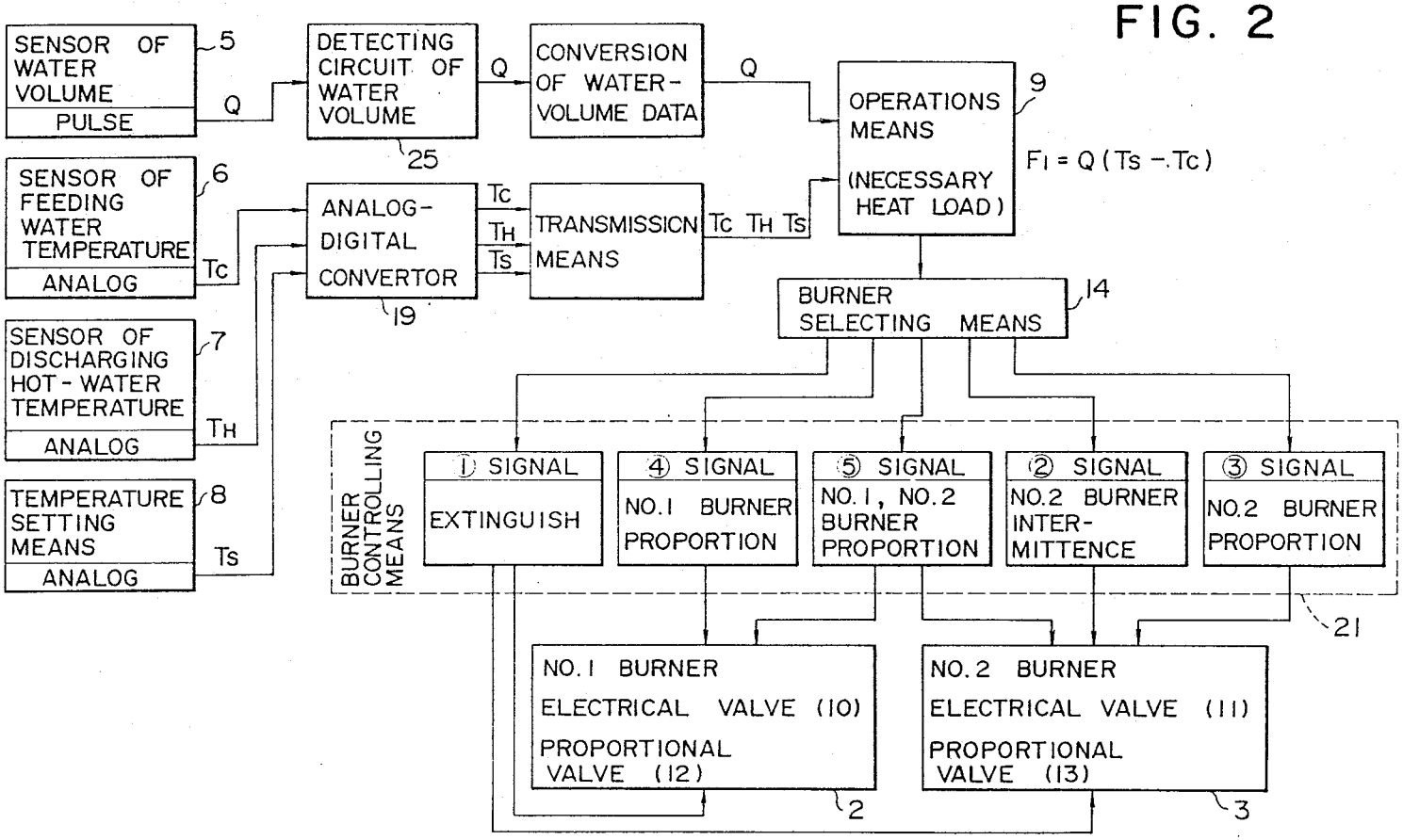
FIG. 2 is a block diagram illustrating the use of the first invention.

Microprocessor 17 is housed in water heater body (a) and itself includes an operation means or device 9, illustrated in FIG. 1B and FIG. 2, which calculates the necessary heat load. It further comprises a burner selection means 14 which determines which burner is preferred and which control method is suitable, both in accordance with a necessary heat load calculated by the operation device 9.

The operation device accepts the Q-value of water volume in the converted form of a pulse signal from the water volume sensor 5, and also accepts each value of Ts, Tc and Th which are transmitted from temperature setting means 8, the feeding water temperature sensor 6, and the discharge hot water temperature sensor 7, via the A/D convertor; it thereafter calculates the necessary heat load in accordance with such data.

Burner selecting apparatus 14 sends the necessary signal into burner control device 21 in order to drive electrical valves 10 and 11 and proportional control valves 12 and 13 in response to a necessary heat load which is indicated as an F1-value calculated by operation device 9.

Each of the above signals is then divided into 5 types of signals, i.e., between a first signal and a fifth signal; the first, i.e., 1-signal, closes the No. 1 and No. 2 electrical valves 2 and 3 as well as the No. 1 and No. 2 proportional control valves 12 and 13; the second, i.e., 2-signal, closes the No. 1 electrical valve 10 and the No. 1 proportional control valve 12, while simultaneously driving the No. 2 electrical valve 11 in an intermittent on-off action in response to a necessary heat load value F1 in a suitable cycle, and it also opens the No. 2 proportional control valve 13 with an opening which is suitable for the No. 3 combustion capacity; the third, i.e., 3-signal, closes the No. 1 electrical valve 10 and No. 1 proportional control valve 12, opens the No. 2 electrical valve 11, and also drives the No. 2 proportional control valve 13 in response to the necessary heat load value F1, in a proportional fashion; the fourth, i.e., 4-signal, opens the No. 1 electrical valve 10, and it drives the No. 1 proportional control valve 12 in a proportional fashion in response to the necessary heat load value F1, as well as opens the No. 2 electrical valve 11 and the No. 2 proportional control valve 13; the fifth, i.e., 5-signal, will open the No. 1 and No. 2 electrical valves 2 and 3, and will drive the No. 1 and No. 2 proportional control valves 12 and 13, respectively, in a proportional fashion in response to a necessary heat load value F1.

Hereinafter, the action of the burner selecting device 14 will be explained with respect to the block diagram of FIG. 2.

First, when the No. 1 and No. 2 burners 2 and 3 are to be extinguished, respectively, i.e., as occurs when a faucet or similar structure 27 is opened, and when the necessary heat load F1 is <No. 0.1 of combustion capacity calculated b operation device 9 (operation device 9 is activated when a water volume is detected by water volume sensor 5), burner selecting means 14 will dispatch the 1-signal. Accordingly, in this situation fire extinguishing condition will be continued.

When No. 0.1 is ≦F1< No. 2.5, the second, i.e., 2-signal will be sent. In this situation, water heater (a) will enter a phase of intermittent combustion of the No. 2 burner 3.

When No. 2.5≦F1<No. 4, the 3-signal will be sent. As a result, water heater (a) will enter into a phase in of proportional control of the combustion of the No. 2 burner 3.

When No. 4 ≦F1<No. 8, the 4-signal will be sent. In this case, water heater (a) will enter into a phase of proportional control of the combustion of the No. 1 burner 1.

Further, when No. 8 ≦F1, the 5-signal will be sent, and in this situation water heater (a) will enter into a phase of proportional control of the combustion of both of the No. 1 and No. 2 burners 2 and 3, respectively.

Next, when the water heater is in a phase proportional control of the combustion of the No. 2 burner 3, i.e., when F1<No. 0.1, burner selecting device 14 will send the 1-signal, and will extinguish the No. 1 and No. 2 burners 2 and 3, respectively. Further, when No. 0.1 ≦F1< No. 1.6, the 2-signal will be sent and will effect intermittent combustion of the No. 2 burner 3.

When No. 1.6 ≦F1< No. 6, the 3-signal will be sent, and the system will enter a phase in which the combustion of the No. 2 burner 3 is proportionally controlled; and when No. 6 ≦F1 No. 8, it will enter a phase of proportionally control of the combustion of the No. 1 burner 2.

Further, when No. 8 ≦F1, the 5-signal will be sent in order that the combustion of both the No. 1 and No. 2 burners 2 and 3 will be proportionally controlled.

Water heater (a) can come under the control of proportional controlling combustion of the No. 1 burner 2 as follows. When F1< No. 0.1, burner selection device 14 will send the 1-signal, and make the No. 1 and No. 2 burners 2 and 3 enter a fire extinguishing phase; and when No. 0. ≦F1< No. 1.6, the 2-signal is sent and the No. 2 burner 3 enters a phase in which it undergoes intermittent combustion.

Further, when No. 1.6 ≦F1 No. 4, the 3-signal will be sent and will change the control method to proportional control of the combustion of the second burner 3; and when No. 4 ≦F1< No. 10, the 4-signal is sent and the No. 1 burner 2 is proportionally controlled.

Further, when No. 10 F1, the 5-signal is sent and proportionally controls both of the No. 1 and No. 2 burners 2 and 3.

Next, when the No. 1 and No. 2 burners are under the proportional control, and when F1<No. 0.1, burner selection device 14 sends the 1-signal and extinguishes both the No. 1 and No. 2 burners; and when No. 0.1 ≦F1< No. 1.6, the burner selection device sends the 2-signal in order to effect intermittent combustion of the second burner 3 instead.

Further, when No. 1.6 ≦F1< No. 6, it sends the 3-signal and converts only the second burner to proportional control; and, when No. 6 ≦F1< No. 8, the 4-signal is sent and converts the control of only the No. 1 burner 2 to proportional control.

Further, when No. 8 ≦F1, it sends the 5-signal and continues proportional control of both of the No. 1 and No. 2 burners 2 and 3.

Therefore, as explained above, there is a standard value for switching the No. 2 burner 3 between intermittent combustion control and proportional control; the standard value when the intermittent combustion control is changed to proportional control is No. 2.5, and when the proportional control is switched to an intermittent combustion control, the standard value is No. 1.6. The standard value for switching between proportional control of the No. 2 burner 3 and proportional control of the No. 1 burner 2 is as follows: when the proportional control of the No. 2 burner 3 is changed to proportional control of the No. 1 burner 2, No. 6 is the standard value; but when the proportional control is switched from the No. 1 burner 2 to the No. 2 burner 3, No. 4 is the standard value.

Further, the standard value for switching between proportional control of the No. 1 burner 2 alone and proportional control of both the No. 1 and No. 2 burners 2 and 3 is as follows: when proportional control of the No. 1 burner 2 alone is switched to proportional control of both the No. 1 and No. 2 burners 2 and 3, No. 10 is the standard value; in contrast, when proportional control of both of the No. 1 and 2 burners 2 and 3 is switched to proportional control of only the No. 1 burner 2 alone, No. 8 becomes the standard value.

A sources electrical valve 16 of gas heat pipe line 15 is turned on and off in response to an indication from microprocessor 17 to ensure safe operation of the system.

An igniter 82 is attached to each burner 2 and 3 in order to generate an ignition spark which is synchronized with the opening of electrical valves 10 and 11, corresponding to burners 2 and 3, respectively.

1. Problems of Operation

Operation of the instantaneous gas water heater as described above (which water heater is referred to hereinafter as the prototype), provided a satisfactory capability in a laboratory setting. However, in endurance tests aimed at merchandising the product, technical problems occurred (as follows) after a period of time had elapsed.

That is, it was found during tests that the electrical valve arranged along the gas feed pipe line to feed the fuel gas into burners encountered unexpectedly severe damage.

Accordingly, the cause of the damage was investigated thoroughly. During this investigation it was determined that both burners 2 and 3 effected intermittent combustion by repetitive on-off action of the No. 1 and No. 2 electrical valves 10 and 11. In other words, microprocessor 17 includes software which increases the on-off frequency of the electrical valves; as a result, damage resulted to the electrical valves, and particularly serious damage was found in the No. 2 electrical valve 11.

In view of the above disadvantages, the present inventors have improved upon the software, i.e., improved the software so that the No. 2 electrical valve 11 of the No. 2 burner 3 will be limited in its on-off operation to situations when the necessary heat load has value lower than the lowest limit combustion capacity of the No. 2 burner 3; i.e., intermittent combustion control is provided electrical valve 11 of the No. 2 burner 3 in order to minimize the on-off frequency of the valve as much as possible.

2. Practical Example of the No. 2 Invention

One practical example of such an improvement which will reduce the on-off frequency of the electrical valve noted above will be described hereinafter.

First, the hardware used includes pipeline systems for feeding water, for discharging hot water, and for feeding fuel gas, a heat exchanger, a burner system, and a proportional gas valve which controls all of these apparatus. The system also includes an electrical valve and other controlling apparatus as in the first invention referred to above. However, the burner selection device 14 forming a part of the software has been improved, and this system is thus hereinafter referred to as the No. 2, or second invention, hereunder.

Figure 3:
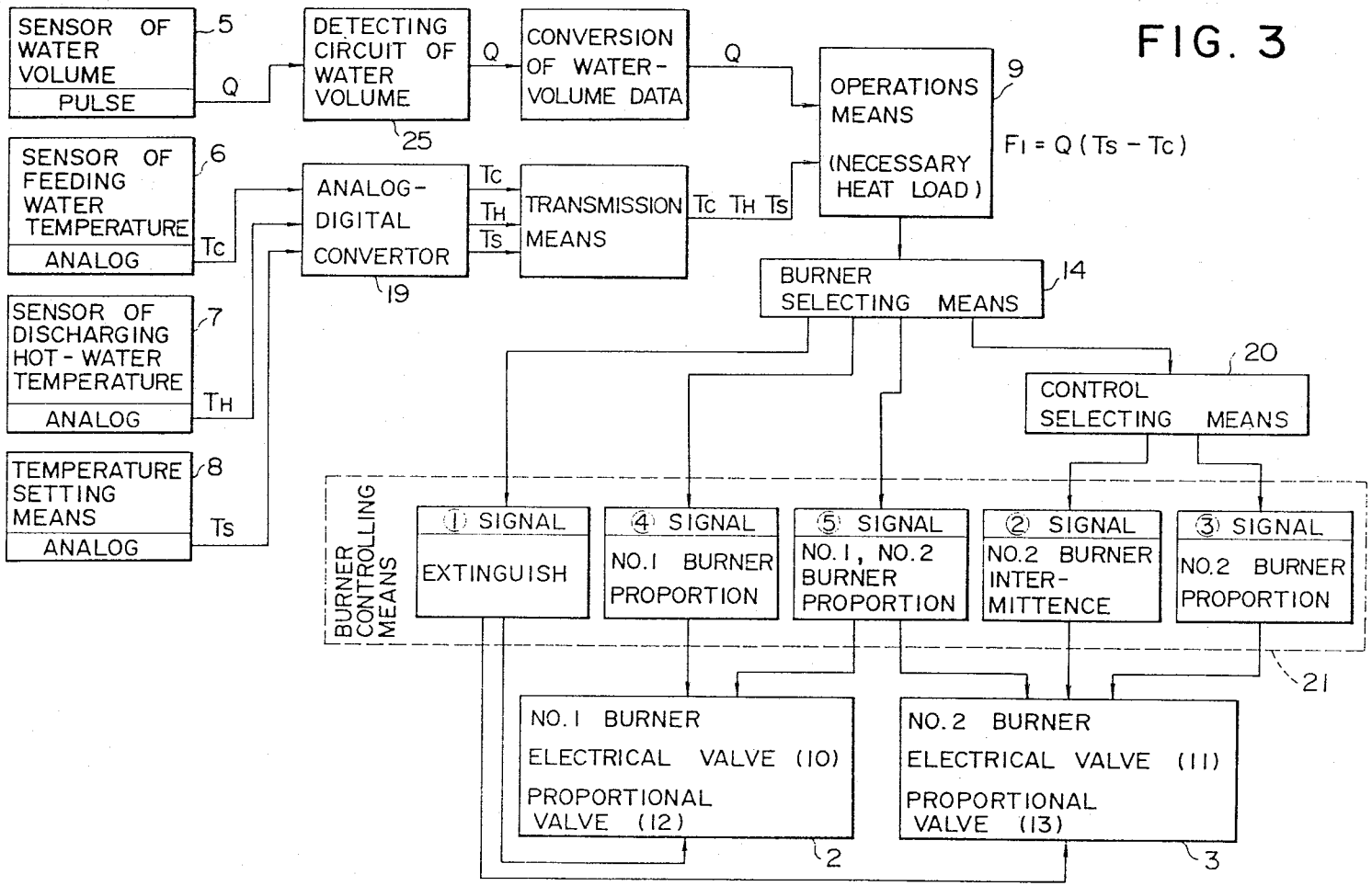
FIG. 3 is a block diagram illustrating the operation and use of a second embodiment of the present invention.

In this second invention, as shown in FIG. 1B and the block diagram of FIG. 3, microprocessor 17 is housed within water heater body (a), and includes an operation device 9 for calculating the necessary heat load value F1; a burner selecting device 14 is provided to select the burner preferred in accordance with the necessary heat load calculated by operation device 9, and a control selecting device 20 is provided to select the method of controlling the heating capacity of the No. 2 burner 3 when the burner selecting device 14 selects, e.g., the No. 2 burner 3; and, further, a burner control device or means 21 is provided for generating the necessary power signal for effecting an on-off action of the electrical valves and for the opening ratios of the No. 1 and No. 2 electrical valve 10 and 11 and the No. 1 and No. 2 proportional control valves 12 and 13, respectively, in response to selection by the burner selection device of a burner(s) and a method of controlling the burner(s).

Operation device 9 initiates action so as to take in water volume Q-data (sensed by Water volume sensor 5) which is converted to a pulse signal. At the same time, data Ts, Tc, and Th, transmitted from temperature setting means 8, feeding water temperature sensor 6, and discharging hot-water temperature sensor 7, respectively, are also received in order to calculate the necessary heat load value F1 in accordance with all of this data.

Burner selection device 14 will make 4 types of selection (Nos. 1–4) relating to operation of a burner by operation device 9 in response to a necessary heat load.

In the block diagram of FIG. 3, selection No. 1 uses neither of the No. 1 or No. 2 burners 2 and 3, and is selected when the necessary heat load is less than the No. 1 standard value.

The selection of No. 2 uses the No. 2 burner 3, and is selected when the necessary heat load is within a range between the No. 1 standard value and the No. 2 standard value.

The selection of No. 3 effects the use of the No. 1 burner 2, and is selected when the necessary heat load is within a range between the No. 2 standard value and the No. 3 standard value.

The selection of No. 4 requires use of both the No. 1 and No. 2 burners 2 and 3 in combination, which are selected when the necessary heat load exceeds the No. 3 standard value.

The respective standard values will be arranged as follows: e.g., the No. 1 standard value is the No. 0.1 combustion capacity, the No. 2 standard value is at No. 6, which relates to the highest combustion capacity of the No. 2 burner 3, and the No. 3 standard value is at No. 15, which is related to the highest combustion capacity of the No. 1 burner 2.

Control selection device 20 will only be able to act when burner selection device 14 selects the No. 2 burner 3.

The control method selected will either be intermittent combustion control or proportional control; therefore, control selection means 20 will select intermittent combustion control when the required heat load is less than the No. 4 standard value, which is arranged between the No. 1 and No. 2 standard values, and will select proportional control when the required heat load is greater than the No. 4 standard value.

The No. 4 standard value will be arranged at the No. 16 combustion capacity, which is located below the lowest limit combustion capacity of the second burner 3, e.g.

Burner control means 21 generates a power signal for driving an electrical valve in an on-off fashion, and generates an opening power signal to a proportional valve which is capable of selectively sending five types of signals in response to receipt of the signal from the burner selecting device 14 and the control selecting device 20.

These five types of signals are basically set forth as follows: an intermittent combustion controlling signal for the second burner 3; a proportional control signal for the second burner 3; a proportional control signal for the first burner 1; a proportional control signal for both the first and second burners 2 and 3; and a fire extinguishing signal for both of the burner 2 and 3.

A fire extinguishing signal (hereinafter referred to as an extinguishing signal) will be sent when burner selecting device 14 has determined not to use either of the first or second burners 2 and 3, and therefore closes both the first and second electrical valves 10 and 11 and the first and second proportional control valves 12 and 13.

Thus, when this extinguishing signal is sent once, both the first and second burners will enter a state of fire extinguishing.

The signal for intermittent combustion of the second burner 3 will be sent when burner selecting device 14 has decided to use the second burner 3, and when control selecting device 20 has determined that such control will be an intermittent combustion control. In this case, the first electrical valve 10 and first proportional control valve 12 will be closed, the second electrical valve will be turned on and off intermittently in a cycle at a time ratio of on off times; and simultaneously, the second proportional control valve 13 will be opened a predetermined amount, e.g., the opening will be suited to the number 3 combustion capacity of the burner.

Therefore, when an intermittent combustion control signal is sent, as described above, the second burner 3 will burn intermittently in accordance with a time-ratio and on-off cycle in response to a necessary required heat load.

The signal (h) for proportional combustion of the second burner 3 will be sent when burner selecting device 14 selects the second burner 3 and when the control selecting device 20 selects proportional control; in this case, the first electrical valve 10, first proportional control valve 12 and second electrical valve 11 are opened simultaneously, and the second proportional control valve 13 is operated with a proportional action in response to the necessary heat load which has been determined.

Therefore, when such a proportional control signal (h) is sent, the second burner 3 will undergo continuous combustion with a suitable amount of fuel gas in response to a required heat load.

The proportional combustion signal (J) for the first burner 2 will be sent when burner selecting device 14 selects the first burner 2 to be used, the first electrical valve 10 will be opened, the first proportional control valve 12 will be operated in response to the required heat load, and the second electrical valve 11 and second proportional control valve 13 will also be opened.

Thus, when signal (J) is sent, the second burner 3 will effect continuous combustion with a suitable amount of fuel gas in response to the necessary or required heat load.

Accordingly, a proportional combustion signal for the first and second burners, i.e., (h) and (J), will be sent when burner selecting device 14 selects both the first and second burners 2 and 3 to be used; in this case, the first and second electrical valves 10 and 11 are opened and both the first and second proportional control valves 12 and 13 will be operated in response to th determination of a necessary heat load.

Therefore, when such signals are sent, the first and second burners 2 and 3 will effect continuous combustion in a common fashion with a suitable amount of fuel gas in response to the determination of a necessary heat load.

As explained above, the lowest limit combustion capacity of the first burner 2 was set at the No. 4 combustion capacity, and the highest limit combustion capacity of th second burner 3 was set at No. 6 combustion capacity; therefore, the apparatus will be able to control the combustion capacity, during use, of the first burner 2 or the second burner 3, whenever the necessary heat load is within a range between the No. 4 and No. 6 combustion capacities. Further, even though the necessary heat load had a value greater than that suited to a No. 1.6 combustion capacity, the second burner 3 will still be able to respond with an intermittent combustion control in accordance with a cycle and the on-off timing ratio of intermittent combustion.

Thus, the standard value for burner selection and control selection need not always be limited to the above-reference standard values; instead, it is possible to determine the standard value for any particular control situation, so that it is possible to effect different standard values, each being between an increased necessary heat load and a decreased necessary heat load.

3. Explanation of the Second Invention a. Technical Problem in the Second Invention As a general concept, a suitably stabilized automatic control must be capable of providing a superior transient response with good dynamic characteristics when a sudden variation is input into the system within a short time. In other words, it must respond quickly to reach a state of equilibrium between input and output.

In this invention, the transient response must be a linearly curved step-response; however, a satisfactory response is not always evidenced in practice. In other words, software has remained part of the problem. To this end, the second invention of the present application is directed to overcoming this problem as follows.

That is, it is assumed that the second invention is operating and is discharging hot water at a comparatively low temperature, and that the second burner is in a slow cycle of on-off combustion. At this time, the set up temperature is suddenly changed to a high temperature, i.e., the required heat load is considered to finally settle within a region of the single combustion of the first burner undergoing proportional operation. However, some confusion will occur during switching of the burners. In other words, due to the overdrive of a feedback effected by a time delay of the output side in response to the suddenly changed input value, the first and second burners unexpectedly both effect combustion rather than only the first burner. Due to this unexpected result, the hot water discharge temperature rises suddenly, and reflects a secondarily curved step-response having a large overshoot.

Thereafter, after a period of time has elapsed, proportional operation of the first burner is properly restored, and it can achieve a normal equilibrium output state.

When the burners are confused as to operation, one result is that, the damage ratio of each operating part of the device will increase, e.g., because the operational frequency of the electrical valve and similar structure will be increased.

4. Method of Resolving the Problem of the Second Invention

In the control system of the second invention, burner selection is effected by the required heat load which is calculated by a feed forward of the set up temperature, the water feeding temperature, and the water flow rate. However, even if the feeding hot water temperature does not rise to the level of set up temperature during an initial stage of combustion, the system will still hold a partial charge of the selected burner's combustion. Further, if there is a large amount of return feedback, proper combustion will still be maintained, including an amount of feedback within the range of the highest combustion capacity of the burner which in operation. As a result, improvements were incorporated in the software to prevent the miscasting of burners as noted above. Such an improvement is referred to as the third invention in this application.

Figure 4:
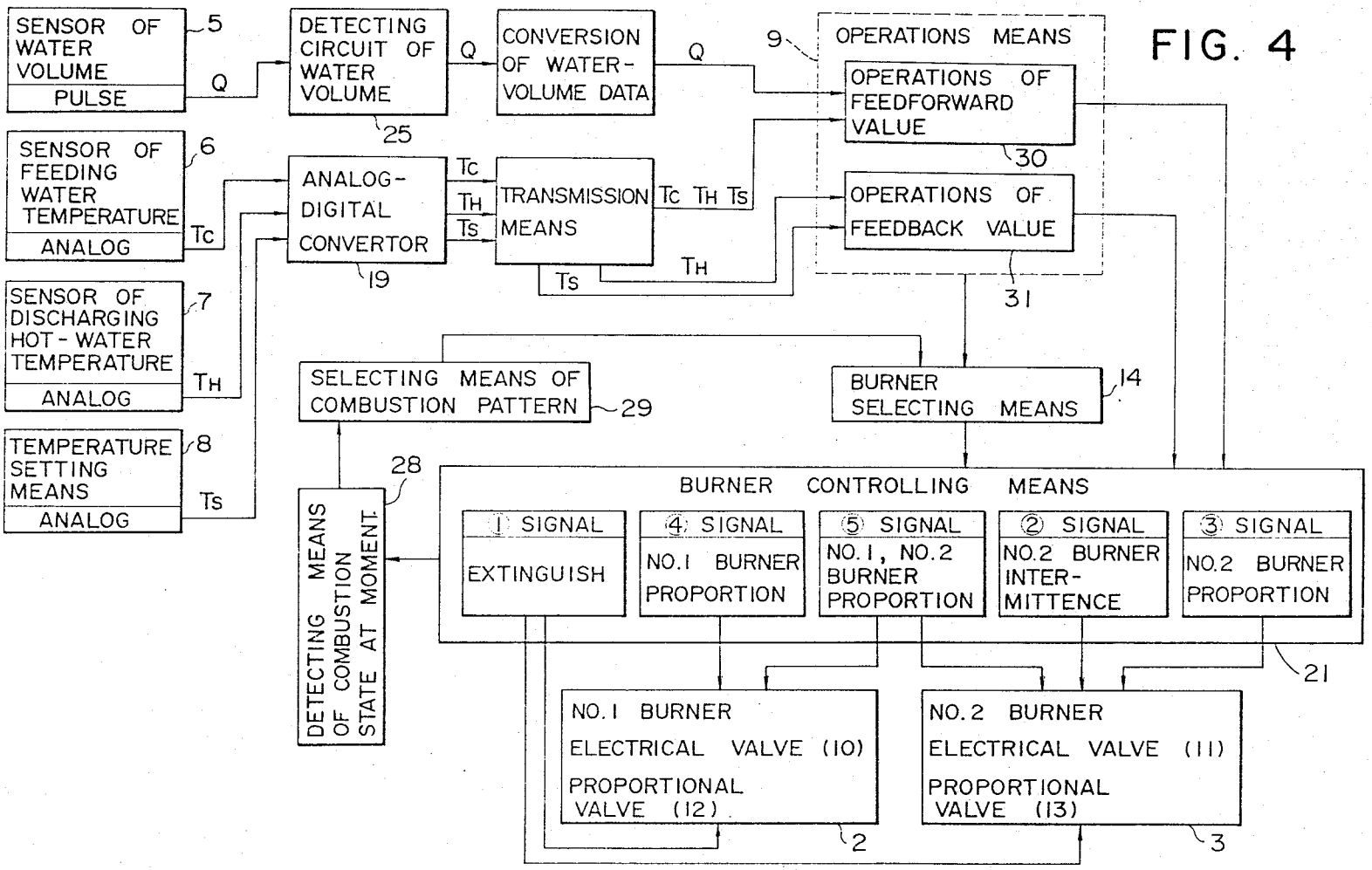
FIG. 4 is a block diagram illustrating the operation of a third embodiment of the present invention.
Figure 5:
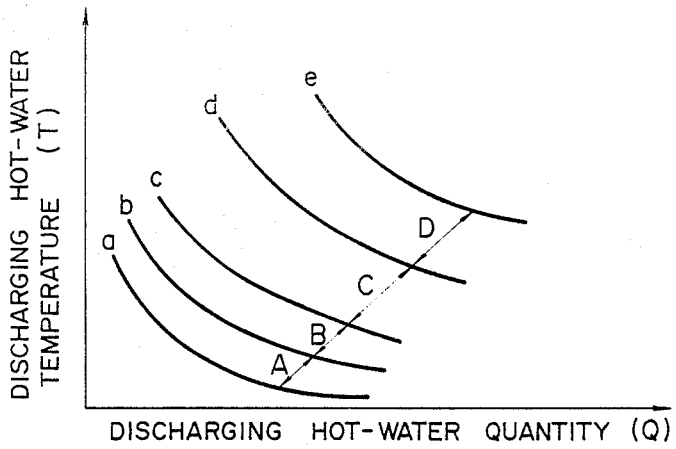
FIG. 5 is a graph illustrating the boundaries of each combustion zone.

In the third invention, as illustrated in FIGS. 1 and 4, microprocessor 17 provides six different processing modes of operation: (1) means for detecting (28) the combustion state at a given moment in order to detect the burner operating at the moment and the combustion state at a given moment; (2) means for selecting a combustion pattern 29 for selecting a predetermined combustion pattern from a plurality of predetermined patterns in accordance with the state of an operated burner and its combustion at any given moment in time, i.e., whether the burner is in a fire extinguishing mode, under intermittent combustion, or under proportional combustion; (3) means for operating a feed forward value 30 to calculate the required heat load (referred to hereinafter as the feedforward necessary heat load) in accordance with the value of a hot water discharge temperature value Th, a set up temperature value Ts, and a proportional gain; (5) a burner selecting device 14 for selecting and determining the preferred burner and the method of combustion of the burner from a selected combustion pattern, all in response to the required feedforward heat load; and (6) a burner control device 21 for controlling a selected burner with a feedforward value including an additional feed back value.

Figure 6:
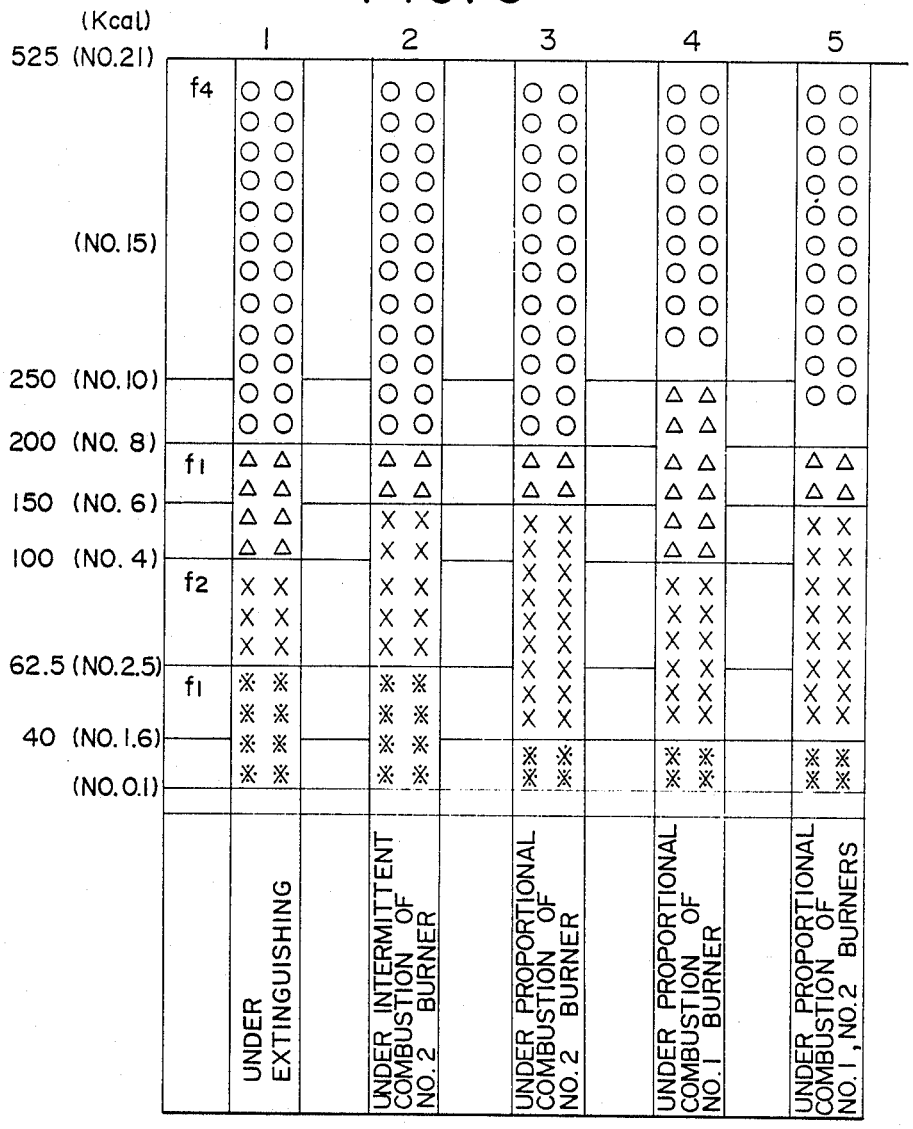
FIG. 6 is a combustion pattern in accordance with the third embodiment of the present invention.

As illustrated in FIG. 6, the combustion patterns are arranged preliminarily with five patterns ranging from a first or No. 1 pattern to a fifth or No. 5 pattern in accordance with the burner being operated at a given moment in time and its combustion state at that time. Further, these five patterns, between No. 1 and No. 5, are arranged in order to correspond to a value converted from boundaries $f_1$, and $f_2$, and $f_3$ of combustion zones A, B, C and D, all in response to an increase or decrease in the direction of the heat load.

Figure 7:
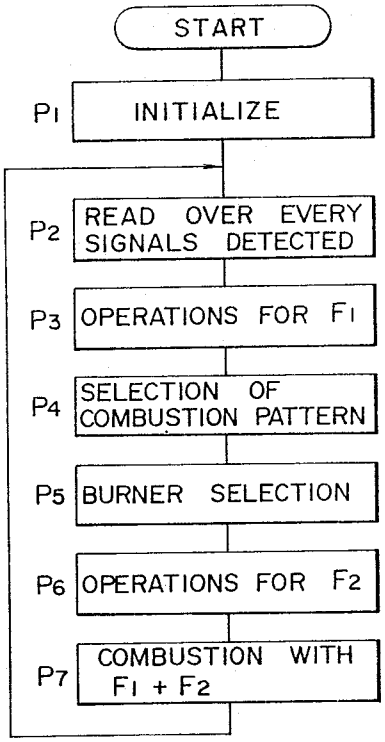
FIG. 7 is a flow chart of the third embodiment of the present invention which illustrates the proportional control of both of the No. 1 and No. 2 burners.

Such an instantaneous gas water heater is controlled with reference to the flow chart program of FIG. 7. In other words, switching on of power source switch 18 provides power to the system, the system is initialized in step P1, and read over signals are detected in Step P2, with the $F_1$-value of the feedforward necessary heat load being calculated in Step P3.

Figure 8:
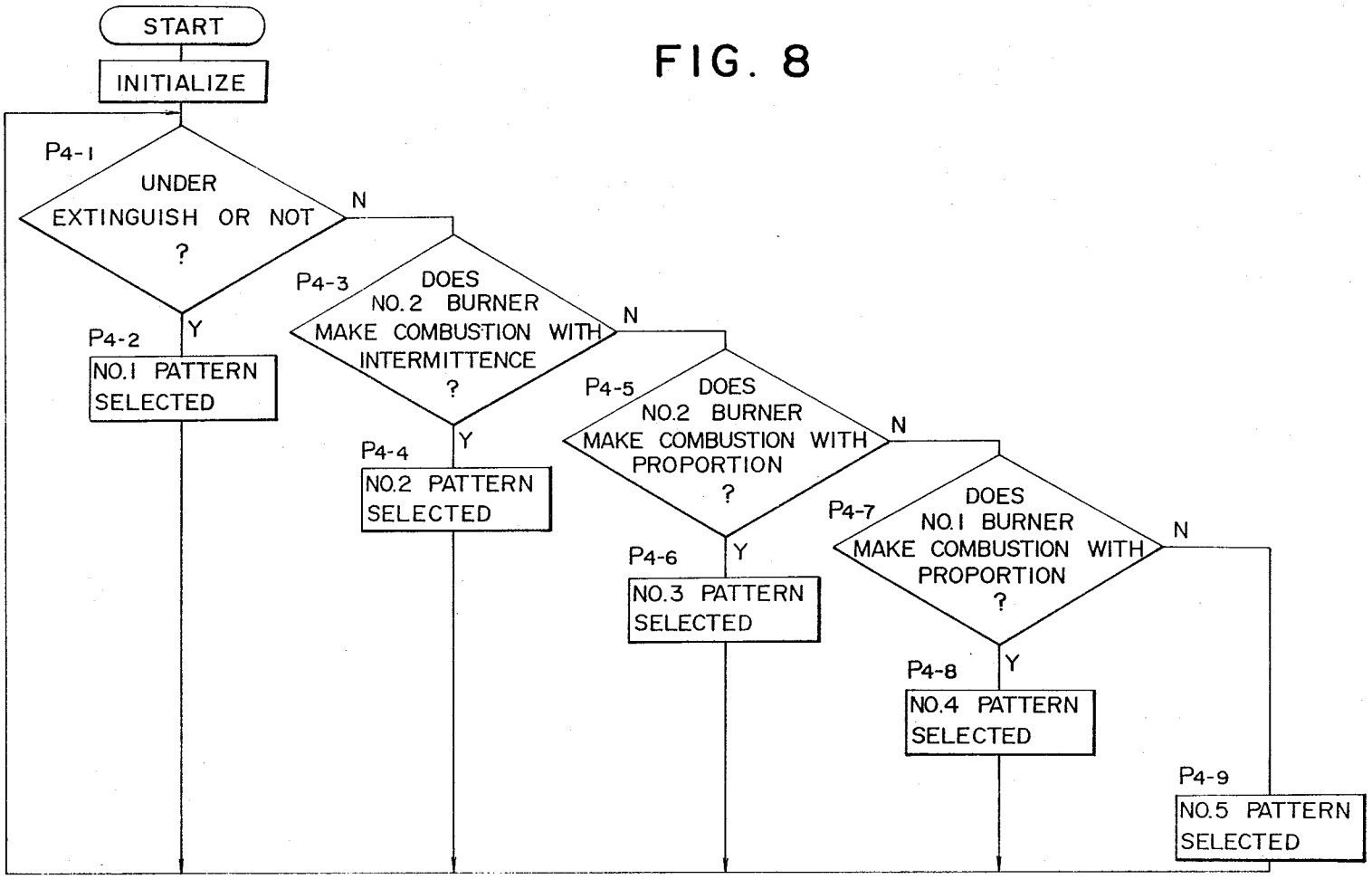
FIG. 8 is a flow chart which illustrates a pattern selected in accordance with the third, i.e., No. 3, embodiment of the present invention.

In Step P4, a predetermined combustion pattern is selected from five combustion patterns, as illustrated in FIG. 6, in response to the burner being presently operated and its present combustion state. For example, as illustrated in FIG. 8 of a flow chart program for pattern selection, the first or No. 1 pattern is selected when the burner is in a fire extinguishing mode, the second or No. 2 pattern is selected when the second burner is in an intermittent combustion mode, the third or No. 3 pattern is selected when the second burner is in a proportional combustion mode, the fourth or No. 4 pattern is selected when the first burner is undergoing proportional combustion, and the fifth or No. 5 pattern is selected for all cases other than the four detailed herein.

Figure 9:
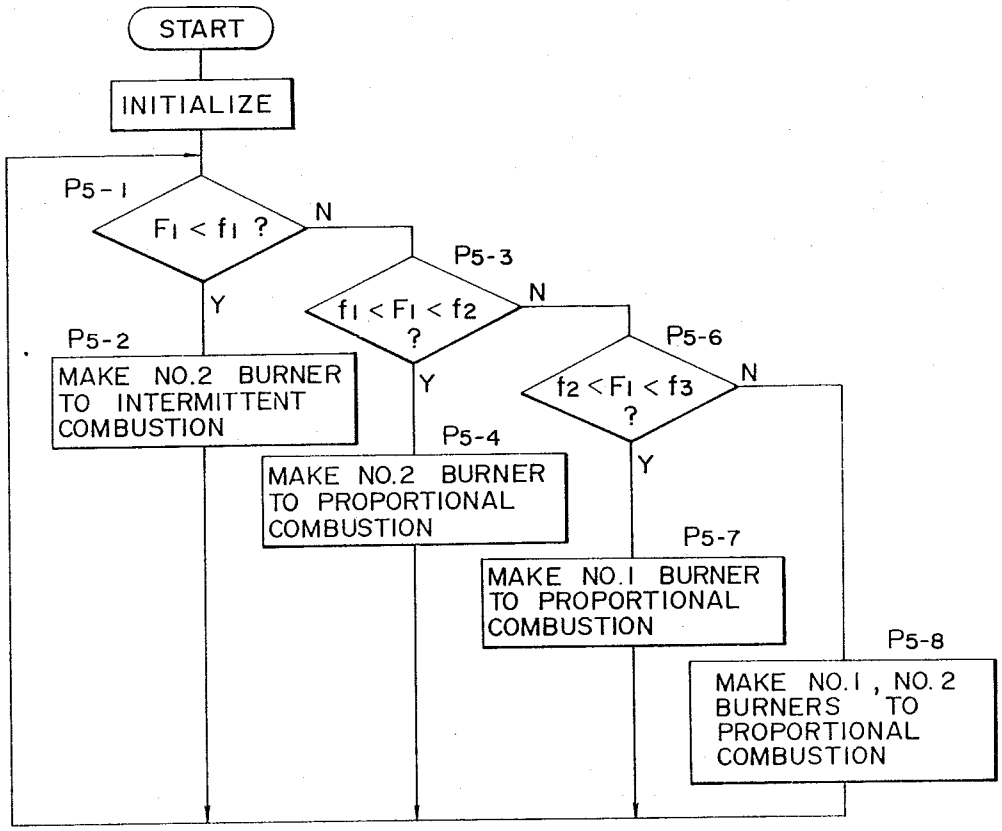
FIG. 9 is a flow chart of a program which illustrates the burner selection in accordance with the third embodiment of the present invention.

In Step P5, a feed forward value operation means 30 will determine the preferred burner and its combustion method in a combustion zone which is suited to the $F_1$-value of the feed forward necessary heat load, which is calculated by operation device 30. For example, when the first pattern is selected, the boundaries of combustion zones A, B, C and D are $f_1$, $f_2$, and $f_3$, and the treatment of burner selection for the first pattern is effected with reference to FIG. 9. In such case, the second burner is operated under intermittent combustion when the $F_1$-value of the feedforward necessary heat load is suited to a range (i.e., the A-zone) of $F_1<f_1$, the second burner is operated in a proportional combustion mode when the $F_1$-value is within a range (i.e., the B-zone) of $f_1<F_1<f_2$, and the first burner is operated when the $F_1$-value is within a range (i.e., the C-zone) of $f_2<F_1<f_3$. The first and second burners are operated in a proportional combustion mode simultaneously when the $F_1$-value is within a range (i.e., the D-zone) outside of the above-noted A, B and C zones, and combustion is thus controlled until the combustion capacity is suited to a range representative of the proportional zones of the first and second burners. Similarly, in the process of approaching a set up temperature, a sufficient feedback value is given; accordingly, it can discharge hot water at a required set up temperature immediately, and the character of its response is better than that of a set up temperature with a large temperature difference. In the same way, when the hot water discharge temperature is decreasing, a feedback value is added into the feedback necessary heat load, and as a result it can control the combustion with an improved character of response. Accordingly, it is capable of igniting the burner from the beginning, when it should be ignited, after only a few seconds of lag time during the time when the hot-water discharge temperature increases to a value equal to the set up temperature, so that no switching to another burner will result from the same.

Further, each combustion pattern, as illustrated in FIG. 6, is arranged so as to be able to improve the capability of the hot water discharge in each of combustion zones A, B, C and D. In other words, in the fourth or No. 4 pattern, a boundary between proportional combustion zone D of the first and second burners 2 and 3, and the proportional combustion zone C of the first burner 2, is arranged at the No. 10 combustion capacity. However, the boundaries of the first, second, third and fifth patterns are arranged at the No. 8 combustion capacity, which is less than the No. 10 capacity noted above. In other words, the goal of the direction of heat increase is higher, i.e., No. 10 capacity, but the goal of the heat when going in the decreasing direction is lower, i.e., the No. 8 capacity. The relationship of the different boundaries is also observable in the next group, i.e., in the relationship between the early group the first, second and third patterns, and the last one, or fifth pattern; for example, the boundary between the No. 4 (or C) zone and the fifth (or D) zone is set at a No. 8 combustion capacity, so that even if the No. 9 or ninth combustion capacity of the feed forward necessary heat load has been attained, it leads to both the first and second burners 2 and 3 immediately and effects proportional combustion with a larger feed back value. As a result, the hot water discharge capability of the burners will be further increased. Conventionally, a required heat load was suitable if it was between No. 2.5 and No. 9, e.g., in such a conventional case, the No. 9 combustion capacity was suited to a combustion (or C) zone of the first burner 2 alone, so that it might make the combustion capability of the first burner 2 lie within a range between No. 4 and No. 15. In such a case, the No. 9 combustion capacity of the feed forward would be $F_1$, and, further, its final heat load would be F, e.g.; thus, the feedback heat load $F_2$ would be equal to a No. 6 combustion capacity, which results from the equation $F_2=F-F_1$, so that the No. 6 combustion capacity of the feedback will be immediately driven. In view of this, in the practical example being given, because the boundary is decreased to a No. 8 combustion capacity, the No. 9 combustion capacity of the necessary heat load will correspond to the proportional (or D) combustion zone of the first and second burners 2 and 3. In this fashion, $F_2$ will equal the No. 12 combustion capacity when $F_1$ equals the No. 9 combustion capacity; therefore, the No. 12 combustion capacity of the feedback will be capable of being driven immediately, so that, in comparison to a conventional situation, about twice as large a feedback will be driven in this example. Similarly, enough feedback will be driven to result in the immediate discharge of hot water at the set up temperature.

Further, in the fifth pattern as illustrated in FIG. 6, the boundary between the C-zone and the B-zone is arranged at the No. 6 combustion capacity, which is increased from the No. 4 combustion capacity for the fourth pattern. Therefore, during combustion of the first and second burners 2 and 3, when the required feed back $F_1$-value is reduced to the No. 5 combustion capacity, it will be transmitted to the B-zone from the D-zone immediately, and will be controlled so as to drive a large amount of negative (i.e., minus) feedback.

In the first and improved inventions which have been described above with respect to the instantaneous gas water heater, a large type of water heater with a large hot water discharge capability has been provided for the combustion of a plurality of gas burners; in this fashion, stable control is effected by microcomputer software having various capabilities.

5. Description of the Fourth Invention

The fourth invention has two major intents. The first intent is fundamental, and relates to the solution of combining the combustion of a plurality of ga burners (including when undergoing intermittent combustion) which are under the control of a microcomputer. The other meaning is a more commercial one, relating to most improved technology, where it is understandable that merchandise should tend towards being high-class and deluxe over a period of time. This trend, however, is not always welcome when economic efficiency is desired, which is one important feature that any invention must have.

In accordance with this requirement of economic efficiency, and contrary to the trend of making a high-class and deluxe product which is represented by the prototype of the first invention, to the contrary, there is a market need for a small type of instantaneous gas water heater. Therefore, it would not be desirable to ignore the potential offered by such technology in less expensive water heaters.

Accordingly, in order to respond to the requirements of a simplified small type of heater, it will be necessary to easily obtain a simplified small type of instantaneous gas water heater only by extracting the suitable technology from a variety of technologies relating to the discharge of hot water, which technologies are peculiar to the first invention described above and other improved inventions. This type of water heater will be detailed hereinafter.

6. Explanation of the Improved Technology of the Fourth Invention

As an example, this improvement is explained with respect to the first burner as well as with respect to the second burner.

Relating to an improved and simplified type burner, the combustion system first diverts the firs prototype burner to one purpose, and the control method is diverted to an intermittent combustion method peculiar to the second prototype burner.

In this fashion, the heat source for the instantaneous gas water heater is subjected to on-off control by the unit of one burner.

The control method is simplified by being controlled in response to a necessary heat operable with an on-off time ratio within a cycle of intermittent combustion which is peculiar to the No. 2 prototype burner. Further, the required heat load, which is to be the standard controlled value, will be calculated by a feedforward set in due course by a setting temperature, a feeding water temperature, a hot water discharge temperature, and a water flow rate, as in the previously mentioned prototype. However, as mentioned above with respect to the prototype, the instantaneous gas water heater has a variety of factors which generally prevent stable control, and accordingly it is a serious question in a simple type of instantaneous water heater how such control will be stabilized.

To this end, the present inventors offer a simplified controlled method. In other words, when one cycle of an on-off combustion cycle is finished, an operation means or device 9 of the control system will immediately calculate the average amount of heat capacity used during that cycle and will memorize it in due course.

Further, when the next combustion cycle again starts, the burner combustion will be controlled with a pulse time which is determined by an on-off time ratio in accordance with the average amount of heat capacity which has already been memorized. That is, via this technology it will be possible to obtain a volume of hot water discharged by controlling the on-off combustion cycle.

Figure 10:
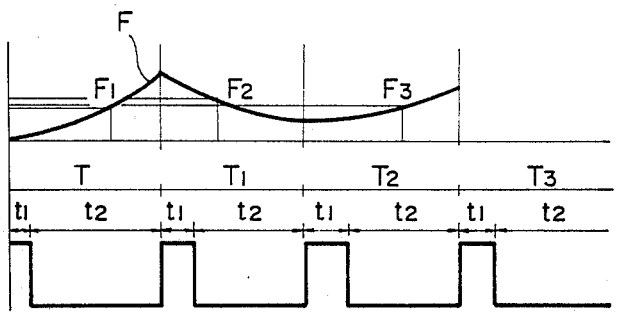
FIG. 10 is a graph which illustrates the relationship between the necessary heat load during a cycle of intermittent combustion and the ratio of on and off times of the burners in accordance with the fourth, i.e., No. 4, embodiment of the present invention.

Accordingly, the simplified and improved technology of the prototype, which features combustion time control, will be detailed based upon the attached drawings, and will be hereinafter referred to as the fourth invention In the drawings of FIG. 1(A), FIG. 1(B) and FIG. 10, (a) is a water heater body, and is provided to effect combustion of fuel gas fed through gas pipe feed line 15 into the first burner 2, to flow feeding water through a feeding water pipeline 4 into a heat exchanger 1, and to heat up and discharge the water into a faucet or similar structure 27 through a hot water discharge pipeline 34.

A source electrical valve 16, first electrical valve 10, and gas regulator 22 are arranged along a feeding gas pipeline 15 along the upstream side of the pipeline.

Further, a hot water discharge pipeline 34 branches to a return pipeline 32 at a central portion thereof, and more specifically it is branched from a position adjacent a faucet or similar structure 27. This will be explained hereinafter.

A circulation pump 35 sucks an amount of hot water flowing within a hot water discharge pipeline 34 into return pipeline 32; and a small capacity circulation pump, i.e., having a flow rate of about 2 liters per minute, will be used so as not to prevent the main flow of hot water discharged into the faucet or similar structure 27.

Further, the first electrical valve 10, water volume sensor 5 along feeding water pipeline 4, feeding water temperature sensor 6, hot water discharge temperature sensor 7, and circulation pump 35 of return pipeline 32 are connected, respectively, electrically to an operation device 9. The water volume sensor 5 sends a signal (c) after detecting the rate of water flowing within water feeding pipeline 4, and feeding water temperature sensor 6 sends a signal (d) after detecting the water feeding temperature flowing into heat exchanger 1. Further, a discharge hot water temperature sensor 7 sends a signal (e) after detecting the hot water discharge temperature coming from heat exchanger 1, so that signals (c), (d), and (e) will be sent to operation device 9, respectively.

Operation device 9 is housed within a water heater body or control panel (b), and, in accordance with the turning on of power switch source switch 8, it will send a signal (L) into a circulation pump 3 for operating it, simultaneously accepting signals c, d and e. Operation device 9 will calculate, for comparison purposes, a balance value by comparing the water flow rate value, the water flow temperature value, the hot water discharge temperature value, and on the other hand, the set up temperature which has been set by temperature setting means 8. As a result, it calculates the necessary heat load value F, as shown in FIG. 10, and further calculates an average amount of the necessary heat load value F in an intermittent combustion cycle and a value T, which represents the total amount of the on-time $t_1$ and off-time $t_2$ of a burner. Operation device 9 will send a pulses signal (i) with a predetermined pulse-span corresponding to the average amount of the value $F_1$ of the necessary heat load value F into the first electrical valve 10, in the form of a ratio between the on-time $t_1$ and the off-time $t_2$ of the intermittent combustion cycle $T_1$ of the next turn. In this way, the system will send a pulse-signal (i), in response to an average amount $F_2$, which is the value of the necessary heat load value F, into the first electrical valve 10 as a ratio between the on-time $t_1$ and the off-time $t_2$ in the intermittent combustion cycle $T_1$ of the next turn. In this way, it will send a pulse signal (i) in response to the average amount $F_2$ of the necessary heat load F into the first electrical value 10 as a time ratio between the on-time $t_1$ and the off-time $t_2$ in the intermittent combustion cycle $T_2$ of the next turn. Further, it will send a pulse-signal (i) in response to the average amount $F_3$ of the necessary heat load F into the first electrical valve 10 as a ratio between the on-time $t_1$ and the off-time $t_2$ in the intermittent combustion cycle $T_3$ of the next turn. In this regard, the structure repeatedly sends a needed pulse-signal in response to an average amount of a necessary heat load into the first electrical valve as a function of the time ratio between the on-time $t_1$ and the off-time $t_2$ during intermittent combustion cycles $T_1$, $T_2$ and $T_3$.

When the first electrical valve 10 accepts a pulse-signal (i), it will be opened during the on-time $t_1$, and be closed during off-time $t_2$ in accordance with the length and span of the pulse-signal, and it will be operated with a predetermined timeratio.

That is, the first burner 2 will repeat combustion intermittently in accordance with the length and span of pulse signal (i); in other words, it will be operated with an on-time $t_1$ and an off-time $t_2$ time ratio which is determined by the average amount of the required heat load F in the immediately previous intermittent combustion cycle.

Thus, the gist of the above operation can be explained as follows: first, a faucet or similar structure 27 is shut, the hot water discharge temperature sensor 7 will detect the feeding water temperature which, e.g., may not reach the set up temperature, and then operation device 9 will begin to calculate the necessary heat load F; at the same time, circulation pump 35 will begin rotation, and the first electrical valve 10 will effect an on-off action. Accordingly, the first burner 2 will begin combustion.

As a result, an amount of water within the pipeline system will be circulated through feeding water pipeline 4, heat exchanger 1, hot water discharge pipeline 34, and will be returned back into feeding water pipeline 4, where water volume sensor 5 is located upstream along the pipeline. This circulation is effected by the operation of circulation pump 35, and the water is heated when it is transmitted through heat exchanger 1.

During this time, intermittent combustion of first burner 2 is controlled by operation device 9 with a ratio between on-time $t_1$ and off-time $t_2$ which is determined by the average amount of the necessary heat load F, so that circulating water will be heated up until it reaches the set up temperature, and so that this temperature will be maintained in a continuous fashion.

Next, the valve of a faucet or similar structure 27 will be opened, an amount of hot water then within the pipeline and already heated up will be supplied into faucet 27, and, thereby, an amount of feeding water will be newly fed from feeding water pipeline 4 and will be heated up to the set up temperature, and thereafter supplied into the faucet or similar structure 27 (hereinafter referred to as the faucet).

Also, when an amount of hot water is used by faucet 27, the water flow rate and feeding water temperature will be quite different than during water circulation periods. In other words, this is a time when hot water is not used; however, in conformance with this change, intermittent combustion of the first burner 2 will be successively controlled by operation device 9, so that an amount of hot water with a predetermined set up temperature will be accurately discharged. In such a case, circulation pump 35 continues to operate; however, it does not prevent a sufficient amount of hot water from being supplied into faucet 27, due to the pump having a small capacity and being limited in the amount of hot water it can suck from hot water discharge pipeline 34 into return pipeline 32.

Further, when a valve of faucet 27 is closed, fresh water supply into the hot water heater body (a) is stopped; however, the amount of hot water positioned within hot water discharge pipeline 34 will be forceably circulated, and the temperature will be maintained at the set up temperature and will await the next discharge of hot water by faucet 27.

7. Explanation of Fifth Invention

As noted previously, the present inventors have provided technology for controlling combustion, if an intermittent combustion method for a single burner is desired.

As described in the above practical example, the present invention is directed to keeping hot water warm by forceably circulating water via a circulation pump with a circulation bypass pipeline.

However, because the first burner 2 is being utilized as a heat source during the water warming operation, and because the burner is being operated with a time-ratio below a standard value calculated by the average amount of the necessary heat load just prior to extinguishing the first burner 2, one disadvantage will be minimized. This disadvantage arises when the combustion capacity of the burner is too large in comparison to the actually needed combustion capacity for warming up only a small amount of hot water positioned within the bypass pipeline, so that the temperature of the circulating hot water would rise immediately and undesirably cause accidents by scalding users of the hot water in the faucet when such water is discharged. Such an immediate increase in temperature is not only observed b reignition of the first burner, but also when an overshoot phenomenon occurs due to the heating momentum of heat exchanger 1 located just behind the extinguished burner, when the normal hot water discharge is temporarily stopped.

Accordingly, relating to this problem of keeping circulating hot water warm, it will be possible not to use the first burner as the heat source during such a water warming operation, as in the fourth invention. Instead, an electrical heater will be provided along the circulating bypass pipeline for keeping the water warm, rather than using the first burner. This electrical heater will be controlled suitably by a control system. This is referred to hereinafter as the fifth invention.

8. Working Example of the Fifth Invention

In this fifth invention, the hardware used will include a feeding water pipeline system and a hot water discharge pipeline system, a proportional gas valve for operating each of these systems, and electrical valve, with controlling devices which are quite similar to those in the first and fourth inventions noted above.

The practical aspects of the fifth invention relate to offering a technology which involves arranging an electrical heater 36 along a return pipeline 32, as shown in FIG. 1, as the heat source for keeping recirculating hot water warm.

Electrical heater 36 is connected to an inlet port provided along return pipeline 32.

This electrical heater 36 can generate a larger heating capacity than is necessary to overcome the amount of heat loss radiating outwardly from the pipeline system in a normal setting state.

For example, the relationship between the heat loss and heating capacity will be explained. When water at a flow rate of 2 liters per minute flows within an insulated pipeline having a length of 15 meters, and when the environment comprises open air having a temperature of approximately 20° C., e.g., the amount of heat loss released from the pipeline is estimated to be approximately 400 Kcal per hour; as a result, electrical heater 36 is treated as having a capacity of more than 400 Kcal per hour.

Further, circulation pump 35 and the electrical heater are connected with a microprocessor 17 and controlled thereby.

The microprocessor is adapted to be operated by an on-off power switch source switch 18 initially, and is adapted to calculate the difference between a set up temperature and a recirculating hot water temperature which is detected by a hot water discharge temperature sensor. It is also capable of calculating the heat capacity necessary to heat up the circulating hot water to the predetermined set up temperature. Further, it calculates any other heat capacity necessary to warm the water to the set up temperature and to vary the voltage of the electrical heater 36 after the water is heated up.

In other words, when a large amount of the necessary heat capacity is generated, electrical heater 36 is driven with a large amount of voltage in response thereto, and in contrast, when a smaller amount of the necessary heat capacity is indicated, it is driven by a smaller voltage.

Therefore, in accordance with variation of the voltage of electrical heater 36, the heating capacity will be variable, and will heat an amount of recirculating hot water continuously with a suitable heat capacity and with a voltage provided by the power output section of microprocessor 17; this arrangement also conducts the water warming maintenance operation.

Further, a circulation pump 35 can be provided which is adapted to stop when hot water is discharged from faucet 27. However, it is not always necessary to stop the faucet because the pump has a relatively small flow rate, i.e., around two liters per minute, so that the normal discharge flow rate of the hot water which is sucked from hot water discharge pipeline 34 into return pipeline 32, and discharged by faucet 27, will not be prevented.

In this example, microprocessor 17 is adapted to vary the voltage of electrical heater 36 in response to a required heat capacity calculated when the hot water was circulating during the heating process and during the process of maintaining the water warm. However, the microprocessor is also adapted to make the electrical heater 36 turn off intermittently so as to vary the ratio between the on-time and off-time in response to a required heat load.

In other words, when the required heat load is larger, the on-time is made longer, and when the required heat load is smaller, the on-time is shortened.

9. Explanation of an Improved Type A Device

The technology for keeping recirculating hot water warm with an electrical heater rather than by using the gas heat source of the first burner during a period when hot water is not being discharged in the fifth invention is beneficial for preventing accidents involving users which result from scalding and the like during hot water discharge.

However, as in other areas above, one cannot leave such a problem without proposing a solution relating to energy conservation for the heat source used to keep the water warm with an electrical heater. In accordance with the fifth invention, about 400 Kcal per hour of heat capacity is needed for covering the heat loss released from the entire pipeline system of the water heater body. Despite such a calculated feature, in actual practice the real amount must be twice that, i.e., about 800 Kcal per hour from a preheater will be required. In other words, the amount is about one Kw per hour of output from the electrical heater (which generates 860 Kcal per hour).

In tracing back this energy source of 860 Kcal per hour to its origin, i.e., to a stage of a power station, the total of the heat efficiency of the power station is about 39% in the most up-to-date type of power station using an LNG fuel source in Japan (whereas a steam boiler has an efficiency of about 86%, a steam turbine about 46%, and a power generator about 99%). Further, the final efficiency of a power distributing facility into a home or retail outlet is about 80%, so the "dead" figure, calculated by subtracting the efficiency from that of a home or retail outlet, is only about 31%.

Therefore, in order to obtain 860 Kcal per hour, it will be necessary to provide 2,800 Kcal of LNG fuel consumption at the stage of the power station referred to above. Even considering only this one point, it should be understood how much of an energy-wasting source an electrical heater is. Because of the social responsibility of heating equipment manufacturers such as the present Applicants, and also in view of the operational cost consciousness required which users of water heaters exhibit, the present application directs some attention to reviewing the method of keeping water warm when using an electrical heater.

As means of resolving the problem, there are no way, other than returning to the use of a fuel gas heating source and disposing of the electrical heater. If this occurred, the 2,800 Kcal would result in about 1,075 Kcal when using an 80% heat efficiency heat exchanger, i.e., it would be equivalent to about 38% when compared to the electrical heater.

However, as described above with respect to the fifth invention, the technical problems which must be solved in using a gas burner as the heat source for maintaining the water warm are several. These problems are detailed hereinbelow.

In the instantaneous gas water heater of the fourth invention, once the hot water is no longer used, and it is only a short time in which new hot water must be reused, the heat exchanger will display an over-shoot with a resultant immediate rise in the temperature of the hot water. In this way, the hot water which is discharged will be too hot at the beginning of the next use of hot water from the heater.

Accordingly, in the fourth invention, a recirculating pipeline was provided which contained water and which maintained the water warm with a burner except during the hot water discharge period.

However, in the conventional method of controlling hot water by varying the gas flow rate, the lowest limit of combustion capacity which is controllable is within a range of about one quarter or one fifth of the highest limit of the combustion capacity, which limitations are imposed by the structure of the burner. Accordingly, the question remained in such a structure whether this problem would be overcome even if a circulating flow line was provided in order to heat up circulating water.

That is, as a practical example, with a circulation pump flow rate of two liters per minute, a water warming maintenance setup temperature of 60° C., and a circulating hot water temperature of 55° C., the combustion capacity of the burner would be the No. 4 combustion capacity, capable of generating 100 Kcal per minute.

Under such conditions, the burner is operated in a proportional operation in the lowest limit of combustion, and the following equation will result:

100 Kcal per minute/2 liters per minute = 50 (°C.).

That is, 50° C. of excess temperature will be added to the 55° C. temperature of the circulating hot water, so that the total temperature will be more than 100° C., and, as a result, a bumping phenomenon will occur.

Further, due to the lowest level to which the combustion capacity is limited, the burner will be unable to be ignited unless a temperature difference ($\Delta t$) between the water warming maintenance setup temperature and the circulating hot water temperature will become larger; further, after one ignition the rise in temperature will exhibit a large increase in the hot water discharge temperature.

On the other hand, during circulation of the water which is being kept warm, such water has a problem in that a large amount of the water flow will release a large amount of radiational heat loss from the entire surface of the piping surface, and, to the contrary, a smaller amount of water flow will make it difficult to control the operation during which the water is kept warm.

Accordingly, regardless of the composition of the pipeline, it is preferable to minimize heat loss and to also have a suitable flow rate which is easily controllable, i.e., on the order of two liters per minute is preferable, e.g.

Therefore, it has been considered to provide a water flow valve in a suitable position along the circulating pipeline, and to control circulating water at a predetermined flow rate by throttling the valve. In this regard it would be possible to adopt prior technology relating to arranging an automatic water flow valve along a circulating pipeline in order to throttle th flow rate, which throttling would be controllable within a range of the ability of the water heater even if excess water flow occurred. However, such prior technology is questionable in that the flow rate of hot water is undesirably controlled even when it is within the capability of the water heater, when switched from an operation in which the water is kept warm into an operation in which water is normally discharged when the valve is being throttled.

10. Means of Resolving Problem

The present invention provides a method of overcoming this problem by joining a mid-portion of a hot water discharge pipeline and a feeding water pipeline by a return pipeline having a circulation pump along the line. Such structure results in an amount of water being forceably circulated within a loop line which consists of a feeding water pipeline, a heat exchanger, a hot water discharge pipeline, and a return pipeline during a period in which hot water discharge does not occur. Further, the burner is operated with intermittent combustion, it calculates the necessary heat capacity for maintaining the circulating water warm and at a predetermined setup temperature in accordance with the circulating water flow rate, the circulating water temperature, and the predetermined setup temperature. These features are respectively detected by a water volume sensor and a feeding water temperature sensor; and the ratio of the on and off time of the burner is controlled, and the circulation pump is also controlled electrically in accordance with the water flow rate detected by the water volume sensor and in accordance with a predetermined target flow rate.

As noted above, in order to maintain water warm with a gas burner system in said fashion, it is necessary that the system calculates the necessary heat load needed for a water warming maintenance operation, and that it makes the first burner undergo intermittent combustion. Further, it operates the circulation pump in order to obtain the most suitable flow rate.

According to FIGS. 1A and 1B and the practical example, a manner in which the most suitable flow rate is obtained is detailed hereinafter.

Thus, an improvement relating to the water heater is referred to as the A-type improvement hereinafter.

11. Working Example of the A-type Invention

In this A-type improved invention, the components include a feeding water pipeline and a hot water discharge pipeline, a fuel gas feeding pipeline, a heat exchanger and a burner system, a proportional control valve for controlling all of the heating apparata detailed above, an electrical valve ,with controlling apparatus similar to those in the first, second, and fourth inventions detailed above, and, further, a return pipeline 32 provided along with hot water discharge pipeline 4. A circulation pump 35 is positioned along pipeline 32.

Therefore, in the software section of the A-type invention, as illustrated in FIGS. 1A and 1B, microprocessor 17 is adapted to electrically control circulation pump 35 with a phase control in accordance with a predetermined target flow rate and also an actual flow rate which is detected by a water volume sensor 5; which generates a signal.

Figure 11:
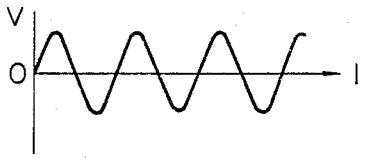
FIG. 11 is a graph which illustrates the normal wave of AC source frequency in a sixth, i.e., No. 6, embodiment of the present invention.
Figure 12:
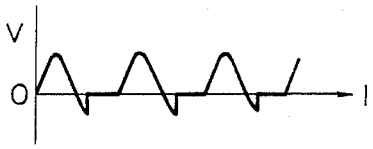
FIG. 12 is a graph illustrating a half-rectified wave rectified by a silicon controlled rectifier, i.e., a SCR, e.g.,in the sixth embodiment of the present invention.

The term phase control relates to the oscillating waves of a commercial alternating current frequency, as illustrated in FIG. 11, which are partially cut-off, as shown in FIG. 12, by an SCR, i.e., a silicon controlled rectifier or similar structure, e.g., so that revolution of the circulation pump motor is controlled by varying the cut-off ratio.

Therefore, in this A-type invention, in order to control the speed of revolution of the motor, a cut-off ratio is established in a preliminary fashion, e.g., it resembles the varied waves of FIG. 12 and is adapted to determine the flow rate of water circulating at, e.g., two liters per minute. When the actual flow rate detected by water volume sensor 5 is larger and exceeds the target flow rate. The cut-off ratio will immediately be enlarged so as to reduce the speed of the motor. In contrast, when a smaller flow rate is detected, it is decreased so as to increase the speed of the motor. In this way, the output flow of pump 35 is constantly controlled at a predetermined target flow rate.

This target flow rate is arranged at the most suitable flow rate as to prevent a large quantity of the heat loss caused by having a flow rate which is too large within the pipeline loop system. To the contrary, too small a flow rate may produce bad results in controlling the device.

Accordingly, the target flow rate referred to above is preferably established at about two liters per minute.

Further, such a flow rate will not disturb the supply of hot water into the faucet 27 which is sucked from hot water discharge pipeline 34 and into return pipeline 32, even if the circulation pump is operating.

Therefore, circulation pump 35 is capable of operating continuously, regardless of whether or not hot water is discharged from faucet 27 when the water heater body (a) is being operated.

It goes without saying that circulation pump 35 is also allowed to be operated, in a limited fashion, when no hot water is being discharged from faucet 27.

In accordance with the gist of this operation, when the faucet valve is closed, power source switch 18 of control panel (b) is first switched on, water heater body (a) becomes operational, source electrical valve 16 is opened, and a circulation pump is driven.

Further, when a hot water discharge temperature sensor 7 senses that the water temperature of the section has not yet reached the setup temperature, the first electrical valve 10 will be operated with an on-off action in order to effect intermittent combustion of the first burner 2.

Thereafter, water contained within the entire pipeline system is forceably flowed by circulation pump 35 from feeding water pipeline 4 to heat exchanger 1, hot water discharge pipeline 34, and is caused to flow back into feeding water pipeline 4, where it is in the upstream position adjacent to a water volume sensor 5. Thereafter, it is warmed during passage of the water through heat exchanger 1.

In this fashion, the flow rate of circulating water is controlled within a range of a target flow rate by phase control operation within circulation pump 35, as well as in accordance with the actual flow rate calculated by microprocessor 17 in response to the water volume detected by sensor 5, e.g., when the controllable target flow rate is two liters per minute.

Further, when faucet valve 27 is closed, and when the feeding water flow is stopped within water heater body (a), and the hot water contained within the pipeline system is forced to flow in a circulating fashion, and maintained at the setup temperature, the system awaits the next discharge by faucet 27.

Figure 13:
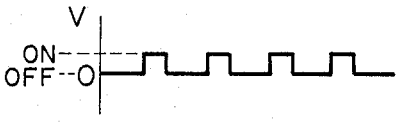
FIG. 13 is a graph illustrating a general pulse wave of duty control in accordance with another embodiment of the invention, i.e., an A-type improvement.
Figure 14:
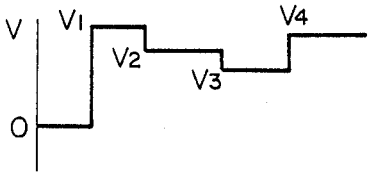
FIG. 14 is a graph illustrating a voltage controlled wave in the invention of FIG. 13.

In this example, the system was adopted to operate in phase control in accordance with the flow rate of circulating water; however, as illustrated in FIG. 13, it can also be adapted to control the revolution of the motor of the circulation pump 35 with an on-off pulse, i.e., a duty-control. Otherwise, it is also adapted to control the voltage by a Slidac or similar structure, e.g., and in this fashion is capable of controlling the rotational speed of the motor.

12. Explanation of Sixth Invention

In the A-type invention described above, the apparatus was capable of using a gas burner rather than an electrical heater to keep water warm as in the fifth invention, and is adapted to provide a standard value based on the required heat load for keeping the water warm in only a controlled section. In this invention, the first burner and a circulation pump are placed under the control of such system, and control of burner combustion and speed control of the circulation pump is also effected. These improvements achieve an energy-saving object in a water warming maintenance operation and achieve speed control of the circulation pump.

However, the circulation pump is adapted to rotate in a non-stop fashion during discharge of hot water, and the hot water flows back at two liters per minute into the pump through a bypass pipeline.

However, the circulation pump is adapted to be operated even during a period of hot water discharge although it is appropriately operated during a water warming maintenance period. It takes two liters per minute of hot water out of the water discharged from the heat exchanger, and flows this water back into the circulation pump via a return pipeline. This back flow of recirculated hot water during the hot water discharge period may be completely meaningless, but it also reduces two liters per minute of hot water from the total of hot water to be discharged.

This non-stop operation of the circulation pump may not only harm the mechanical life of the circulation pump itself, but may also waste power during operation. As a result, it can be economically disadvantageous to a water heater user.

Accordingly, as one means of resolving this disadvantage, improved technology has been provided herein in the form of the software used in the A-type invention.

13. Means of Resolving the Problem

This apparatus is adapted to cause rotation of the circulation pump to stop during discharge of hot water from faucet 27, and can be achieved in different ways. In one simple example, it is possible to control the circulation pump in accordance with the variation in water pressure or the variation in the water flow rate. For example, there may be a way to sense the water pressure variation mechanically by a diaphragm valve, or the like, during the hot water discharge. Otherwise, one way to sense the sudden variation in water flow rate during hot water discharge would be by a water volume sensor 5 or other electronic device.

However, with the exception of these above common sense methods, it has been considered that one way to sense sudden variation in the heating capacity during discharge of water would be to provide a microprocessor within the water heater control section, and have a standard value provided which will stop the circulation pump during the discharge of hot water. This value is to be written into a memory section such as the ROM, i.e. Read-Only Memory, of the microprocessor, as a newly provided standard value within an older group of required heat loads. This would be the easiest and most economical method of sensing sudden variations in heating capacity.

Accordingly, this method of stopping the pump during hot water discharge, in response to variation of a necessary heat load, will be referred to as the sixth invention hereinafter, one operating example of which is detailed below.

14. Working Example of the Sixth Invention

First, a predetermined required heat load is needed for the water warming operation, under mechanical and environmental conditions which permit the circulation pump to pump at two liters per minute. When the feeding water temperature in the winter season is 5° C., in combination with the other conditions, the heat load required must be able to warm up an amount of water to 60° C. from 5° C. in accordance with the following equation:

$$(60^\circ\ C. - 5^\circ\ C.) \times 2 \text{ liters per minute} = 110 \text{ Kcal per minute.}$$

In considering the next conditions, an amount of water warmed up to 60° C. one time is being maintained warm; and, when its temperature drops to 55° C., e.g., the necessary heat load required to restore the temperature from 55° C. to 60° C. again is in accordance with the following equation:

$$(60^\circ\ C. - 55^\circ\ C.) \times 2 \text{ liters per minute} = 10 \text{ Kcal per minute.}$$

As shown above, it has been estimated that the highest heating capacity limit which would be necessary for warming this amount of water from 5° C. in the winter season will be approximately 110 Kcal per minute.

However, when encountering the worst case, i.e., a situation in which the entire pipeline system is affected by other unexpected conditions, or when the feeding water temperature is affected by an extremely low temperature environment, a larger required heat load will be demanded. Nonetheless, if the system is capable of providing 150 Kcal per minute, it should be sufficient.

On the other hand, when the quantity of circulating water, despite the above-noted flow rate of two liters per minute, is too small during hot water discharge from faucet 27, the actual amount used will need to be larger. In this fashion, i.e., when the flow rate is three liters per minute, e.g., and where a predetermined amount of water must be warmed to 60° C. from 5° C., it will be warmed in accordance with the following equation:

$$(60^\circ\ C. - 5^\circ\ C.) \times 3 \text{ liters per minute} = 165 \text{ Kcal per minute.}$$

Thus, as one logical estimate, it is possible that hot water discharge is performed for a faucet 27 when the necessary heat load calculated exceeds a predetermined heat capacity, i.e., more than 150 Kcal per minute, which is larger than the largest expected heat capacity needed to maintain the water in a warm condition.

Accordingly, in the present invention, it is possible to stop the circulation pump when the required heat load calculated exceeds a predetermined heat capacity which is larger than the highest heat capacity expected to be needed for a warm water maintenance operation.

In describing one practical example, e.g., the one in FIGS. 1A and 1B, microprocessor 17 is adapted to calculate a required heat load in response to the water flow rate detected by water volume sensor 5, the feeding water temperature detected by feeding water temperature sensor 6, the setup temperature established by setting temperature section 8, a hot water discharge temperature detected by hot water discharge temperature sensor 7, the heat efficiency of the heat exchanger, the proportional gain and the like; and, further, the first electrical valve can be turned on and off on at an interval and at a time ratio in response to the necessary heat load calculated. Further, the circulation pump 35 is stopped temporarily once.

Therefore, a valve of faucet 27 is opened, an amount of hot water which has been heated to the setup temperature within a pipeline system is supplied to the faucet 27, and new water is then fed from a feeding water pipeline 4 and is warmed up to the setup temperature, and thereafter discharged. During this time, the hot water discharge flow rate increases to a value greater than the natural circulating water flow rate, i.e., to a value greater than two liters per minute. This flow rate of water flowing within feeding water pipeline 4, heat exchanger 1, and hot water discharge pipeline 34 will increase, in response to the above, so that the amount of heat load necessary will be calculated automatically by microprocessor 17. In response to the calculated necessary heat load, the first burner 2 will be controlled in the most suitable fashion by intermittent combustion. As a result, continuous discharge of hot water at the setup temperature will surely result.

Further, the calculated required heat load will exceed by a large amount the highest heat capacity needed to keep the water warm. Also, it will exceed the predetermined value, e.g., it will be 150 Kcal per minute, so that microprocessor 17 will stop the operation of circulation pump 35.

Further, when the valve of a faucet 27 is closed, water supply to water heater body (a) will also be stopped. Thus, the required heat load calculated by microprocessor 17 will decrease automatically in response to such cessation, and it will be reduced to a value lower than the aforesaid predetermined value, i.e., lower than 150 Kcal per minute.

Therefore, circulation pump 35 will again start its operation, and hot water contained within the pipeline system will flow in a circulating fashion, and will again await the next use of hot water by faucet 27.

Further, as explained above, the water heater has a method in which it controls the hot water temperature in response to the ratio between the on and off time of the burner undergoing intermittent combustion. However, this water heater can use a control method to control the hot water temperature with a proportionally gas controlled type burner, and it is also possible to combine methods in one system.

15. Explanation of the Seventh Invention

This invention relates to technical problems in controlling water within the heater during the warm water maintenance operation.

In several of the partially improved inventions, i.e., in the fifth, A-type, and seventh inventions, relating to using the heater to keep water warm, the technology has involved the use of circulating water which circulates through a return pipeline 32 via circulation pump 35, and which involves the use of the first burner 2 and second burner 3 as heating sources, as well as electrical heater 36 and heat exchanger 1, respectively.

Briefly, these methods of controlling the warm water maintenance operation involve controlling the heat source or the rotation of a circulation pump such that the relationship between temperature sensors, i.e., between feeding water temperature sensor 6 and hot water discharge temperature sensor 7, as well as temperature setting means 8, result in a water temperature detection system.

In view of such a technical method of controlling the water temperature, other control technology is also being contemplated in which the water flow rate will be detected. In other words, a water flow rate detecting system will involve the water flow detection sensor 37 which is adapted to detect variations in the value of the water flow rate which is forceably flowed within feeding water pipeline 4 during hot water discharge periods and also during periods when hot water is not being discharged. Through this selection of an indication of the necessary heat source and a combustion pattern, preferred heating will be performed on the circulating water.

Against this technical background, comparing environmental factors of water flow rate detection and water temperature detection involve less highly intensified disturbances; as a result, the control system used to control the system on a water temperature detecting basis will be unavoidably more intricate than a system using water flow rate detection.

In other words, the environmental factors relating to water temperature detection are largely affected by the geographical conditions and/or seasonal conditions, and thus it can be easily imagined that the amplifying span for controlling an object will be widened to as large a degree as possible in order to respond to a widely spanned variation and/or a suddenly changed disturbance in the water.

From this viewpoint, one feature of the control system of the present invention is that the water flow rate detection is basically simple and clear, and is not greatly affected by any disturbance. Along this line, one basic point of control technology may be used, in order to arrange the detecting elements into a stable position without disturbance. Accordingly, this system will be referred to as the seventh invention and will be detailed hereinbelow.

16. Working Example of the Seventh Invention

In the seventh invention, the hardware comprises both a feeding water pipeline and a hot water discharge pipeline, a fuel gas feeding pipeline, a heat exchanger, and a burner system, as well as a proportional gas valve for controlling these systems, an electrical valve and its related control system, all of which are quite similar to the first, second, fifth, sixth, and A-type improved inventions detailed above.

Accordingly, the practical feature of the seventh invention resides in its improved software, as detailed below.

In FIGS. 1A and 1B, microprocessor 17 is electrically connected to electrical valves 10 and 11, proportional valves 12 and 13, hot water discharge temperature sensor 7, circulation pump 35, water volume sensor 5, feeding water temperature sensor 6, respectively, and this microprocessor is adapted to send a signal (L) to circulation pump 35 to drive it. On the other hand, microprocessor 17 is adapted to accept sensing signals (e), (c), and (d) from sensors 7, 5, and 6, respectively, and to thereby calculate the required heat load for keeping circulating water warm during both hot water discharge and non-discharge periods. Further, in accordance with the variation in volume of the required heat load the system will select the smaller capacity type second burner 3 or the larger capacity type first burner 2. Further, microprocessor 17 will send, when using the smaller capacity type second burner 3 which has been selected, a pulse signal (g) to second electrical valve 11 in response to the combustion capacity required when the required heat load is lower than a predetermined combustion capacity. In such case, two different pulse interval levels are arranged, one for discharge of hot water periods and one for periods when hot water is not discharged, respectively, in which the interval for the former is short and the interval for the latter is long.

Further, after second electrical valve 11 receives signal (g) from microprocessor 17, this second valve is operated in an on-off fashion, respectively, in conformance to the length of the pulse interval, and fuel gas is thus fed into the second burner 3 in an intermittent fashion. Thus, the smaller capacity type second burner 3 is controlled with different cycles, e.g., a five second time length is used for hot water discharge and a 30 second time length is used for a period in which hot water is not discharged, so that the second burner 3 is operated with an on-off action repeatedly in order to warm up the circulating water passing through heat exchanger 1.

Further, when the second burner 3 has been selected, the on signal (g) for opening the valve is sent from microprocessor 17 to the second electrical valve 11 when the necessary heat load is greater than a predetermined combustion capacity; simultaneously, signal (h) is sent into the second proportional valve 13 in response to the different values of the required heat load for both cases, i.e., both when in which hot water is discharged and when hot water is not discharged. According t signal (h), the second proportional valve 13 will feed fuel gas into the second burner 3 in a continuous fashion in response to the required heat load corresponding to each of these situations. Further, the second burner 3 is operated continuously with a predetermined combustion capacity for discharging hot water, and heat exchanger 1 is heated by burner 3.

On the other hand, when the larger capacity type first burner 2 is selected, an on signal (i) (to open) is sent to the first electrical valve 10 in order to heat up the heat exchanger 1 by using the first burner 2.

Further, a water flow rate sensor 37 which detects the flow rate of discharged hot water as well as a non-discharging hot water condition will be positioned upstream from the point where return pipeline 32 branches from feeding water pipeline 4. The water flow rate sensor 37 will initiate detection in response to water flow movement into heat exchanger 1 from feeding water pipeline 4 and the water source, during hot water discharge, in order to send a signal (M) into microprocessor 17. That is, the microprocessor is essentially programmed to determine each state of discharge of the hot water and from stopping discharge i accordance with a yes or no signal (M) sent from the water flow rate sensor 37.

In this type of a water heater, microprocessor 17 will calculate the heat load necessary in response to signals (e), (c), and (d), which are detected by hot water discharge temperature sensor 7, water volume sensor 5, and feeding water temperature sensor 6, respectively, and the smaller capacity second burner 3 will be selected when the necessary heat load is lower than the predetermined combustion capacity. Further, the larger capacity type first burner 2 will be selected when th necessary heat load is greater than a predetermined combustion capacity.

In accordance with these operations, when hot water is being discharged from faucet 27, water flow movement towards heat exchanger 1 is detected by water flow sensor 37, and microprocessor 17 accepts a signal (M) sent from the water flow sensor 37, distinguishes between the hot water discharge states, and regulates the amount of fuel gas supplied into the first and second burners 2 and 3 which are selected, respectively.

That is, when the smaller capacity type second burner 3 has been selected, the second burner will be operated with a cycle in response to the state of hot water discharge when the necessary heat load is lower than a predetermined combustion capacity. Water heated within heat exchanger 1 will be heated to a predetermined temperature and will be supplied to faucet 27. When the hot water discharge has stopped, i.e., when there is no discharge of hot water from the faucet and the faucet valve is closed, the water flow within feeding water pipeline 4 where the water flow rate sensor 37 is arranged will be stopped. As a result, an amount of water contained within a circulating pipeline will be forceably flowed by circulation pump 35. In these water flow states, due to the failure to receive a response from water flow rate sensor 37, i.e., when there is no signal (M) from sensor 37 being input to microprocessor 17, the microprocessor will distinguish the lack of hot water discharge, the second burner 3 will be operated in a cycle in response to this non-discharge state, and the second burner will be operated in an on-off combustion fashion in order to warm up water circulating within a circulating loop pipeline extending through heat exchanger 1. As a result, water temperature will be maintained within a predetermined temperature range until the hot water is reused by faucet 27.

Further, when the second burner of smaller capacity is selected, this burner 3 will be operated continuously when the required heat load is greater than a predetermined combustion capacity, in response to the required heat load, in order to warm the heat exchanger so as to maintain the hot water at a predetermined temperature.

On the other hand, when the larger capacity first burner 2 is selected, this burner will be operated continuously in response to the required heat load calculated in accordance with the signals detected by sensors 7, 5, and 6, and as a result, hot water being heated within heat exchanger 1 will be supplied into faucet 27.

Another working example will now be described.

In this practical example, a water flow rate sensor **37*a* is arranged along return pipeline 32, and this sensor is adapted to act in response to sensing of water flow movement within return pipeline 32** during period in which hot water is not discharged.

Thus, in this practical example, the water flow circulating through return pipeline 32 will be sensed by water flow rate sensor 37*a* within return pipeline 32, and microprocessor 17 will accept a signal (Ma) from water flow rate sensor 37*a*, and will distinguish a state of non-discharge of hot water, as well as the above flow rate, and it is thereby able to control the fuel gas volume fed into the second burner 3 and the first burner 2.

17. B-Type Invention

In the above description of the seventh invention, a technology is described which is capable of effecting intermittent combustion in a stable fashion by a small capacity second burner 3 in accordance with the water flow detected during a period in which hot water contained in the water heater is not discharged. According to the previous technology, when the system is switched from a period in which hot water is not discharged to a period in which discharge again starts, an amount of warmed hot water which has been faithfully maintained at predetermined setup temperature will be discharged from the faucet, and accordingly the danger of jeopardizing the user to scalding water was avoided.

However, when the water which has been maintained in a warm state is flowing at a predetermined water flow rate during a period in which hot water is not discharged, the reservoir capacity in which the water is stored, i.e., the reservoir capacity within the circulating pipeline channel coupled across the heat exchanger, will result in discharge of water within a few seconds after reopening of the faucet valve, which will cause a supply of fresh water being fed to be immediately heated up.

In contrast, in conventional water boilers, no matter how small, they all have reservoir capacities for hot water which are capable of housing approximately at least a three minute continuous discharge of hot water. In such cases, in instantaneous gas water heaters, the reduced reservoir capacity will be one feature which comprises a technical difficulty for controlling heating of the water in the heater.

Accordingly, during reopening of the hot water discharge, in a system with a relay supply of fresh water after discharge of a stored water supply, it was unclear what type of temperature characteristics of the water were evident in the fifth, sixth, seventh, and A-type inventions described above. All of these were regrettably unsatisfactory. In other words, there was a large temperature variation in the hot water which was discharged, i.e., initially an amount of hot water having a predetermined temperature wa discharged within the first few seconds, and thereafter very hot water was discharged for a few seconds. Thereafter, the temperature of the water dropped suddenly and was discharged for a predetermined period.

Figure 15:
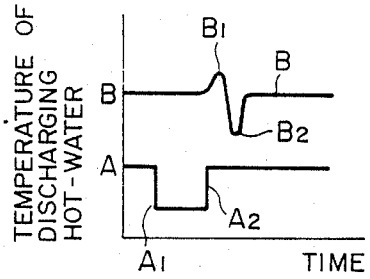
FIG. 15 is a graph illustrating the conventional temperature characteristics of the hot water being discharged in another embodiment of the present invention, i.e., the B-type improved invention.

The lower temperature is reduced in a hesitating fashion and is restored to a setup temperature in due course. Typical temperature responses, with their secondary degree curves, are illustrated in FIG. 15.

In these drawings, the abscissa axis represents time, and (A) is the hot water discharge volume, with (B) being the hot water discharge temperature. During discharge of hot water, the volume A temporarily stops discharging hot water at volume $A_1$, and redischarges the hot water at volume $A_2$, with hot water discharge temperature B increasing sharply immediately first (at $B_1$), then drops sharply immediately (at $B_2$), and is thereafter restored again to B in due course. The cause of the hunting phenomenon of hot water temperature discharged in the above inventions, within the channel of the control systems, during the time while the first and second burners are being switched (in their operation), requires sampling during this switching period. This problem caused, even when urgent heating of fresh water is required during a new discharge, a waiting time period for the purpose of igniting the burner with the most suitable gas volume so as to obtain stabilized combustion during the period when burner operation is switched, i.e., during the slow ignition time as illustrated in the drawing. Therefore, it has been found that the phenomenon of the sharp drop in temperature of the water occurred as a result of the above.

Figure 16:
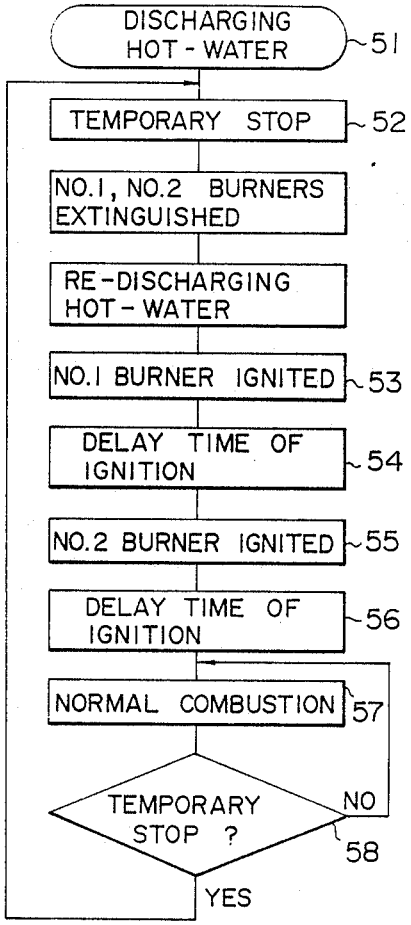
FIG. 16 is a flow chart illustrating a conventional program using a time delay between the switching of the burners in the B-type invention.

FIG. 16 illustrates these reasons. During discharge of hot water 51 during reopening of the faucet valve 27, and when hot water discharge is temporarily stopped, the first and second burners 2 and 3 will enter in a burner off situation, i.e., a fire extinguishing phase.

After this phase, water is discharged again, and the larger capacity type first burner 2 is again ignited (53) through ignition time 54. During such time, the control section will calculate the necessary information, or will send an operation signal to reignite (55) the second burner 3. Further, this slow ignition time is squeezed into the period between th switching of the burners, and then barely enters into a state of normalized combustion. In other words, according to the five distinct types of operational circuit signals which can be sent from the control system of the prototype water heater of the present invention, the first and second burners 2 and 3 will be operated in each combination of combustion, and will then reach the set up temperature.

Accordingly, in FIG. 16, it can be understood that the problem illustrated during the second hot water discharge will be caused by the delay time, i.e., the slow ignition time 54 behind the re-ignition 53 of the first burner 2. In situations in which it is required to urgently heat up the fresh water being fed, even in which reinforcement of the second burner 3 is urged to perform with the first burner 2 in a single performance; then the first burner 2 is ignited, and thereafter a slow ignition time between the times when the first burner 2 is ignited and when the second burner 3 is also ignited. Further, for one additional time the slow ignition time exists between these periods, and at last normalized proportional controlled combustion will occur in both of the first and second burners 2 and 3.

Figure 17:
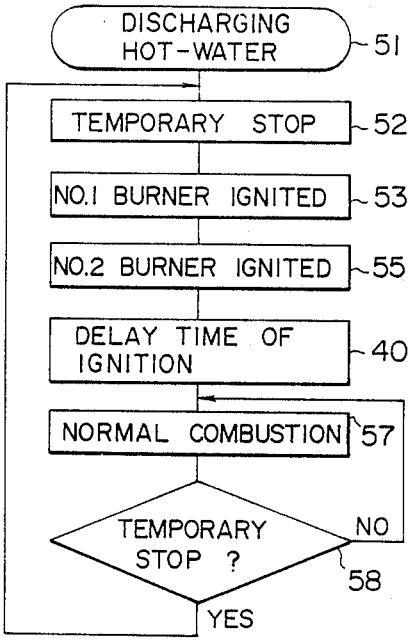
FIG. 17 is a flow chart illustrating an improved program for the B-type invention.

As one technical resolution of the problem, as illustrated in FIG. 17, the present invention improves the software in order to make the time in which slow ignition occurs be simultaneous for the first burner 2 (52) and for the second burner 3 (53).

This improved type of operation is hereinafter titled as a B-type improved invention.

18. Working Example of the B-type Improved Invention

The hardware of the B-type improved invention is similar to those of the first or basic invention, the fifth invention, the A-type improved invention, the sixth invention, and the seventh invention described above, i.e., they include at least a feeding water pipeline apparatus, a hot water pipeline channel, a fuel gas feeding pipeline channel, a burner system, a heat exchanger channel, and similar structure.

Therefore, the main object of the B-type improved invention is to improve upon software as explained hereinafter.

To explain the action of the practical example with respect to FIG. 17, a faucet valve 27 is first opened so as to discharge hot water at 51, and then the faucet valve 27 is closed in order to stop discharge of hot water temporarily during period 52.

By temporarily stopping the discharge (52) is meant that the faucet valve 27 is closed so as to stop hot water discharge, first and second burners 2 and 3 are stopped, respectively, thereafter, and the faucet valve 27 is again opened in due course.

Detecting th hot water discharge movement with the water volume sensor 5 results in the first electrical valve 10 being opened in order to ignite the first burner 2 (at 53), and the second electrical valve 11 is opened in order to ignite the second burner 3 during time period 55.

Next, during the slow ignition time of the first and second burners 2 and 3, which operate at the same time in order to operate the first and second proportional valves 12 and 13 to effect proportional action response to the total heat load F (at 40) to effect a normal combustion (at 57).

The total heat load is formulated in accordance with the equation $F=F_1+F_2$, where $F_1$ is the required heat load, $F_2$ is a rectified heat load, with the coefficient being $\alpha$, e.g., wherein the equation is $F_2=\alpha(Ts-Th)\times(Qh)$.

Thus, normal combustion will continue until the next temporary stop is sensed, and then the on-off combustion cycle will be operated repeatedly in due course.

19. Explanation of the C-type Improved Invention

In the water heater of the B-type invention, there was a problem insofar a the discharged hot water temperature fluctuated upwardly and downwardly at the beginning of the discharge and during a redischarge period after it had temporarily been stopped. This was partially solved by changing the method of control.

However, as one other method of resolving the problem of the immediate reduction in the temperature of discharged hot water, it may be possible to improve the capability of the gas burner itself. In the first invention, a premixed type of gas burner was used, i.e., the type of burner referred to as an atmospheric pressure type gas burner. This type of burner is adapted to use a pressurized premixed fuel gas which is injected by blowing into a Venturi tube opened in a direction downstream from the gas jet nozzle. As a result, part of the primary air will be sucked into the Venturi in accordance with conventional Venturi theory, and such air will be mixed with the fuel gas at an air mixing ratio of 30%–80% air from the theoretical rate of combustion air. In this fashion, a totally mixed gas will be fed into the combustion nozzle in order to effect a flame ignited by a predetermined ignition apparatus about the nozzle. Further, the necessary secondary air for effecting combustion is taken in from the environment, and it is used to effect a typically premixed type flame, i.e., in other words a Bunsen type flame. This atmospheric type burner indispensably provides stable combustion by providing a full clearance combustion chamber and sufficient draft via a smokestack and similar structure. Further, during heat transmission by the fin-tube of the heat exchanger, the Bunsen type flame will hardly be present in providing luminous radiation peculiar to a general diffusion flame. Therefore, heat transmission will be effected mainly by the coefficient of heat transmission within a range of the mass velocity of a high temperature combustion gas flow via its draft. As a result, it is considered to be an important condition in designing the burner to provide a good surface on the heat exchanger for radiation and for acting as a heat receiver.

As a conventional method of obtaining a high combustion load type of gas burner with a more compact combustion chamber which will overcome the restrictions which are peculiar to an atmospheric pressure type burner, it is possible to charge blown air forceably into a fresh air intake port of the burner system, which system includes a burner, a combustion chamber, and a heat exchanger within a sealed container-like chamber. When adopting a high load combustion method, it is advantageous to make the burner, combustion chamber, and heat exchanger compact and light. Additionally, the forced blowing control method can be achieved within the control system channel, and the contents of the control system can become further complicated.

In the prior technology as represented by U.S. Pat. No. 4,501,261, the present assignee offered technology to attach a forced air blower to a burner. Therefore, in the first and second inventions herein, it would be possible to improve the water heater by using a forced air blower controlled by improved software as detailed hereinafter. Accordingly, this improvement is referred to as a C-type improved invention hereinafter, and a working example is detailed in the drawings which follow.

20. Working Example of the C-type Improved Invention

The hardware of the C-type improved invention is similar to that of the first, second, and fourth inventions in its structure and function.

Accordingly, the main object of the C-type improved invention is to driveably control a forced air blower via a blower operation circuit N by microprocessor 17, which provides a forced air blower 38 in the upstream direction of a combustion air intake burner port.

Figure 19:
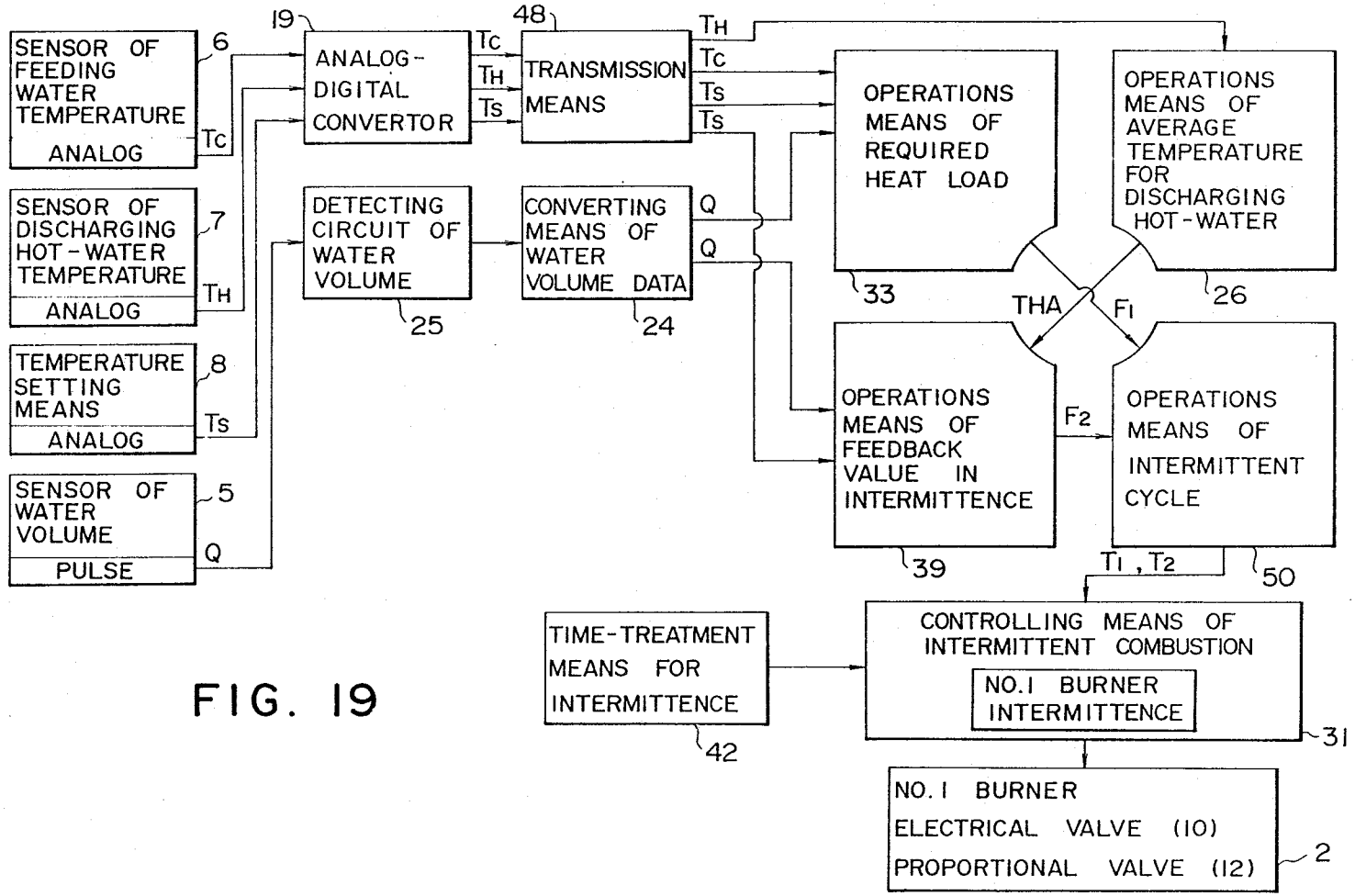
FIG. 19 is a block diagram illustrating operation of another embodiment referred to herein as the C-type invention.

Accordingly, as shown in FIG. 19, microprocessor 17 provides a water flow data conversion device 24 for obtaining the water flow rate Q from a water flow signal detected by a water flow rate detecting circuit 25, a temperature data transmission means 48 for obtaining a feeding water temperature Tc and a hot water discharge temperature Th, which are transmitted via an analog-digital converting circuit 19, and an operation device for a feeding water temperature average value 26 for calculating an average value Th of a hot water discharge temperature Th within a predetermined time period. Further, it also provides a required heat load operation device 33 for calculating a necessary heat load $F_1$, which is referred to as a feed forward necessary heat load hereinafter, in response to the water flow rate Q, feeding water temperature Tc, setup temperature Ts, the intermittent feedback value 39 from an operation means or device used to calculate the necessary heat load $F_2$ during intermittent combustion (which is referred to hereinafter as the intermittent feedback necessary heat load) in response to the average temperature Th of discharged hot water, a setup temperature Ts, water flow rate Q, and the proportional gain, and the cycle $t_1$ which is calculated by an operating device of an intermittent cycle 50. This operation device also calculates a pulse span $t_2$ for controlling the intermittent combustion in response to the finally required heat load F, which incorporates both the required heat load $F_1$ and $F_2$ which have been summed; and time treatment means for the intermittent step 42 are provided to arrange a predetermined time X in a preliminary fashion, and an intermittent combustion control device or means 41 is provided to send a control signal to an electrical valve operation circuit (G) in response to the cycle $t_1$ and pulse span $t_2$ which are calculated by the operation device for intermittent cycle 50. In this fashion, the apparatus is capable of dispatching a blower-on and a blower-off signal through a blower operation circuit N in response to the relative length of time of the off-time period, i.e., the fire extinguishing time, during an intermittent combustion period.

Figure 20:
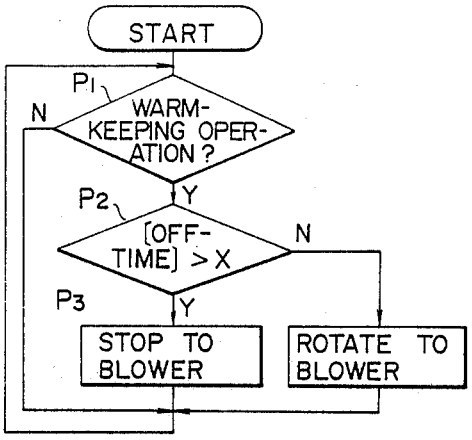
FIG. 20 is a flow chart illustrating a conventional program for blower control in the C-type invention.

In this fashion, the instantaneous gas water heater is controlled in accordance with the operational steps illustrated in the flow chart of FIG. 20. This flow chart illustrates the method of controlling the intermittent combustion of the smaller capacity type second burner 3. That is, in step $P_1$, it discriminates between a yes or no for maintaining the warm water maintenance operation; when it responds no, it continuously sounds the yes or no signals until it detects a signal for maintaining the water warm; when it responds yes, it will proceed to a warm water maintenance operation, and will then step up to step $P_2$. It distinguishes as to whether this is a state of hot water discharge or a state in which the hot water discharge has stopped, i.e., a state in which the water is maintained warm, by the existence of a signal M received from a water flow sensor 37, as shown in FIG. 1B. In step $P_2$, it can distinguish whether the off-time $t_3$ which is obtained by intermittent cycle $t_1$ and pulse span $t_2$ from the operation device of the intermittent cycle 50 are larger (or not) when compared to predetermined time X. When $t_3$ is not greater than X, it is stepped up to step $P_3$ and an intermittent combustion control means 41 will send a blower operation signal into the blower operation circuit N in order to operate the forced air blower 38. When $t_3 > X$, the intermittent control means 41 will send a signal for stopping the blower operation in stop the operation of forced air blower 38. In this fashion, the operation of the blower will be stopped when the off-time of the intermittent cycle of keeping the water warm is continued for a predetermined time period. Therefore, there is no additional heat released from the heat exchanger 1 which is intended to blow cool air from the forced air blower 38 during a water warming maintenance operation; the water warming maintenance capability is thus improved, and, as a result, no waste of fuel occurs, and fuel consumption increases.

Figure 21:
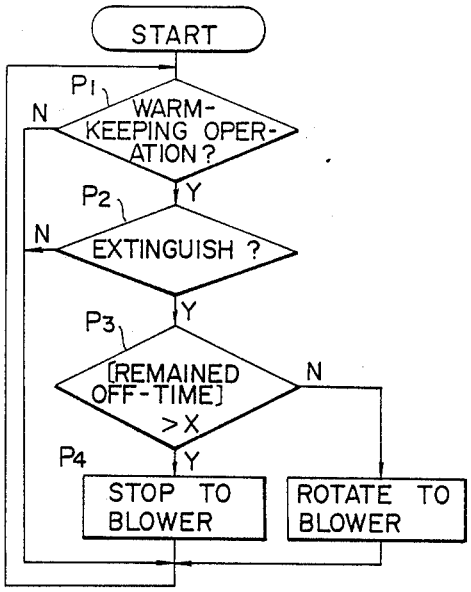
FIG. 21 is a flow chart illustrating an improved program for blower control in the C-type invention.

Further, the forced air blower is not limited to being stopped as illustrated in FIG. 20, but it can be treated in accordance with the flow chart in FIG. 21. That is, during an operation in which the water is maintained warm in $P_1$, it can be distinguished as to whether it is during the off-time or on-time of an intermittent combustion period.

Eventually, it can distinguish each off-time period during intermittent combustion, and in step $P_3$ it can distinguish as to whether time remains which will be deducted from the working time and whether or not each off-period is larger than a predetermined time X. When the remaining time is larger than the predetermined time, the step $P_4$ is reached, and stops the blower; and when the remaining time is smaller than the predetermined time, the blower is operated. Thus, the apparatus is capable of distinguishing the blower operation during each off-period, so that in addition to the above practical example, it can be controlled more carefully.

Further, as seen in FIGS. 20 and 21, a flow chart for keeping the water warm is illustrated; this is the same as with intermittent combustion during hot water discharge, because it is available to convert flow charts to a warm water maintenance operation and intermittent combustion rather than hot water discharge.

21. Explanation of Eighth Invention

As mentioned above in the C-type improved invention, the present invention provides means for stopping blower operation when the off-time of a smaller capacity type burner is maintained for a predetermined time period during intermittent combustion.

Accordingly, a water heater improved by the C-type invention was practiced in a laboratory, and provided fairly good results. However, in commercialization, and in endurance tests used therefore, the burner flame was often unstable.

That is, in the C-type invention, the control system section would be capable of sending five types of burner operational signals, as usual; and it can effect intermittent combustion and proportional combustion for a smaller capacity type burner to follow up the setup temperature, and proportional combustion of the larger capacity type burner. In these ways, the system will control the heating capacity in a mostly stepless fashion. In response to varying the heating capacity, combustion air will have to be varied properly, and the blower of the C-type invention will operate with a constant rotation and a constant blowing capacity. This will cause the burner to tend to be blown out due to a presence of excess air for some period of time. Otherwise, it will display a type of diffusion flame due to the shortage of air; in contrast, this flame will be unstable.

Against the background of the above, obviously an unsuitable blowing method existed in combustion technology. Therefore, the present invention offers a blowing method which is suitable for combustion at each stage, i.e., it is capable of controlling the blower motor with a speed control and in a proportional operational method, which operation is conducted by the control section.

Thus, the present invention effects a speed control for the blower motor and is referred to hereinafter as the eighth invention.

22. Working Example of the Eighth Invention

With specific reference to the working example in FIGS. 1A and 1B, the invention comprises a larger capacity type first burner 2 arranged within a combustion chamber, a smaller capacity type second burner 3, an air charging duct 83 joining the blower housing and the burner chamber, a common blower 38*a*, a fuel gas feeding pipeline 15, a first electrical valve 10, a gas regulator 22, a second electrical valve 11, a gas regulator 23, a hot water discharge pipeline 34, a water flow sensor 37, a feeding water temperature sensor 6, a hot water temperature sensor 7, a microprocessor 17, a control panel (B), a temperature setting means 8, and a water heater body (a). The structure of each of these apparata and the manner in which the system operates will be similar to that of the first and second inventions. However, in this invention, a common blower is operated by a signal, and is speed controlled, from a control section in order to satisfy the burning criterion for each burner.

Figure 22:
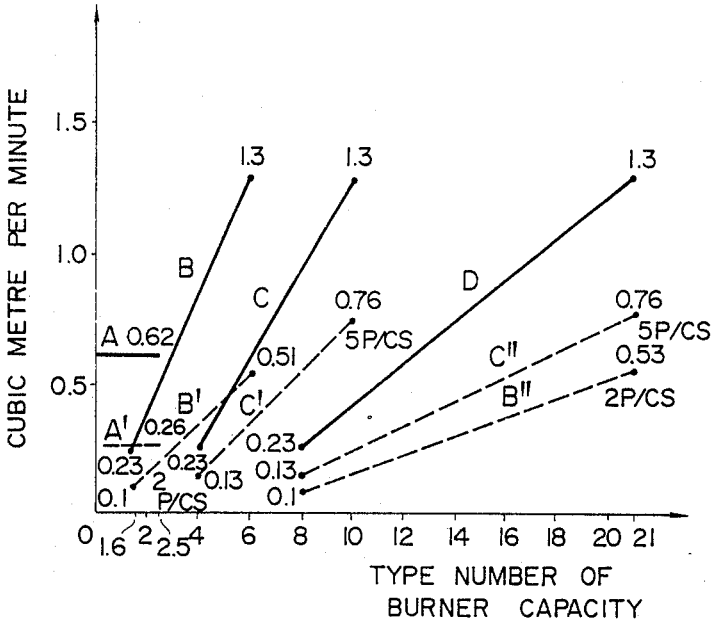
FIG. 22 is a graph illustrating the relationship between the air flow rate of combustion and the type number of burner capacity in another, eighth or No. 8 embodiment of the present invention.

With specific reference to the practical example of blowing air control in FIGS. 1A and 1B, the relationship between the necessary air flow combustion rate for the first and second burners 2 and 3, and the combustion capacity number, are illustrated in the graph of FIG. 22.

The necessary airflow rate A' of the second burner 3, which is operable in an intermittent combustion fashion with a combustion capacity between No. 0 and No. 2.5, will be 0.26 $m^3$/min., where $m^3$/min. equals cubic meters per minute. However, when only the second burner 3 is used, due to the existence of partial wall 84, partial of the air flow will escape into the combustion chamber of the first burner 2. Therefore, about 0.62 $m^3$/min. of the excess air flow A will actually be required. The necessary air flow rate B' of the second burner 3, which is operable in a proportional combustion fashion with a combustion capacity between No. 1.6 and No. 6 can be increased within a range of 0.1 $m^3$/min. to 0.51 $m^3$/min. However, due to the escape of air flow into the No. 1 burner 2 side combustion chamber, an excess air flow rate of between 0.23 $m^3$/min. and 1.3 $m^3$/min. will be required.

The necessary airflow rate C' of the first burner 2, which is operable in a proportional combustion fashion with a combustion capacity between No. 4 and No. 10 can be increased within a range of 0.13 $m^3$/min. to 0.76 $m^3$/min.; however, due to the air flow escaping into the combustion chamber of the second burner 3, an excess air flow of between 0.23 $m^3$/min. to 1.3 $m^3$/in. will be required including a proportionally supplied air flow C.

Necessary air flow rates B'' and C'', during combined combustion by the first and second burners 2 and 3, are operated at a combustion capacity between No. 8 and No. 21, and will be within a range of between 0.1 $m^3$/min. to 0.53 $m^3$/min. for the above No. 8 combustion capacity and also 0.13 $m^3$/min. to 0.76 $m^3$/min. for the above No. 21 combustion capacity, respectively. However, in order to supply the necessary air flow rate D for covering between the No. 1.6 and No. 6 combustion capacities of the second burner 3, with the exception of the necessary air flow rate B'' of the first burner 2, air flow escaping into the side of the second burner is available for the necessary air flow C'' of the second burner.

When using the second burner 3 as above, and when using the first burner 2, and further when using the first and second burners 2 and 3, the air charging rates A, B, C, and D are different from each other and are controlled by microprocessor 17, which is adapted to calculate the necessary heat load in response to the air flow rates, the feeding water temperature, the setting temperature, the hot water discharge temperature, the heat efficiency of the heat exchanger, the proportional gain, and to then select the necessary air flow rates A, B, C, and D for each combustion capacity number in order to control the speed of the common blower **38*a*** via the air flow rate control circuit within the microprocessor.

Figure 23:
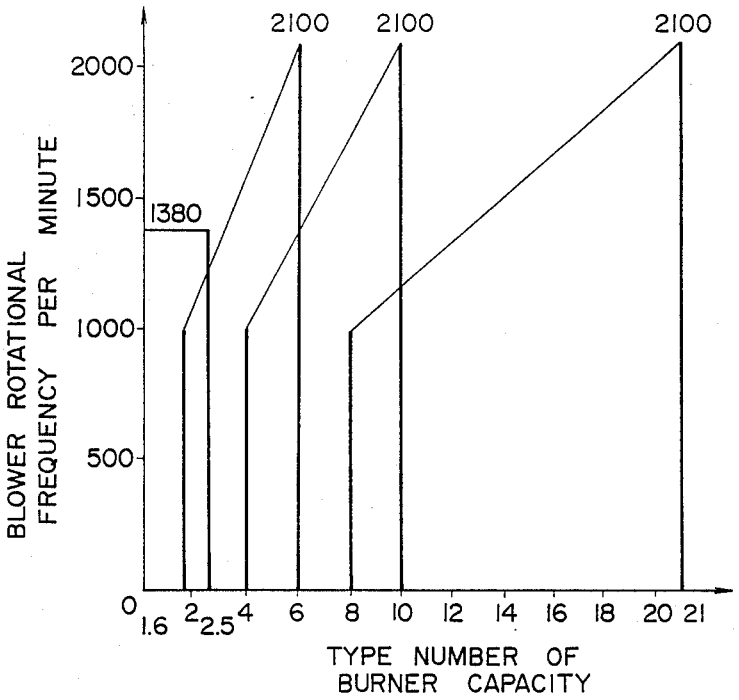
FIG. 23 is a graph illustrating the relationship between the rotational frequency of a blower and the type number of burner capacity in the eighth embodiment of the present invention.

The necessary rotational frequency of the common blower **38*a* is referred to in FIG. 23**, which is a graph of the relationship between the number of the combustion capacity and the rotational frequency of the blower.

22. Explanation of the Ninth Invention

In the eighth invention, technology was provided for controlling the airflow rate of combustion via a blower speed control in proportion to the variation in the fuel gas volume.

However, during commercialization, a new technical problem arose. This problem involved the failure to synchronize the motion of the proportional valve and the blower rotation. In other words, in comparison to the movement of the proportional valve, the movement of the blower was always delayed due to the momentum of the blower rotor, because a constantly rotating blower rotor was always affected by inertia, so that it was hardly possible to restrict and synchronize with the other motion unless it was converted to a different type of blower motor, i.e., a type of pulse motor or similar structure.

As a result of the delayed response of the blower motor, when there is an immediate increase in the fuel gas supply, a burner flame will evidence a yellow flame phenomenon. As a result, it is feared that a burned mixture of gas containing various unburned materials might attack the heat exchanger, and cause an active reaction resulting in material deterioration in an area in which the material contacted the gas mixture. Otherwise, due to immediate decreases in the fuel gas supply, the gas flame would be blown out, and it was thus feared that raw gas might leak outwardly from the burner.

As one means of solving this problem, it would be possible to provide means for detecting the delay response of the blower, and in proportion to the actual variation of the blowing capacity, synchronize the movement of a proportional valve with the actual variation of the blower's movement.

Accordingly, such an improved type of water heater, in which the actual air blowing rate and the movement of the proportional gas valve would be synchronized will be hereinafter referred to as the ninth invention, and will be detailed in the drawings which follow.

23. Working Example of the Ninth Invention

Figure 24:
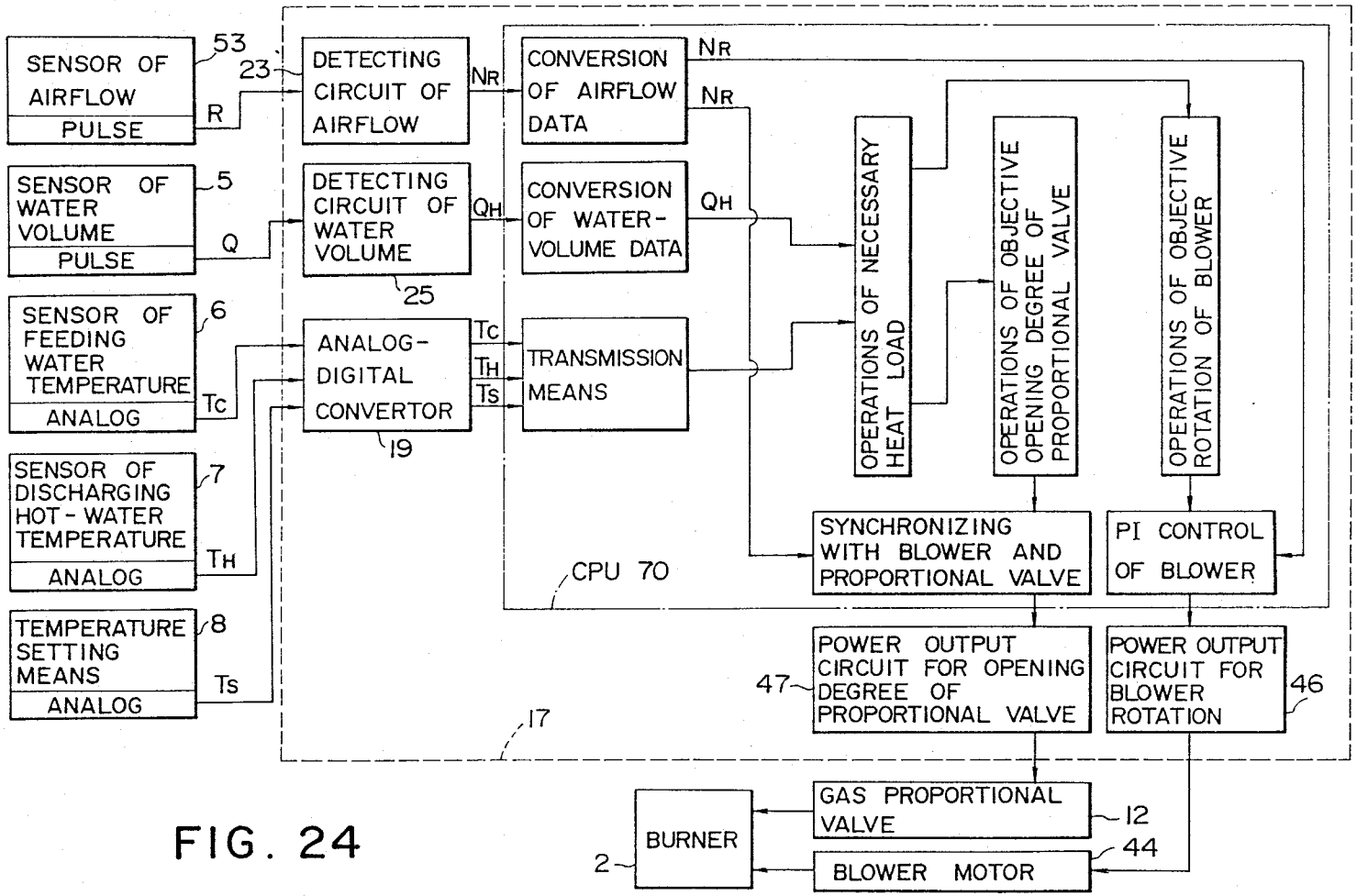
FIG. 24 is a block diagram illustrating the function of the ninth, or No. 9, embodiment of the present invention.

In FIG. 1B and the block diagram of FIG. 24, an air flow rate sensor 43 is shown which will detect the rotational frequency of the blower motor 44, and a pulse signal proportionate to the rotational frequency will be sent.

Besides, a control panel (b) is arranged in an isolated fashion with respect to water heater body (a,) and a power source switch 18 is provided as well as a temperature setting means 8.

The temperature setting means is provided to set up an objective temperature for hot water discharge, and will send a voltage pulse in response and conformance with the above-noted setup temperature.

Each above signal is, as seen in FIG. 24, accepted by microprocessor 17, which is housed within water heater body (a), and treated by a CPU 70.

In other words, the CPU 70 will convert an input signal from a water volume sensor 5, via a water volume detecting circuit 25 into water data Qh, and also input signals from the temperature setting device 8, feeding water temperature sensor 6, and hot water discharge temperature sensor 7, all into setting temperature data Ts, feeding water temperature data Tc and hot water discharge temperature Th, respectively, through an A/D converter 19, and in accordance with such data, the CPU 70 will calculate the required heat load in accordance with the following equation:

$$F=[Qh\times(Ts-Tc)]+[\alpha\times Qh\times(Ts-Th)]$$

On the other hand, an output signal from air flow rate sensor 43 will be accepted by CPU 70 via air flow rate detecting circuit 45, and will be converted into air flow rate data N.

Further, CPU 70 will calculate the objective rotational frequency Ns of common blower 45 in response to the above required heat load and thereafter CPU 70 will send an output signal representative of a PI control method to control the blower rotation via the blower rotating output circuit 46, after calculating and comparing the rotational frequency Ns and the air flow rate data N. At the same time, CPU 70 will calculate the objective opening Ps of the first proportional valve 12 and the second proportional valve 13 in response to a necessary heat load, and will then compare the objective opening Ps to air flow rate data N, and will send an output signal representative of the opening ratio of the proportional valve in response to the above result and compare it to a rectified value; in addition the rectified value will be placed on an objective opening through proportional valve opening output circuit 47.

The blower rotational frequency output circuit 46 and the proportional valve opening output circuit 47 will then send a suitable rotational frequency signal and a suitable opening signal, respectively, into each of the blower motor 44 and proportional valves 12 and 13, in order to operate them.

24. Explanation of the D-type Improved Invention

In the above-noted ninth invention, the present invention offered a technology which would not transmit the variation in fuel gas feeding rate into a proportional gas valve, but which would make a proportional gas valve coordinate its movement with the real steps of the actual air flow rate of the blower.

Accordingly, in this type of an instantaneous gas water heater, in which combustion air is chargeable by being forced by the blower, the velocity of the combustion gas which passes through the interior of the combustion chamber and/or the interior of the heat exchanger, will be at a high speed in comparison to the conventional exhaust used in an atmospheric pressure type burner having a natural draft, e.g., a smokestack or the like. In increasing the exhaust gas velocity, it is significant that the coefficient of heat transmission within the heat exchanger be improved; on the other hand, it is disadvantageous to have a heat exchanger change into an air-cooled type radiator when the operation of the burner is stopped. Therefore, in this combustion method, which provides two units of burners whose burning rotation switches frequently, it is possible to avoid inserting the combustion off-time between the times at which the operation of the burners is switched.

From this viewpoint, reviewing the operation of the burners in the prototype, it was determined that the off-time would be inserted between the switching times of the first and second burners 2 and 3.

This interposition of the off-time will be explained further with respect to FIG. 25, where it is clear that the second burner off-time 96 is provided.

Figure 26:
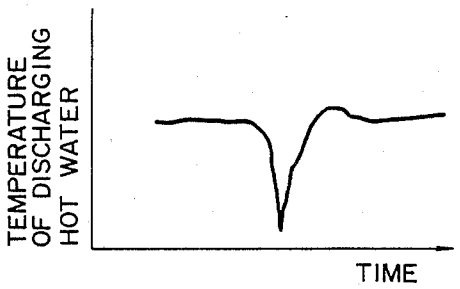
FIG. 26 is a graph illustrating the conventional temperature characteristics of hot water discharged, as used to explain the D-type invention.

As a result of this, as illustrated in FIG. 26, the disadvantage is unresolvable in that the hot water discharge temperature decreases temporarily.

Figure 27:
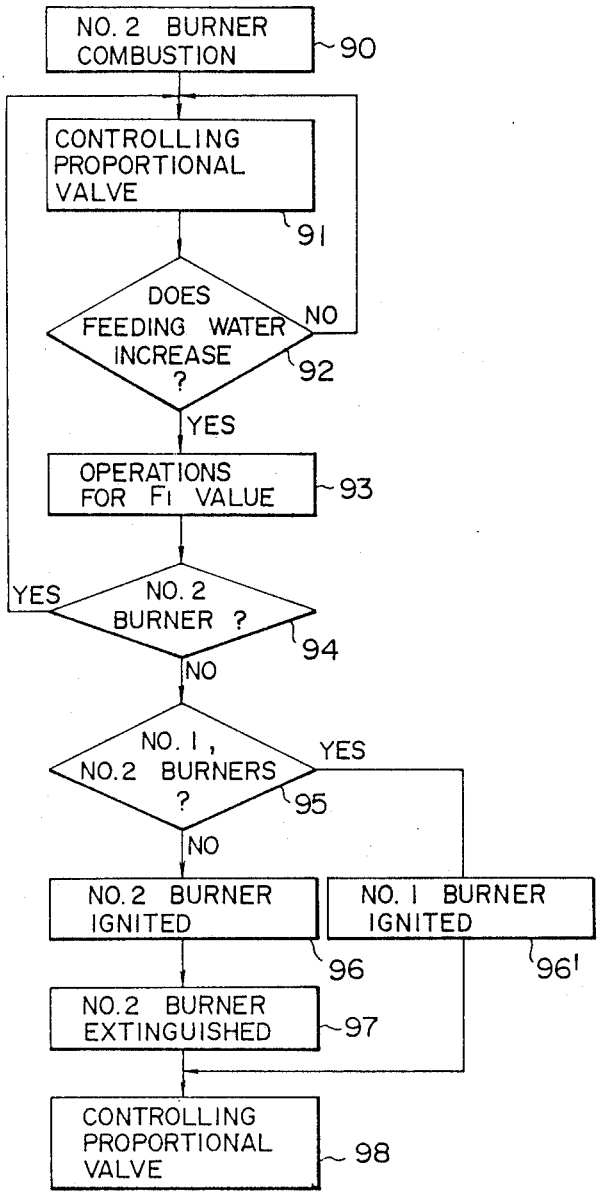
FIG. 27 is a flow chart illustrating an improved program for use in the D-type invention.

As a method of resolving this problem, the present inventor has made the following improvement: with respect to FIG. 27, the first burner is ignited at step 96' while the second burner is ignited at step 96; after that, the second burner off step 97 is performed.

As a result, a water heater undergoing improved performance will be hereinafter referred to as the D-type invention, and will be detailed with respect to the drawings which are described herein.

25. Working Example of the D-type Improved Invention

Figure 29:
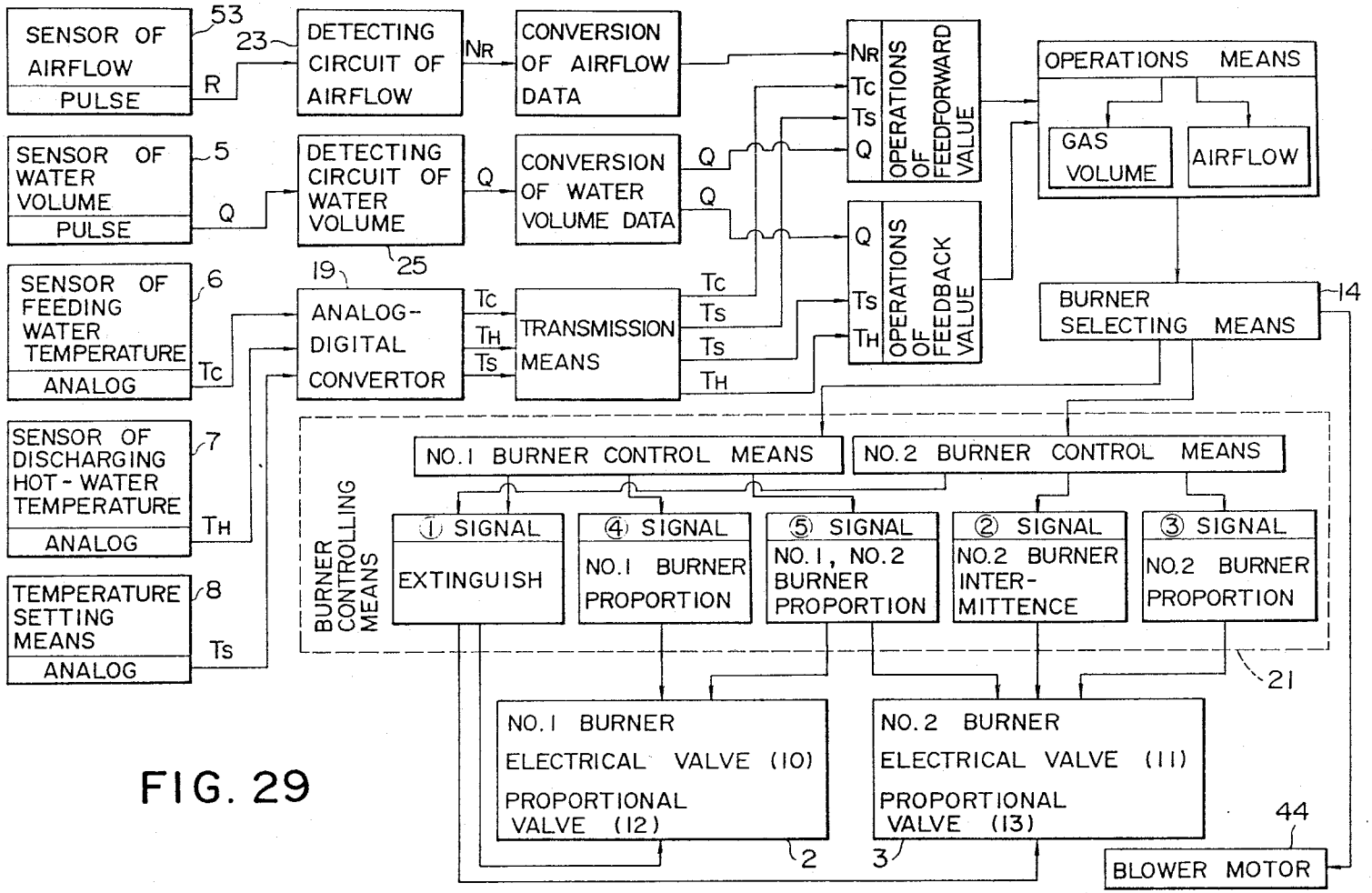
FIG. 29 is a block diagram illustrating the manner of operation of the D-type invention.

As shown in the block diagram of FIG. 29, an essential part of the D-type improved invention resides in the fact that burner control means 21 is divided into two sections, i.e., a major point resides in first burner 2 and a minor point in second burner 3, respectively. According to this software improvement, it will be possible to improve the otherwise sharp drop-off of the hot water discharge temperature during switching from the second burner 3 to the first burner 2. In describing the principle of the working example of the present invention, burner control means 21 is connected to the second burner 3 and the first burner 2, respectively, and when burner selecting device 14 switches from second burner 3 combustion to first burner 2 combustion (second burner combustion leads to first burner combustion), it is adapted to control the operation so as to ignite the first burner 2 and thereafter stop the second burner 3.

Figure 25:
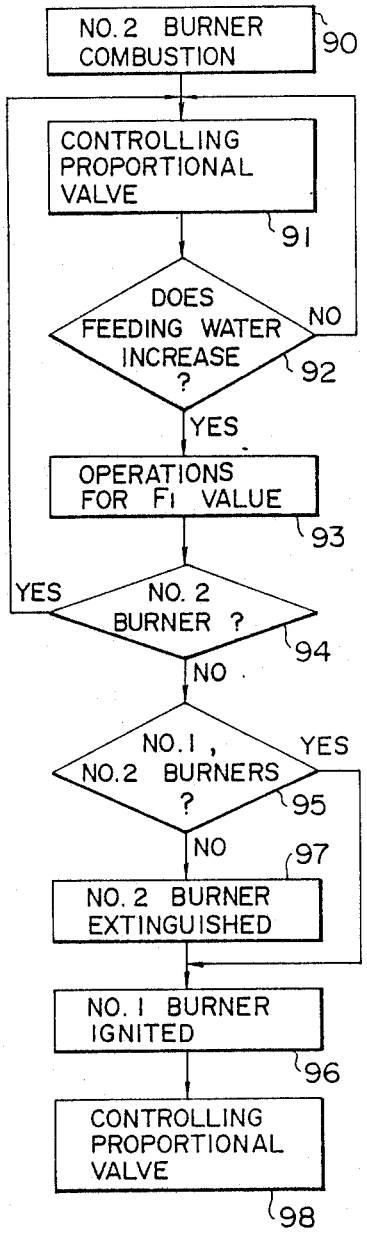
FIG. 25 is a flow chart illustrating a conventional program for explaining another embodiment, i.e., a D-type invention in accordance with the present application.

Next, in explaining the operation of the example referred to in FIG. 27, section 96 of FIG. 25 is replaced by section 97. Accordingly, when the first and second burners 2 and 3 both undergo combustion after the second burner 3 has performed alone, it is possible to ignite the first burner 2 (at step 96') by first controlling proportional valves 12 and 13 (see step 98).

When the second burner 3 combustion is switched to the first burner 2 combustion (at 95), the first burner 2 is first ignited (at 96), and the combustion of the second burner 3 is stopped (at 97) thereafter via control of proportional valve 12 (at step 98).

Figure 28:
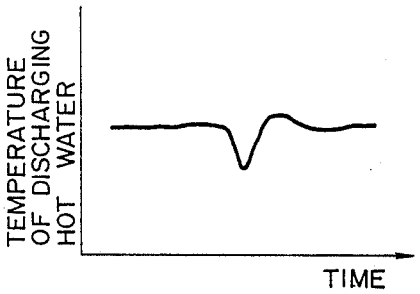
FIG. 28 is a graph illustrating the improved temperature characteristics for hot water discharged in the D-type invention.

FIG. 28 illustrates the temperature characteristics of the hot water discharge temperature. As shown in sections 96 and 97 of FIG. 21, there is no off-time for the burner; therefore, the sharp drop of the hot water discharge temperature illustrated in FIG. 28 is improved in comparison to that of FIG. 26.

26. Explanation of the Tenth Invention

As noted above, the first invention, when used as a prototype, was capable of intensifying the intent of the instantaneous gas water heater in preventing the air-cooled disadvantages of a heat exchanger when combustion air is forceably charged by an attached blower, as in the D-type improved invention and in others, and for improving the temperature characteristic of the hot water discharge temperature.

Meanwhile, in accordance with recent health thought, a variety of health instruments on the market have been used to provide training in the home or office for users of such instruments.

As part of this trend, it has been promoted that alternate hot and cold water showering provides a massaging effect to a bather and improves the blood circulation, activating the function of internal organs and releasing the user from stress.

Accordingly, at present, a bather will take a hot and cold shower or bath by using his hands to operate a conventional faucet and similar structure; otherwise, it is necessary to use a basic type of an automatic cold and hot shower device while trying hard to obtain the desired effect. Therefore, it is possible to provide technology for a hot and cold showering system incorporated into a prototype.

27. Conventional Prior Technology

A conventional type of hot and cold showering system previously used was adapted to control a hot and cold water shower by calculating the necessary heat load in the operational section of the device in accordance with elements of the structure arranged, at the option of a user, after arranging all of the elements of the apparatus at a temperature centrally located between a cold and hot showering temperature, arranging the cycle of showering, the swing wave span for the showering temperature (at half the difference between the highest temperature and the lowest temperature), and a showering time ratio for cold and hot shower water; i.e., the time ratio between the cold water shower time and the hot water shower time within one rotational cycle.

Accordingly, the above type of conventional cold and hot showering system has been evaluated at a lower level, which creates disadvantages such as:

(1) it was unable to show the function of cold and hot showering in accordance with the temperature set during the higher temperature of feeding water which exists during the summer;

(2) according to an increase in the single wave span of the showering temperature due to the overshooting of the heat exchanger pipeline connections, the average temperature (i.e., the central temperature) will rise and will adversely affect the bather; and (3) it was hardly possible to adjust for the preferable showering cycles or temperature for each user's taste.

Therefore, it has been considered to fix the central temperature, the cycle of showering, and the time-ratio of cold and hot showering, and to fixably arrange the swing wave span of cold and hot showering temperatures in an operational section.

In this fashion, it is not only well operable, but it can also be used to prevent the discharge of abnormally hot water caused by fixing the central temperature, and also can obtain an evenly averaged temperature having no relationship to the swing wave span of cold and hot showering. Furthermore, it can increase the effect of showering by fixing the ratio of cold and hot water, i.e., a 50% ratio, which is most effective during a cycle of showering. However, there are still several questions about such a procedure.

That is, in one example, a water heater adapted to discharge cold and hot water for showers may be capable of being arranged with a swing wave span having eight steps, with each step being approximately 5° C., in which a burner is provided having a combustion capacity No. 21, i.e., the highest combustion capacity, for heating the heat exchanger in which the following equation is accurate: $F=F_1\pm\alpha\times Qh$... [1] equation. Wherein F is the necessary heat load, $\alpha$ is the swing wave span, $F_1$ is the required heat load to be obtained at the central temperature (an average required heat load), and Qh is an overflow rate.

From the above equation, when the flow rate is 10 l/min. (i.e., 10 liters per minute), this requires the best combustion capacity number to be capable of discharging hot and cold water of a wide swing wave span of about one-half of the amount of the No. 21 combustion capacity, i.e., on the order of $F_1=250$ Kcal/min., where it is possible to vary the temperature within a range of $MAX\times Qh\pm250$ Kcal/min. Accordingly, the swing wave span will be between F MAX.$=250+250=500$ Kcal/min; and F MIN.$=250-250=0$ Kcal/min.

However, in this fashion, the suitable seasons in which $F_1=250$ Kcal/min will only be the spring and autumn seasons, where the feeding water temperature is approximately 12° C.; in these seasons, it will be bearable to use such water, but a problem arises in the summer season when the feeding water temperature is around 25° C. In a trial with a central temperature of 37° C., and a water flow rate of 10 l/min, the equation is:

$F_1=(Ts-Tc)xQh=(37-25)x10=120$ KCal/min.

Thus in equation [1], where $F=F_1\pm\alpha\times Qh$, and substituting $F_1=120$ KCal/min, $Qh=10$ l/min, and $0>F<525$ for calculations, then $\pm\alpha\times Qh<F$, and $\pm\alpha<F_1/Qh=120/10=12$. Therefore, the actual range of the $\alpha$-value obtained will merely be 5 or 10.

Further, in the winter season, when the feeding water has a 5° C. temperature, the central temperature is 38° C., and the water flow rate is 10 l/min; then, $F=(Ts-Tc)\times Qh=(38-5)\times10=330$ KCal min. Thus, in equation [1], $F=330+\alpha\times Qh$ so that, the condition to be satisfied by F will be $0\leqq330-\alpha\times Qh$, where $\alpha\leqq33$, and $330+\alpha\times Qh\leqq525$, where alpha $\leqq19.5$. Therefore, the actual range of the value of alpha will be within ranges with limits of 5, 10, and 15.

In summary, even if the eight steps are arranged so as to have a 5° C. span, e.g., 5°, 10°, 15°, 20°, and 25°, forming the swing wave span, it is still only possible to control over a span of five steps such as 1 to 5 in the spring and autumn, two steps 1 and 2 in the summer, and three steps 1 to 3 in the winter.

27. Problem to be Resolved

The problem to be resolved herein is to scale up the controllable range to control fixation of the hot and cold water discharging cycle up to the highest possible limits of the swing wave span, and in cases when the range is exceeded, to control the range by varying the cycle.

28. Means of Resolving the Problem

The method of resolving the above-noted problem is to connect a water feeding source and the hot and cold shower instrument to each other with a water feeding channel having a heat exchanger; the exchanger is positioned at a central point of the channel.

The hot and cold shower device includes a feeding water source connected to an instrument for providing a cold and hot shower by feeding water channel with a heat exchanger located along a midpoint of the channel; this device is provided to discharge high temperature hot water and a lower temperature hot water in a reciprocal fashion from a cold and hot shower instrument by periodically varying the heating state of the shower, both in small cycles and in large cycles within the heat exchanger, by using a burner. The following devices can be used: (a) a water flow sensor which is arranged along the feeding water channel; (b) a feeding water temperature sensor which is adapted to be arranged on the upstream side of a heat exchanger along the feeding water channel; and (c) means for memorizing a central temperature between the cold and hot water, a cycle time, and the ratio between the time during cold and hot water is discharged, respectively, and further for memorizing the swing wave span for cold and hot water which is arranged in optional steps by a setting section.

Accordingly, when the device is arranged to exceed the widest limit range of the swing wave span of temperature which is controllable in a fixed cycle, the swing wave span is arranged in a varied cold and hot water cycle.

Accordingly, the invention is adapted to improve the prototype. This improved prototype is referred to as the tenth invention hereinafter, and a working example is explained with respect to the attached drawings.

28. Working Example of the Tenth Invention

Figure 30:
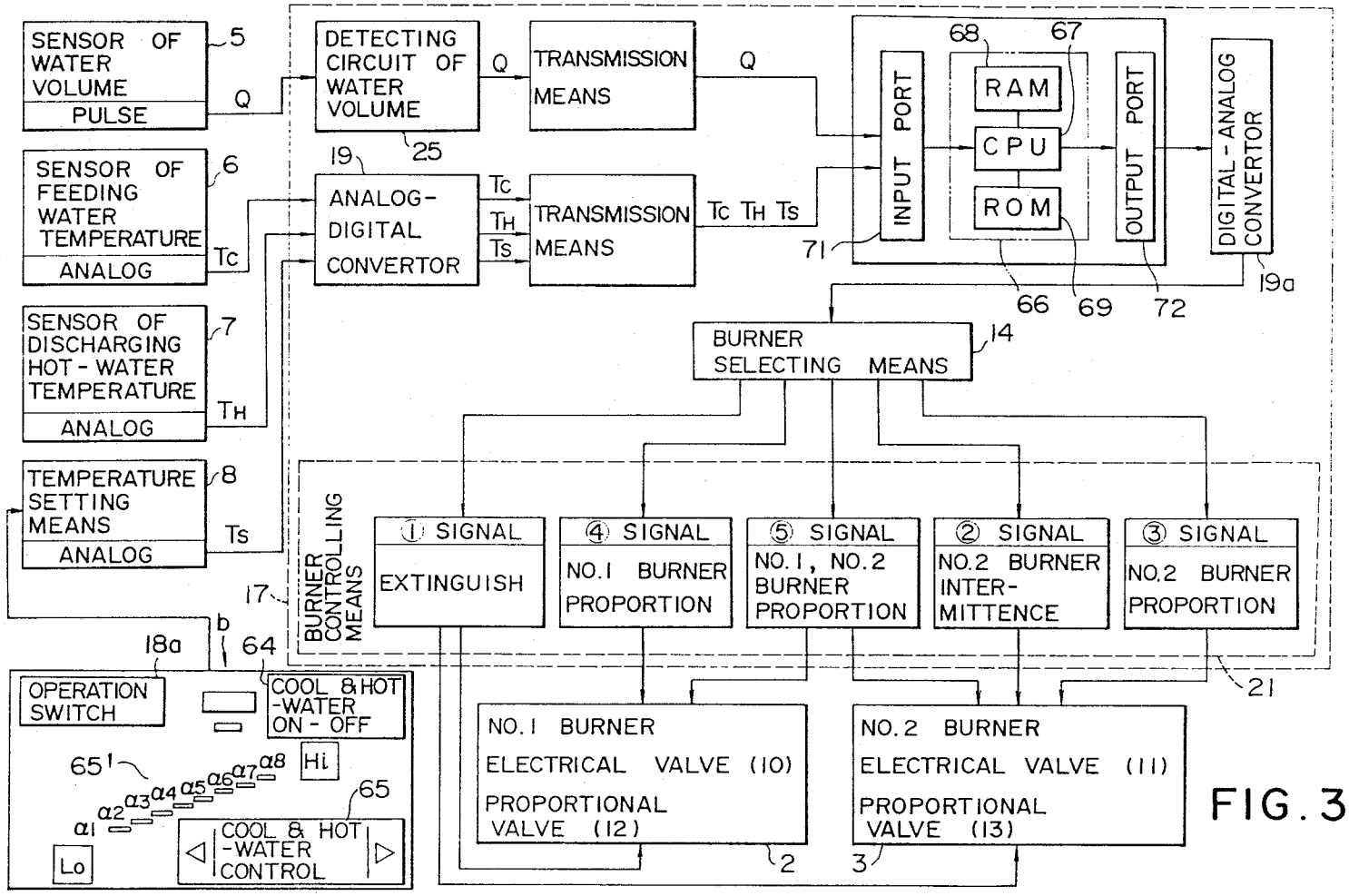
FIG. 30 is a block diagram for showing the operation of a tenth, i.e., No. 10, embodiment of the present invention.

FIG. 30 illustrates one embodiment of a working example, and the function of the hardware is similar to that in the first and second inventions.

Control panel (b) includes a power source switch 18, a first operating switch 18*a*, a cold and hot shower operating switch 64, a temperature swing span setting section 65 together with an associated display section, in which the swing span $\alpha$ arranged in the setting section 65 is converted to data via an A/D convertor 19.

The temperature swing span $\alpha$ is arranged with the eight steps, i.e., $\alpha 1$, $\alpha 2$, $\alpha 3$, $\alpha 4$, $\alpha 5$, $\alpha 6$, $\alpha 7$, and $\alpha 8$, with the swing span of each step being 5° C. and each successive step increasing upwardly by 5° C.

Microprocessor 17 mainly comprises a microcomputer 67.

The microcomputer basically comprises a CPU 70, an RAM 68, i.e., a random access memory, and an ROM 69, i.e., a Read-Only memory.

The program for controlling CPU 70 is written into ROM 69, and therefore CPU 70 will take in any necessary external data through input port 71 in accordance with the above program. Otherwise, it gives and receives data from RAM 68, and in this case it calculates and treats and, when necessary, sends, treated data into output port 72.

Output port 72 receives an output port designated signal, memorizes it temporarily within the port, and thereafter releases it into D/A converter 19*a*, i.e., into a digital-analog convertor.

The D/A converter 19*a*, converts digital signal from output port 72 to an analog signal for controlling a proportional valve and an electrical valve, and sends the signals into the first and second proportional valves 12 and 13 and the first and second electrical valves 10 and 11.

Figure 31:
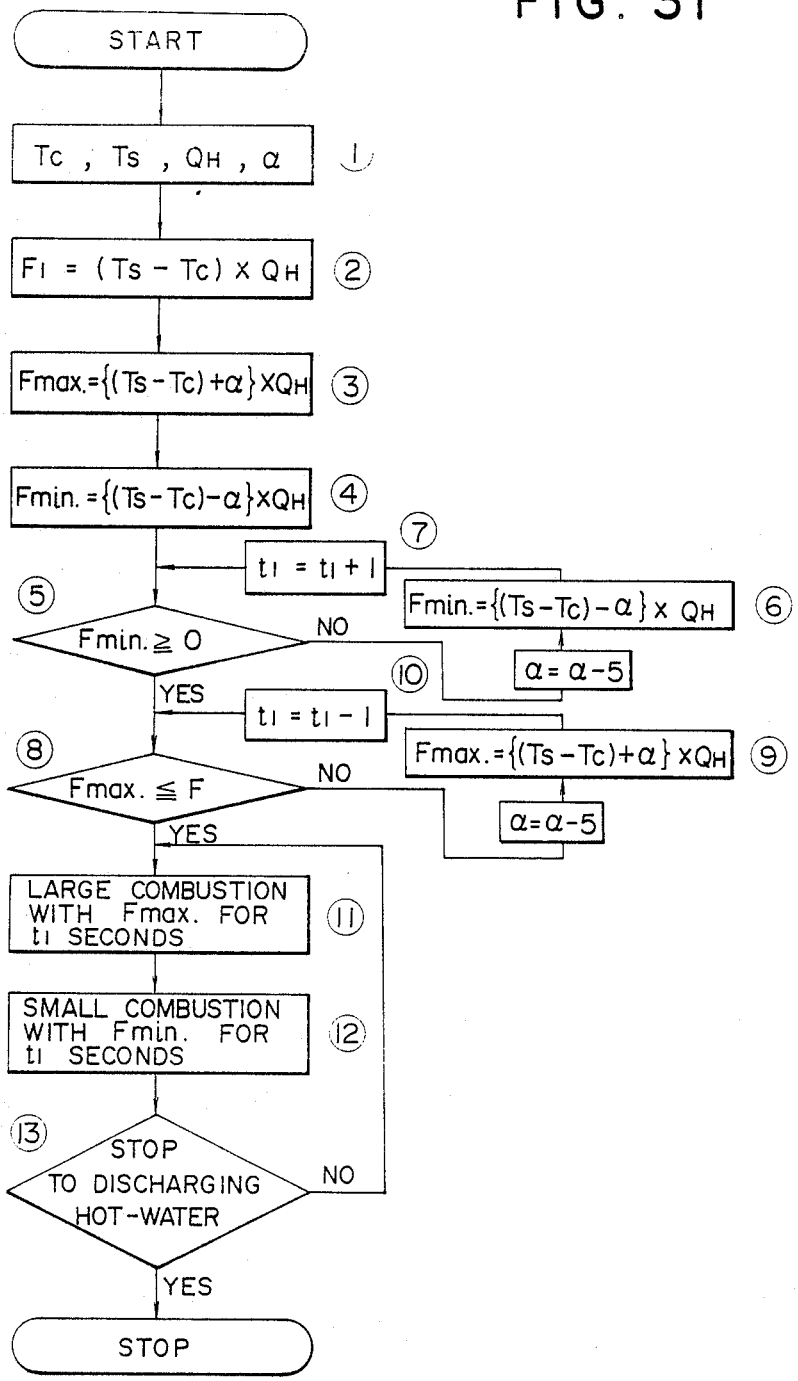
FIG. 31 is a flow chart illustrating a program of the tenth embodiment of the present invention.
Figure 32:
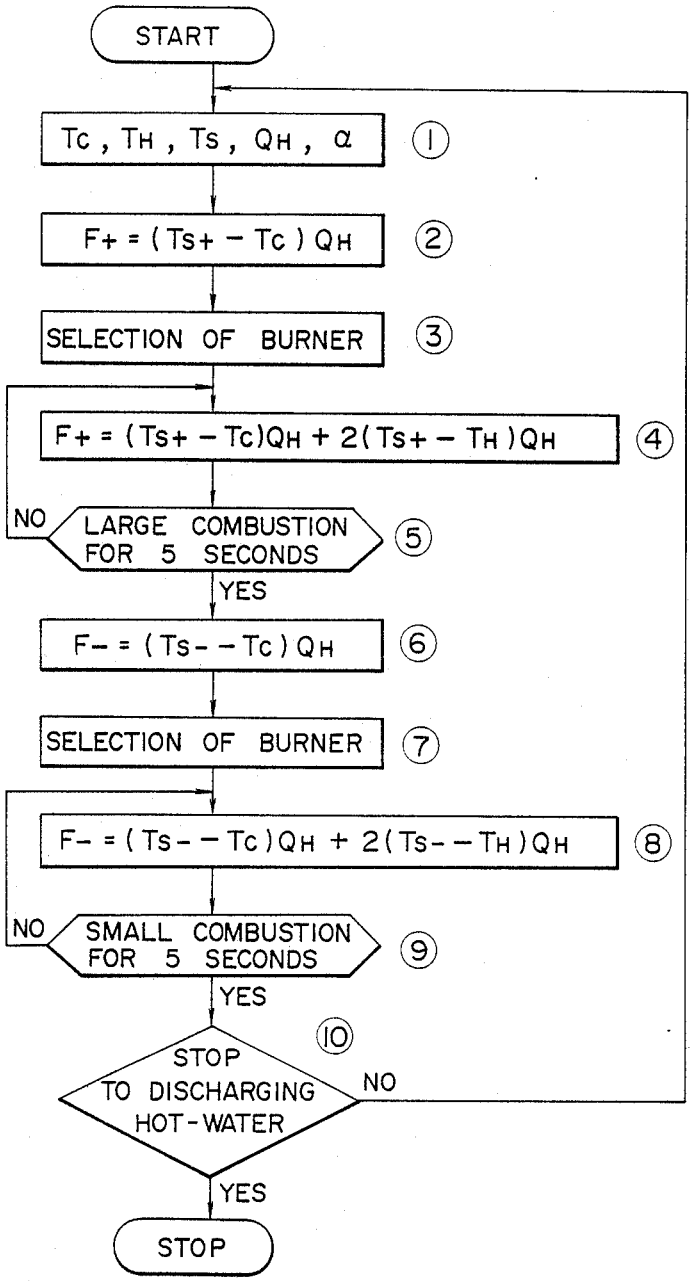
FIG. 32 is a flow chart illustrating a program of the eleventh, i.e., No. 11, embodiment of the present invention.

Reviewing the program written in ROM 69 within the flowchart, as shown in FIG. 31, the data includes the central temperature between the cold and hot water, the cycle time for showering, and the ratio between the time of discharge of cold water and the time of discharge of hot water, all of which are completely memorized as fixed data.

Meanwhile, the function of the cold and hot shower system will now be explained with reference to FIG. 31.

When the switch for operating the cold and hot shower 64 on control panel (b) is switched to an on position, the program will be initialized, and CPU 70 will first take in the waterflow rate Qh as a converted pulse signal from the water volume sensor 5. At the same time, it will take in a signal representative of feeding water temperature Tc and temperature swing span data $\alpha$ which are transmitted from feeding water temperature sensor 6 and temperature swing span setting section 65 on control panel (b) through A/D convertor 19 (as in the above step No. 1). It then calculates the required heat load, assuming an average required heat load $F_1$ to obtain a value of Ts in accordance with between the cold and hot water data (the above being considered as Step No. 2).

Next, CPU 70 calculates the required heat load, i.e., the highest required heat load (or F max.) needed to obtain a high temperature for both the cold and hot water and also the lowest required heat load (or F min.) necessary to obtain the lower temperature water for the cold and hot water in accordance with an average required heat load $F_1$, an arranged temperature swing span $\alpha$, and specified water flow rate data (these constitute Step No. 3 and No. 4).

It is reasonably uncontrollable whether the value of F min. is 0 and/or larger than 0 or not (this is considered to be step No. 5); and, when F min. is less than 0, CPU 70 will step down the $\alpha$ value, one step at a time, over the eight steps (as in Step No. 6); and, further, it steps up or increases the cycle time $t_1$ so that F min. $\geqq 0$ (see Step No. 7).

Values of F max. which are too large, or greater than the highest combustion capacity No. of F of the water heater, also cannot be controlled in a reasonable fashion. It is thus distinguishable whether F max. is the same as F or smaller than F (as in Step No. 8); in the case in which F max. $>$ F, the $\alpha$ value is dropped one step downwardly (see Step No. 9) and, simultaneously, it steps up the cycle time $t_1$ by one tier so that F max. $\leqq$ F (see Step No. 10).

Accordingly, when F min. $\geqq$ zero and F max. $\leqq$ F, the burner is operated at F max. combustion (i.e., a large combustion) within a $t_1$ second time (see Step No. 11), and is switched so as to operate with F min. combustion, i.e., a small combustion as shown in Step No. 12.

After that, rotations are continuously repeating until a stop instruction is sent in the hot and cold switch off position, i.e., when switch 64 is in an off position (see Step No. 13).

29. Explanation of the Eleventh Invention

In the tenth invention relating to cold and hot showering, technology has been provided to arrange the temperature swing span with a plurality of 5° C. steps, in tiers, both upwardly and downwardly in accordance with the calculation of a temperature centrally located between the preferred high and low temperatures.

However, because the above temperature control system was adopted as a so-called feedforward method, the rising and falling gradient is relatively gentle during the switching time between hot and cold water; as a result, it was unsatisfactory in providing temperature stimulation of cold and hot showering effectively to a bather.

As a result, an object of the invention is to improve this tenth invention in this regard.

30. Means for Resolving this Problem

During the preliminary preparation of a program into ROM of the control section, i.e., into the section of Read-Only memory, in response to a question from the CPU, a preliminary program is provided to be responsive to, and driven by, a doubly amplified feedback value. In performing such method, the burner is always directed under the control of a required heat load which is suitable for the twice amplified feedback value, so that the burner will be able to accomplish heating at a of cold water drastically high temperature.

This type of improvement is hereinafter referred to as the eleventh invention, and is explained hereinafter.

31. Working Example of the Eleventh Invention

As illustrated in FIG. 30, the hardware section of the eleventh invention is based upon that of FIG. 1, and is similar to that of the tenth invention.

Figure 33:
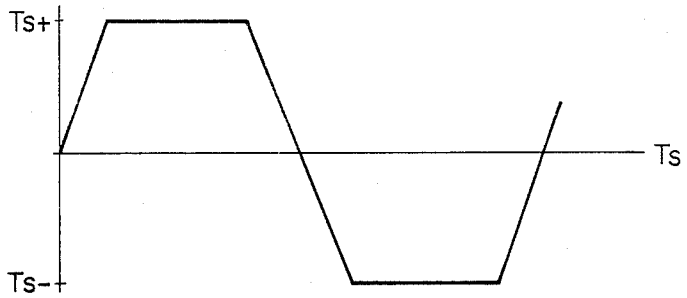
FIG. 33 is a graph illustrating the improved temperature characteristics of the hot water discharged in operation the eleventh embodiment of the present invention.
Figure 34:
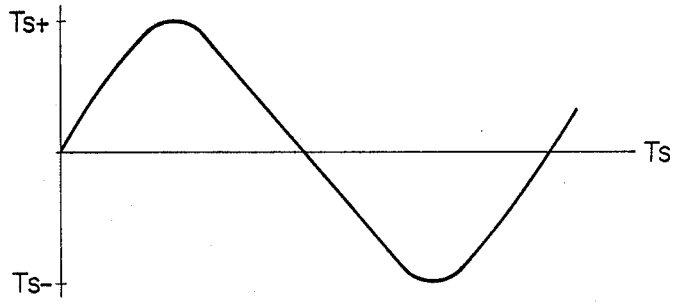
FIG. 34 is a graph illustrating the conventional temperature characteristics of the cool and hot water which are reciprocally and alternately discharged, used in order to provide an explanation of the eleventh embodiment of the present invention.
Figure 35:
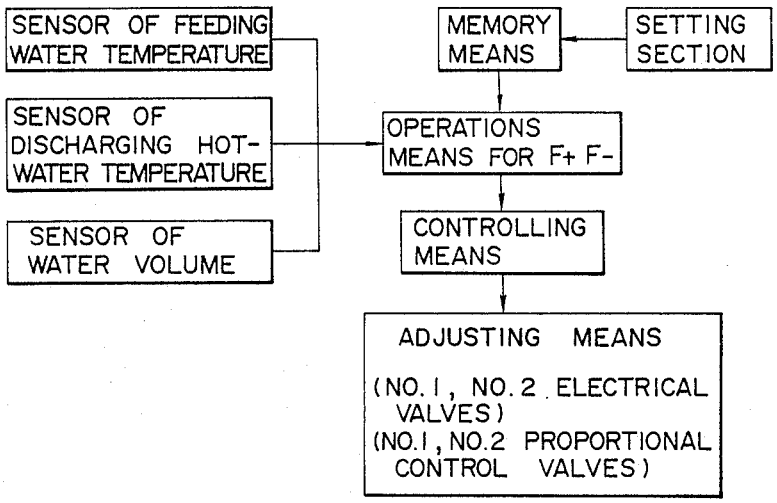
FIG. 35 is a block diagram illustrating the operation of the eleventh embodiment of the present invention.

The basis of this invention can be summarized in that a program for varying the cold and hot water temperature is written into software so that it will vary along a sharp gradient. Accordingly, the program is written into ROM 69, and as shown in FIG. 33, the data relates to a temperature centrally positioned between the cold and hot water temperatures, a cycle time, and a discharge ratio for cold and hot showering which are memorized as fixed data, e.g., in which the cycle time is 10 seconds and the discharge ratio is 50%.

As a consequence, the function of the cold and hot shower system will be explained in accordance with FIG. 33 as described hereafter.

In control panel (b), when power source switch 18 is turned to ON, and when the cold and hot shower operation switch is turned to ON, the program will be initialized, and CPU 70 will take in data relating to the overflow rate Qh, in the form of a converted pulse signal received from water volume sensor 5, as well as feeding water temperature data Tc and hot water discharge temperature data Th transmitted via an A/D converter from a feeding water temperature sensor 6 and a hot water discharge temperature sensor 7 through an A/D converter, respectively. Further, the CPU takes in data relating to the temperature swing span $\alpha$ transmitted from temperature swing span setting mechanism 65 of control panel (b) via an A/D converter (see Step No. 1). Further, CPU 70 calculates the required heat load to obtain a value of high temperature hot water Ts+, i.e., the required heat load necessary to obtain high temperature hot water F+ in accordance with the above data Qh, Tc, and Ts which have been fixedly memorized in a preliminary fashion; in this case, the above calculation is effected by a feedforward method (see Step No. 2), and a useable burner is then selected in compliance with these values (see Step No. 3).

In the next step, CPU 70 will calculate the required heat load and the gainable high temperature hot water F+, which includes a doubly amplified feedback in addition to a standard required heat load calculated by the feedforward value (see Step No. 4). In response to the feedforward value, a heat capacity adjusting means is controlled, and the first burner 2 is burned largely for five seconds with a heating capacity corresponding to the gainable high temperature F+ (see Step No. 5).

Successively, the CPU then calculates the necessary heat load required to gain a low temperature hot water Ts−, i.e., the necessary heat load gainable low temperature hot water F− via a feedforward method (see Step No. 6). In accordance with this value, the necessary burner will be selected (see Step No. 7); further, the CPU will calculate a required heat load gainable low temperature hot water F− which includes the standard necessary heat load, by adding a feedforward to a feedback value (see Step No. 8); a heat capacity adjustment device is controlled in accordance with this value, and the second burner 3 will be burned to a small degree for five seconds with a corresponding heating capacity for the required heat load gainable low temperature hot water F− (see step No. 9). Thereafter, this rotation is repeated, and is continued until an instruction is received for stopping the discharge of hot water, i.e., when the cold and hot shower operation switch 64 is turned to the off position.

32. Explanation of E-type Invention

Most of the technology discussed above has been limited to the internal structure of the water heater body, and has not dealt with the external condition of the water heater body. In other words, with respect to the incidental structure of the building in which a water heater is installed, the technology described above does not to refer to any arrangements relating to installation of the water heater, i.e., to the use of a water supply and drainage system, ventilation facilities, power source or fuel gas supply, and other facilities.

However, there is a problem in coordinating the installation of the water heater to the incidental or existing facilities in any installation, and any such installation raises a large number of questions. One problem is that it is necessary to indicate when the feeding water source suddenly stops. Once the sudden stoppage occurs, the feeding water pipeline channel connected to the water supply source will be affected by negative pressure to a certain degree, and when so affected by negative pressure which is below atmospheric pressure, the heat exchanger will be affected adversely, due to its weak structure and the adverse effects of the negative pressure, and in the worst case, it will be ruined. Particularly, when the feeding water supply suddenly stops during a period in which hot water is not being discharged, stored water within the heat exchanger will turn back upstream due to gravity, and as a result, a steam bed will partially arise in the top portion of the heat exchanger tube. Because the degree of vacuum which will result when the steam bed is condensed (when it is under refrigeration) will be unexpectedly large, as a result the heat exchanger will often be ruined.

Except for a situation in which the heat exchanger is spoiled as a result of negative pressure which is almost a vacuum, and during situations when the water suddenly stops during a hot water discharge cycle, water stored within the heat exchanger will be immediately discharged outside of the unit from a faucet through a hot water discharge pipeline. Further, water stored in the feeding water pipeline will turn back, in the upstream direction, and accordingly, water stored in the heat exchanger as well as water in each pipeline of the water heater will flow outwardly. These pipelines will become empty, and accordingly, damage will often occur to the heat exchanger due to a basic accident such as burning of the device when it is empty.

In order to prevent such damage or accident to result from the stoppage of water in the water supply side of a building, it is desirable, when installing a new water heater, to install a check valve, a vacuum breaker, and other necessary apparata which are provided in a water supply structure in a preliminary fashion, as security control for the buyer.

In view of this technical background, the present invention includes an attachment unit with a return bypass line (c) which includes the check valve, the vacuum breaker, and other necessary structure. Further, it includes a return bypass pipeline system within the attachment unit, so that when the multiple-purpose instantaneous gas water heater is installed with a water supply facility, the attachment unit c will be immediately installed to the water heater body as an attachment. Instantly, it will be fixedly connected to the ends of a fuel gas pipeline, a feeding water pipeline, and a hot water discharge pipeline, which all project outwardly from the bottom of water heater body a, respectively; ends of the fuel gas pipeline, the feeding water pipeline, and the hot water discharge pipeline project upwardly from the top section of the attachment unit and are jointed to respective downward ends by return bypass line c. This structure was provided to prevent the need to use additional water supply facility structure; and, as a result, the system was able to reduce the economic burden which was required by the additional structure and the delayed delivery time for the work.

Accordingly, the present invention will be referred to as an E-type improved invention, and a working example will be described hereinafter.

32. Working Example of E-type Invention

The attachment unit, with its return bypass line body c, as shown in FIG. 1B, provides the feeding water pipeline 4 of water heater body a, hot water discharge pipeline 34, fuel gas pipeline 15, and a plurality of pipelines which are connected to these respective pipelines. Further, a feeding water pipeline of top unit section 4*a*, a hot water discharge pipeline of top unit section 34*a*, and a fuel gas pipeline of unit top section 15*c* project downwardly from unit (c); at the ends of these pipelines, a hot water a connector for feeding water pipeline 4*b*, a connector for hot water discharge pipeline 34*c*, and a connector for fuel gas pipeline 15*d* are arranged in fixed fashion for connecting the lines to side pipelines on the building facility, e.g., they are connected to feeding water pipeline 4*c*, hot water discharge pipeline 34*c*, and fuel gas feeding pipeline 15*e*.

To a mid-section of the feeding water pipeline of top unit section 4*a*, a return bypass line 32*a* within the unit body is connected. Along the upstream side of the return bypass line 32*a* connected section, a check valve 49*a* and a vacuum breaker 73 are installed within the unit in an integral fashion, together with a reducing valve 74. All of these apparata are then arranged along the upstream side of return bypass line 32*a*.

Further, a check valve 49*b* within the unit is arranged in an integral fashion with feeding water pipeline 4*b* of the top section unit 4*a*.

Further, the end of the return bypass line 32*a* within the unit projects downwardly from the bottom of attachment unit body (c), and connector 75 is arranged at the end of the line in order to connect to the return bypass line within unit 32*b*.

Further, the return bypass line 32*a* within the unit includes a circulation pump within unit 35*a* adjacent a central or mid-portion of the pipeline, and water flow switch 76 and a check valve having a drain cap 77 are arranged within the unit upstream from the circulation pump 35*a*.

Similarly, the multiple-purpose instantaneous gas water heater includes a return bypass line (c) which is adapted to connect to the ends of pipelines 4, 15, and 34, all of which project downwardly from the bottom of the water heater, and to the ends of pipelines 4*a*, 15*c*, and 34*a*, all of which project upwardly from the top section of the attachment unit. Further, both connectors 4*b* and 15*b* project downwardly from the bottom of the attachment unit (c) and are adapted to be connected to pipelines 4*c* and 25*e* along the side of the building. Simultaneously, connector 75 of return bypass line 32*a* is connected to return bypass line 32*b*, which is branched from the hot water discharge pipeline 34*c*. In this fashion, a multiple purpose instantaneous gas water heater will be provided which provides, in a single structure, a check valve 49*a*, a vacuum breaker 73, a reducing valve 74, a circulation pump 35*a*, a water flow switch 76, and a return bypass line 32*a*, 32*b*, or similar structure.

During periods of non-use of the faucet and similar structure 27*a*, which is arranged at the end of hot water discharge pipeline 34*g* of attachment unit (c), i.e., during periods when hot water is not being discharged, circulation pump 35*a* is started, an amount of water flows within return bypass line 32*a*, 32*b*, and further flows into feeding water pipeline 4 of water heater body (a) through feeding water pipeline 4*a*. It also has a circulating flow into hot water discharge pipeline 34 of water heater body (a) via heat exchanger of the water heater.

Accordingly, the circulating water is maintained at the setting temperature or at a separately determined temperature by the first and second burners 2 and 3, under control of the microprocessor 17 of water heater body A.

Further, the return bypass line 32*b* does not branch from hot water discharge pipeline 34*c*, but instead closes connector 75 of the return bypass line 32*a* with a blank cap. Thereafter, it can be used as a popular water heater without keeping water warm during a water warming maintenance operation.

Further, in the above-noted working example, the technology was limited to an attachment (c) for a water heater body A; however, such apparatus or pipeline system, i.e., check valve 49*a*, vacuum breaker 73, and detachable return bypass line 32*b* and other structure which are installed within attachment unit body (c) originally, could possibly be installed into water heater body (a) directly without having to create a separate attachment unit body (c).

33. Explanation of F-type Improved Invention

Previously, various technologies were offered, both with respect to hardware and software; these related to methods of displaying the temperature setting means for the water heater or displaying a temperature which had not yet achieved its final value.

Accordingly, the present application will now discuss new technology relating to the display of the temperature setting means and the display itself.

34. Conventional Technology

Conventionally, temperature setting means used in an instantaneous gas water heater roughly comprised four separate stepped channels which utilized a rotary type of switch having a predetermined temperature group, i.e., a low temperature level which was around 35° C., a suitable temperature level which was around 42° C., a hotter temperature level which was around 60° C., and a hottest temperature level which was around 75° C.

However, in actual use, the user's taste varied in accordance with the season, and it appeared that relatively higher water temperatures or relatively lower water temperatures were preferred instead of the predetermined four steps. This was particularly true in the range of the frequently used channel which was determined to be a suitable temperature, e.g., about 42° C.; in other words, users wished to be able to fine-tune or fine-control the temperature, using 42° C. as the central number around which to tune. Therefore, it could not be said that these previous types of instantaneous gas water heaters were convenient to use.

35. The Problem to be Resolved

The present invention will resolve the problem by setting up a temperature control for adjusting the temperature near the predetermined suitable temperature.

36. Means for Resolving the Problem

In order to resolve such a problem, the instantaneous gas water heater will be capable of selecting a predetermined temperature which is one of the factors in determining the required heat load. Further, the predetermined temperature will be divided into four stages, i.e., a low stage, a suitable stage, a hotter stage, and a hottest stage, and it will further be capable of selecting a preferred temperature within a range of several degrees upwardly and downwardly for each of the four stages.

Accordingly, this invention will be hereinafter referred to as the F-type improved invention, and will be described hereinafter in greater detail.

34. Working Example of the F-type Invention

In the multiple-purpose instantaneous gas water heater illustrated in FIGS. 1A and 1B, a control panel (b) includes a power source switch 18, a second operation switch 18*a*, a first fine control temperature setting means 8*a*, a second fine control temperature setting means 8*b*, and a setting temperature display section 78. Further, control panel (b) is electrically connected to a microprocessor 17 which is arranged in an isolated fashion with respect to the control panel. Each of the fine control temperature setting means 8*a* and 8*b* will be capable of selecting a setup temperature Ts from the optional temperatures, e.g., 35° C., 42° C., 60° C., and 75° C.; and, additionally, each of these temperatures can be selected within a range of 4° upwardly and downwardly from such optional temperature, e.g., for the 42° C. setting, 41° C., 40° C., 39° C., and 38° C. downwardly, and 43° C., 44° C., 45° C., and 46° C. upwardly. Further, the setup temperature Ts which is optionally selected will be set as a voltage current into an A/D converter, where it will be converted to a data value Ts, this value will be sent into microprocessor 17, and it will indicate the setup temperature in setting temperature display section 78.

The temperature in control panel B is set up by using a Rockless type push button switch for the first fine control temperature setting means 8*a* to increase the temperature and for the second fine control temperature setting means 8*b* to decrease the temperature; these switches can be operated in a suitable fashion.

Each touch of each of the push button switches makes it possible to change one step of the temperature.

Setting temperature display section 78 comprises a plurality of pilot lamps using light-emitting diodes or similar structure which represent a number of optional setup temperatures; and the pilot lamps are illuminated in accordance with the setting temperature.

Characters, reference numerals, or graduations and similar marks are printed adjacent to each pilot lamp to indicate the setting temperature, wherein 35° C. is the lowest, 60° C. is the hotter, 75° C. is the hottest, and the pilot lamp is also divided into nine steps within a range between 38° C. and 46° C., and has printed numbers and graduations.

The control section is housed within water heater body A and mainly comprises a microprocessor 17.

In the block diagram of FIG. 3, microprocessor 17 is housed within water heater body (a), and includes an operation device 9 for calculating the necessary heat load, as well as a burner selection device 14 for determining which burner will be selected and which method of combustion will be adapted.

Operation device 9 takes in water volume data Q in the form of a converted pulse signal from a water volume sensor 5, and also is adapted to receive data values Ts, Tc, and Th which are transmitted from the fine control temperature setting means 8*a* and 8*b*, the feeding water temperature sensor 6, and the hot water discharge temperature sensor 7, respectively; these signals come through A/D converter 19. Thereafter, the required or necessary heat load $F_1$ will be calculated in accordance with such data.

Burner selection device 14 will send the necessary signal to the first and second electrical valves 10 and 11, and the first and second proportional control valves 12 and 13, in order to effect combustion by one of the burners in accordance with a required combustion method in response to the necessary heat load $F_1$ which is calculated by the operation device 9.

35. Explanation of the G-type Improved Invention

The purpose of the instantaneous gas water heater referred to above as the F-type improved invention was related to improving the temperature setting means and display. In the F-type invention, the display technology was adapted to display a temperature finely controlled by pilot lamps.

Using these pilot or display lamps, the present invention has been further developed to display not only the degree of fine control of the temperature, but also to display trouble points which are evidenced by blinking of lamps when any trouble occurs within the water heater. This is referred to as the G-type improved invention hereinafter, and is described in the following portion of the specification.

36. Conventional Technology

Previously, in conventional types of instantaneous gas water heaters, a variety of matter detecting means are provided. In the case of materials which are detected once, burner combustion is stopped for security, and the water heaters are adapted to generate an alarm for a user in the form of a blinking display resulting from a burner lamp on the control panel face which is outside of the water heater body.

Such conventional alarm systems comprise a temperature setting display means which is adapted to light a pilot lamp, and matter detecting means for detecting matter in a water heater which is used in connection with safety devices. The safety device and sensors are respectively arranged in necessary positions within the water heater, and, further, the temperature setting display means includes pilot lamps used also as matter alarms; and the lamps can be turned on and off in accordance with the type of matter detected by the matter detecting means.

37. Operation of the G-type Improved Invention

In accordance with conventional type display methods, a predetermined alarm lamp blinks on the setting temperature display section when a type of matter is detected by on of the detecting means. However, because this one light blinks even if the matter was detected by another detecting means, the system is unable to determined where the problem arose, and it takes an unduly large amount of time to check or repair, and requires a professional repairman to ascertain the problem and to repair the same.

38. Problem which this Present Invention will Resolve

The present invention is adapted to resolve the problem of displaying the problems in the water heater separately for each type of problem encountered.

39. Means for Resolving this Problem

The technical means used in this invention to resolve such a problem reside in the provision of a plurality of pilot lamps which are visibly arranged on the face of the control panel on the outside of the water heater, and which are provided in a number equivalent to the number of temperatures which can be arranged as setting temperatures. When any trouble arises, a different pilot lamp will be lit, but will not be limited to only one predetermined lamp.

40. Working Example of the G-type Improved Invention

In FIG. 1*b*, the multiple-purpose instantaneous water heater comprises a water heater body (a), an externally arranged control panel (b), a control panel (c) which includes a power source switch 18 and a second operation switch 18*b*, and a microprocessor 17 which is adapted to calculate the required heat load in accordance with the water flow rate and the feeding water temperature which are detected by the water volume sensor 5 and the feeding water temperature sensor 6, which are arranged, respectively, along the feeding water pipeline 4 of the water heater (a). It also receives information relating to the hot water discharge temperature detected by the hot water discharge temperature sensor arranged along hot water discharge pipeline 34, and the setting temperature set by both of the fine control temperature setting means 8*a* and 8*b* located along the face of control panel b. After this calculation, combustion of the first and second burners 2 and 3 will be operated under the control of proportional valves 12 and 13 and electrical valves 10 and 11.

In this working example, the first and second burners 2 and 3 are provided as a combustion system, and either or both of them are burned in response to the necessary heat load. Further, microprocessor 17 selects either of the control methods to control the heating capacity of the burners by varying the fuel gas flow rate by changing the degree to which the proportional valve 13 opens in response to the necessary heat load when only the second burner 3 is selected by microprocessor 17 (this being referred to as the proportional valve control method hereinafter), and, a second method, e.g., a method for controlling heating capacity by maintaining the degree of opening of the proportional valve at a constant value and changing the length of the on-off cycle and the ratio between periods in which the electrical valve is on and off so as to vary the heating capacity, repeating this on-off action as desired (this being referred to as the intermittent combustion control method hereinafter). Further, this proportional control method can be selected when both of the first and second burners 2 and 3 are operated in combination or when only the first burner 2 is operated.

Further, water heater (a) includes a circulating loop line in which the hot water discharge pipeline 34 channel which is positioned within a side of the building and the feeding water pipeline 4 channel will be joined at halfway or central portions of each pipeline by a return bypass line 32*a* which includes a circulation pump 35 therealong. Water contained within return bypass line 32*a* will flow in a circulating fashion under the heater body (a) is stopped. The circulating water is maintained warm by the setup temperature or by a separately determined safe temperature, and is capable of initiating the next discharge of hot water.

Water heater body (a) includes a water volume sensor 5, a feeding water temperature sensor 6, and a hot water discharge temperature sensor 7, and additionally an air flow rate sensor 53 and a flame sensor 82 for detecting the existence of a flame.

The airflow rate sensor 53 is arranged adjacent the common blower 38*a*, which charges a needed amount of combustion air into the first and second burners 2 and 3, and flame sensor 82 is arranged adjacent to the first and second burners 2 and 3.

Safety devices are also provided, including a high limit type bimetal thermostat 80 and a thermal fuse 81 which are arranged adjacent to heat exchanger 1 of water heater body (a). Further, a water flow sensor 37*b* is positioned along the return bypass line 32*a*.

Each of the above types of sensors, the water volume sensor 5, the feeding water temperature sensor 6, the hot water discharge temperature sensor 7, the air flow rate sensor 53, the flame sensor 82, and other safety devices, e.g., the high limit type bimetal thermostat 80, the thermal fuse 81, and the water flow sensor 37*b*, are all entirely connected electrically to the microprocessor 17, and send necessary signals into the microprocessor.

On the other hand, along the face of control panel (b), a plurality of pilot lamps are positioned with numbers which are equivalent to the number of visible setting temperatures in temperature setting sections 8*a* and 8*b*. This structure includes a setting temperature display section 78 which is capable of illuminating predetermined pilot lamps in response to the setup temperature.

In this working example, the setting temperatures are predetermined in four steps, categorized as a low setting temperature, a suitable setting temperature, a hotter setting temperature, and a hottest setting temperature, and with respect to the low, hotter, and hottest zones, they are provided with only step per zone. However, with respect to the suitable setting temperature zone, it has been separated into nine steps which can be selected.

Accordingly, temperature setting section 78 includes twelve pilot lamps.

Nine of the twelve pilot lamps will display not only the setting temperature for the suitable zone, but also will serve as alarms when detecting matter in the water heater, so that when these lamps are lit in an on-off fashion, i.e., when they blink, any trouble point within the heater will be pinpointed.

For example, the nine lamps will serve the secondary purpose of indicating an alarm function as follows: on the lower temperature side, there will be a no ignition alarm lamp 78*a*, a mis-ignition alarm lamp 78*b*, a high limit bimetal thermostat or thermal fuse broken alarm lamp 78*c*, a feeding water sensing thermister cord alarm lamp 78*d* for indicating a broken or shorted cord, a hot water sensing thermister cord broken or shorted alarm lamp 78*e*, an air flow sensor or blower abnormal alarm lamp 78*f*, a flame sensor abnormal alarm lamp 78*g*, a circulation pump abnormal alarm lamp 78*h*, and a water flow sensor abnormal alarm lamp 78*i*.

Each of alarm lamps 78*a*–78*i* will be illuminated in a blinking fashion upon receipt of an alarm signal, described hereinafter, and are known as the first to ninth signals.

Microprocessor 17 basically comprises a well-known CPU, RAM, and ROM, and a variety of programs are written into ROM for controlling the CPU. The first and second burners 2 and 3 are controlled in accordance with a program of combustion control which is written into the ROM, with the arithmetic-logic process of these signals being derived from each of the above sensors and the setup temperature. Further, combustion occurs under a safety control in accordance with a safety control program which is written into the ROM.

Figure 36:
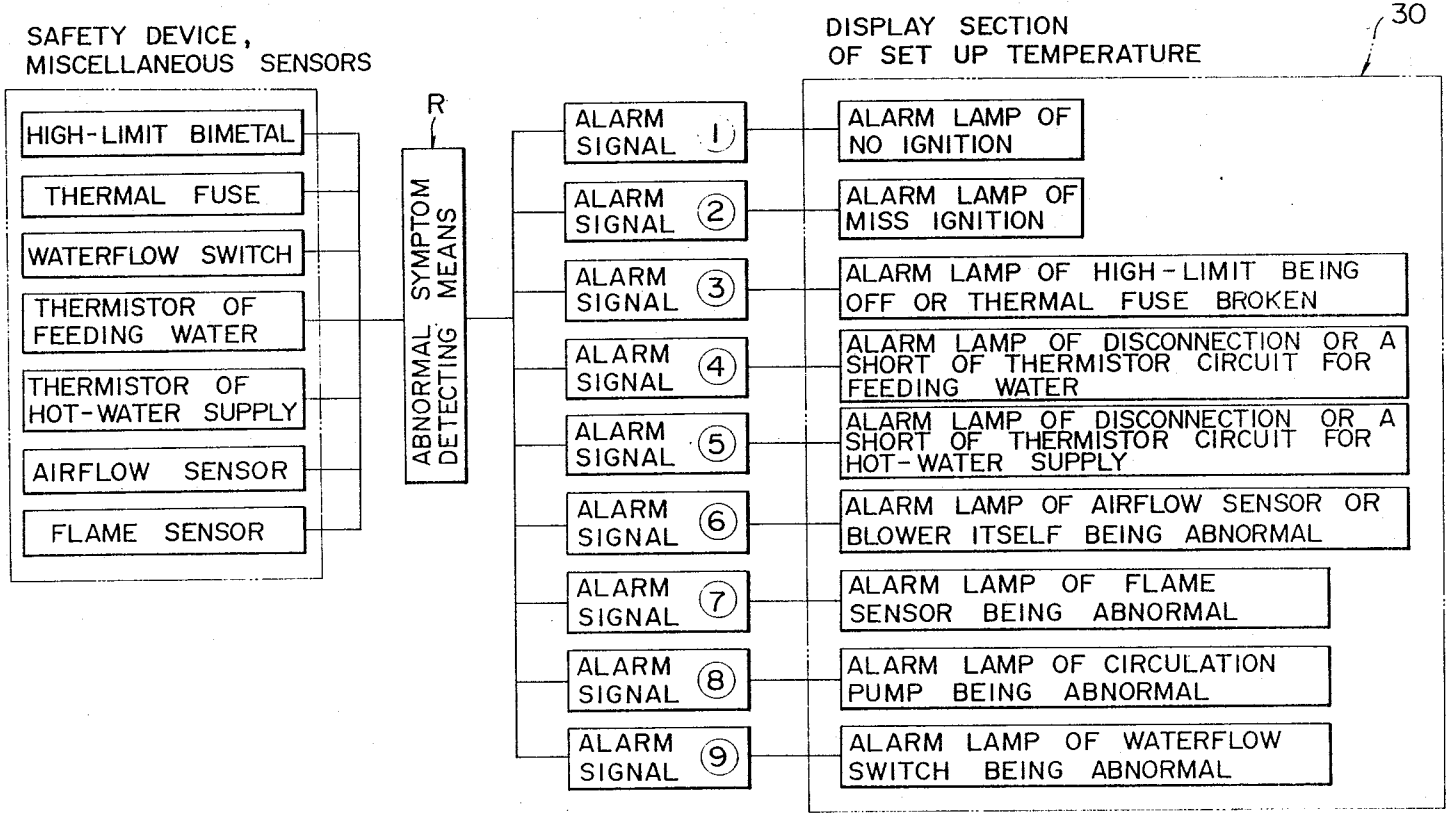
FIG. 36 is a block diagram illustrating the function of another embodiment, e.g., an F-type device, in accordance with the present invention.

The safety control program is illustrated by FIG. 36.

Specifically, an abnormality detecting means R of microprocessor 17 will quickly make a decision as to whether the safety devices are operating properly or not after operation switch 18 of control panel (b) is turned to its on position. When either of the circuits of the high limit bimetal thermostat 80 or the thermal fuse 81 are shorted, the third or No. 3 alarm signal will be sent. In the case of a breakage or a short in the thermistor cord of the water feeding sensor, the fourth or No. 4 alarm signal will be sent, and, further, in the case of breakage or a short in the thermistor cord of the hot water discharge sensor, the fifth, or No. 5 alarm signal will be sent.

In all of the above, the alarm lamps blink on and off when the third alarm signal is sent for the high limit and thermal fuse alarm lamps 78*c*, and the fourth alarm signal is sent for a breakage or short in either of the feeding water thermistor alarm lamps 78*d* or 78*e*, respectively.

Next, an abnormality detecting means R detects the existence of an electromotive force current in the flame rod by using a flame rod type sensor 82 when the faucet or similar structure 27 is released. In case there is no response to the current, the seventh or No. 7 alarm signal is quickly sent and a flame sensor abnormal alarm lamp 78*g* will start to blink.

Further, the abnormality detecting means R detects abnormalities in the air flow sensor 43 or in the common blower 38*a* in accordance with the blower rotation which is detected by air flow sensor 43. When the blower rotation is less than 1,200 rpm, the sixth or No. 6 alarm signal will be sent, and the air flow sensor abnormality or blower abnormality alarm lamp 78*f* will blink on and off.

Further, the abnormality detecting means R detects the current (in amperes) of the flame rod type sensor 82 after an ignition spark is made by igniter 82, and if less than 1 $\mu$A of current is continued for more than four seconds, at that time the first alarm signal will be sent and the no ignition alarm lamp 78*a* will blink on and off.

Further, the abnormality detecting means R will follow the movement of the flame current after ignition, and if the current is reduced, the second alarm signal will be sent and the misignition alarm lamp 78*b* will blink on and off.

Further, when faucet 27 is closed, abnormality detecting means R determines whether the water warming maintenance operation switch 79 is turned on or not, and when turned on, then determines whether water flow switch 76 is turned on or not; when this switch is on the ninth alarm signal will be sent to blink the water flow alarm lamp 78*i*.

Further, after circulation pump 35 starts, the water flow circulation is confirmed by water flow sensor 37*b*, and if it has not been circulated for more than ten seconds, the eighth or No. 8 alarm signal is sent to blink the circulation pump abnormality alarm lamp 78*h*.

Further, microprocessor 17 will make the common blower 38*a* blow at its highest rotation and will maintain this top rotation for between 3 and 7 seconds just after the fourth and fifth alarm signals are sent, the electrical valves 10 and 1 1 and proportional valves 12 and 13 will be turned to off, and common blower 38*a* will be operated at its top rotation for between 3 and 7 seconds when each of the first, second, sixth, seventh, eighth and ninth alarm signals are sent.

Further, simultaneously with each of these alarm signals being sent and the alarm lamps being blinked, a pilot lamp for displaying the setup temperature will also be off.

41. Effect

[1]The first invention comprises a first burner and a second burner, which, when arranged together are located adjacent one heat exchanger unit. The highest combustion capacity is set as well as the lowest combustion capacity for the No. 1 burner, which is otherwise arranged slightly larger. The water flow rate detection means, a feeding water temperature detection means, and a hot water temperature detection means, respectively, are arranged along a feeding water pipeline channel passing through the heat exchanger. A control panel is provided which includes a temperature setting means. An arithmetic-logic operation device is provided to calculate a required heat load in the microprocessor in accordance with the data input from each of the detecting means referred to above as well as from the temperature setting means. A burner selection means is provided to select a useable burner in accordance with the required heat load which is calculated by the arithmetic-logic operation means. A device for selectively generating signals is also provided as follows: it generates a combustion off signal, a second burner intermittent combustion signal, a second burner proportional combustion signal, a first burner proportional combustion signal, and first and second burner proportional combustion signal in response to burner selection by the burner selection device. First and second electrical valves are also provided which open and close a fuel gas feeding pipeline in response to the above operation signals, and first and second proportional valves are also provided which control the fuel gas flow rate in a continuous fashion.

(1) When this structure is used in combination wit flexible software, a multiple-purpose instantaneous gas water heater is provided.

(2) This instantaneous gas water heater is capable of reducing the lowest limit of combustion capacity of the burner with respect to the highest limit of combustion capacity.

(3) The device is capable of changing conversion values in a different fashion, i.e., it is capable of changing the conversion values between an increasing value and a decreasing value of the required heat capacity so as to frequently change between two combustion zones. In the present invention, such conversion between different combustion zones has been limited by reducing the conversion values of the two burners with respect to each other.

[2]The second invention also achieves a variety of effects.

(1) Specifically, in an instantaneous gas water heater, the second invention provides for a wide range of hot water discharge capabilities in a prototype. In other words, range is provided between a lower temperature hot water discharge by a burner combustion which is represented by a No. 0 combustion capacity and a high temperature burner discharge which is represented by a number No. 21 combustion capacity.

(2) At such discharged temperatures, the second invention maintains the highly sensitive response of the prototype. In other words, it is capable of controlling the hot water discharge temperature in a continuous and stepless fashion from a combustion capacity of virtually No. 0 up to a combustion capacity of approximately No. 21.

(3) In the second invention, the disadvantage of electrical valves caused by a too-often repeated on and off action has been improved by the use of software.

[3]The third invention of the present case includes the selection of a useable burner at the beginning of the process by a feedforward combustion capacity which is properly decided as a function of the required combustion capacity. As a result, this system is able to ignite the appropriate burner which should have been ignited from the beginning of the process to avoid unnecessary overuse of the burner.

Further, even if the feedback value is larger, the burner is operated with an initially determined combustion capacity which includes such a feedback value. In this case, an immediate discharge of hot water at a predetermined setup temperature will be accomplished. Further, no other burner will be ignited, and a small capacity type burner can be used, both in intermittent combustion and in a proportional combustion fashion, thereby increasing the durability of the small capacity type of burner.

[4]The fourth invention of the present case provides: (1) a burner operated with an average required heat load just before the combustion cycle of intermittent combustion which is decided in accordance with the ratio between the on time and the off time in an intermittent combustion cycle. As a result, the variation in the required heat load, which otherwise causes unexpected disturbances, will be reduced, and the necessary heat load will be checked each time just before the value is determined, so that there is no fear of bumping or hunting the hot water temperature.

(2) In order to reduce the on-time ratio with respect to the off time ratio, the burner combustion capacity can be reduced to almost the number No. 0 combustion capacity. Accordingly, it should be able to prepare a number of types of water heaters as proportional control types. In the present invention, however, one type of water heater is sufficient, which would be best operated under intermittent combustion for a proper required heat load.

[5]The fifth invention in accordance with the present application has a number of advantages in view of such structure.

(1) Because the water which is contained within a pipeline is always heated up to a setup temperature, so that the hot water will be useable quickly when the hot water discharge valve is opened, it has increased service capabilities, and water is not wasted because hot water comes out first. This makes the entire system more economical.

(2) Hot water is flowed continuously within the heat exchanger by a pump, although the usage of hot water s stopped. As a result, no bumping or sudden increase in temperature occurs, and the danger of scalding and similar dangers caused by the discharge of extremely high temperature water when a hot water side valve is opened are avoided.

[6]The sixth invention in the present case has an advantage in view of its structure.

(1) Specifically, its pump operation will cease when there is no need for water to circulate due to the fact that hot water is being discharged. As a result, power consumption is reduced and energy savings can be promoted; and the life of the pump can also be increased.

[7]The seventh invention of the present case is capable of properly detecting the states of hot water discharge and no hot water discharge by detecting the water flow rate during both of these situations. As a result, it can determine both the burner on and the burner off cycles for a small capacity type of burner which is programmed to effect intermittent combustion when a required heat load is less than a predetermined combustion capacity. As a result, it can minimize the amount of hunting of discharged hot water, and is capable of maintaining the water temperature of circulating water at a predetermined temperature.

Further, in order to operate the small capacity type second burner when the required heat load is greater than a predetermined combustion capacity, the on-off frequency of the small capacity burner is reduced, and the life of the second burner can accordingly be extended.

Further, a small capacity type second burner can be operated in an intermittent fashion or by continuous combustion. Further, a large capacity type first burner can undergo continuous combustion when the required heat load exceeds the highest capability of the small capacity type No. 2 burner. Therefore, it is capable of controlling both the hot water discharge temperature and the circulating water temperature within a wide range of required heat loads.

[8]The eighth invention has advantages in view of its structure in accordance with the following table:

TABLE I

| mode / burner | small combustion | | large combustion | |
|---|---|---|---|---|
| No. 1 burner | | | proportional combustion | proportional combustion |
| No. 2 burner | on-off combustion | proportional combustion | | proportional combustion |

(1) As illustrated in Table I, the invention has a variety of combustion zones, and as a result, it is possible to obtain highly accurate combustion.

(2) By controlling the speed of one blower unit, it is possible to supply the necessary combustion air charges to the first and/or second burners at a suitable air balance. As a result, the cost will be reduced due to the simple structure used, a compact type blower can be adopted, and economic efficiency can also be improved.

(3) It is possible to minimize the combustion capacity to nearly the No. 0 combustion capacity by using only the second burner.

(4) It is possible to maximize the combustion capacity to the total number of both burners which is equivalent to the sum of the first and second burners used at the same time.

(5) It is possible to affect the combustion capacity of the two burners by using the lowest number for the first burner and the highest burner for the second burner, or to make it lower by reducing the total number, by using the lowest number of the first burner, which is less than the highest number of the second burner. In this regard, it is possible to control combustion endlessly and continuously from the lowest value to th highest value.

[9]The ninth invention is advantageous in view of its structure as described herein below.

It is possible to synchronize the response speeds of both the blower motor and the proportional valves. As a result, it is possible to maintain a suitable relationship between fuel gas flow rate and blowing capacity when the hot water discharge temperature is suddenly varied, so as to prevent a yellow flame or flame lift from occurring. Therefore, no deterioration of the heat exchanger will occur and there is no fear of the flame being blown out by leakage of raw gas.

[10]The tenth invention is advantageous in view of its structure.

(1) Because it is capable of fixing a central temperature, it prevents the discharge of abnormally hot water without relationship to the swing span of the cold and hot water temperatures and, it is possible to obtain a uniform, averaged water temperature.

(2) It is capable of fixing the ratio and cycle times of hot and cold water; as a result, it can accordingly predetermine the most effective ratio at cycle times, and it can effect hot and cold water showering under the best conditions possible.

(3) It can be simply operated manually by having the user set up a swing span on the control section, so that the best showering can be obtained by a simple operation.

(4) Cycle time can be automatically changed when the arranged swing span exceeds a controllable highest limit, so that, when compared to a situation in which the cycle is completely fixed, the range of control will be increased, and it can respond for any steps which are optionally arranged, regardless of whether during the summer or winter seasons.

[11]The eleventh invention of the present case is advantageous because of its structure as detailed hereinafter.

It involves a method of operating the burners which adds a feedforward value to the feedback value for those heat loads required for high temperature hot water and low temperature hot water. It is capable of raising a target temperature level with the extra value of the feedback, so that the heating response will be speeded up when it is necessary to raise it to a higher level. In other words, the temperature will move from a low level to a high level rapidly, with drastic variations, so that the effect of the cold and hot water showering massage will be increased.

[12]The A-type improved invention of the present case also has advantages in view of its structure.

(1) This system is capable of controlling the rotation of the circulation pump which circulates the water sucked from a hot water discharge pipeline into a return pipe bypass line, regardless of different conditions of the pipeline and other factors. This can be done in accordance with certain data which has ben received, i.e., with the actual flow rate of circulating water detected by a water flow rate sensor arranged along a loop-shaped pipeline which forceably circulates an amount of water contained within the pipeline for maintaining water warm, and a target flow rate set by means of a phase-control of the pump motor. As a result, this system is capable of controlling the circulating water flow rate and maintaining it at a constant level.

Therefore, regardless of the circulating water flow rate and the pipeline conditions, it can easily control the water flow rate to maintain the water warm in the water warming maintenance operation with a minimal heat loss.

(2) The pipeline containing water is always heated to the setup temperature, so that, as a result, an immediate discharge of hot water will be available when the hot water valve of the discharge apparatus is opened. As a result, service provided by the device is improved and no additional water will be wasted before hot water is discharged from the hot water valve. This increases the economic efficiency of the device.

(3) The temperature control of the hot water is achieved by a ratio between the on-time and the off-time of intermittent combustion. In order to reduce the on time with respect to the off time, the combustion number of the burner can be reduced to near No. 0 in order to effect combustion with an extremely smaller combustion capacity. Accordingly, even if the temperature difference between the setting temperature and the circulating water temperature is extremely small, it is capable of warming up to the setting temperature. No serious bumping or hunting problems will result.

[13]The B-type improved invention of the present case has a number of functions and effects.

Figure 18:
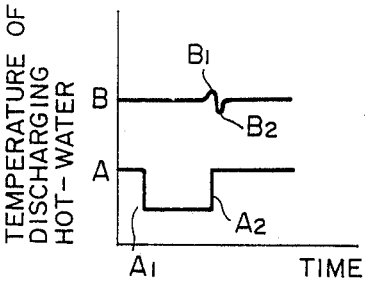
FIG. 18 is a graph illustrating the improved temperature characteristics of the hot water being discharged in operation of the B-type invention.

It is one goal to increase the slow ignition time of the first and second burners in comparison to the device of FIG. 1. FIG. 15 illustrates the conventional temperature characteristics of the burners, and FIG. 18 illustrates the temperature characteristics of this working example. Similarly, the drop of temperature $B_2$ is reduced, and thereafter working time is shortened. Accordingly, no more cold water which will be conducted to users at the beginning of the shower.

[14]In the C-type improved invention of the present case, there are several advantages. In this invention, blower operation is stopped when the off-time in intermittent combustion is continued for a predetermined period. Accordingly, the ability to keep the water warm is improved and fuel and power consumption are reduced.

[15]The D-type improved invention of the present case is also advantageous in view of its structure.

It is capable of transitioning from a small capacity type burner to a large capacity type burner, so that the ignition of the large capacity type burner will occur first and thereafter the smaller capacity type burner will be extinguished. In this fashion, there is no period in which no combustion occurs, i.e., the "no combustion" period has been eliminated. Accordingly, there is less decrease in hot water temperature when the water is initially discharged, and the serviceability of the burners will be improved.

[16]The E-type invention of the present case is advantageous in view of its structure, in which an attachment unit is prepared. A feeding water pipeline, a hot water discharge pipeline, a detachable return bypass line, a circulation pump, a check valve, a vacuum breaker, and other necessary apparatus are housed within the interior of the attachment unit. Accordingly, the feeding water pipeline and hot water discharge pipeline are joined to each other through the same channels of a side wall of a building. As a result, there is no additional structure required to install this apparatus in the building, thereby reducing the worktime required to install these devices as well as the cost involved in installation.

[17]The F-type improved invention of the present case is advantageous because of its structure. In this portion of the invention, frequently used temperature zones are provided, i.e., the suitable temperature zones is controlled by a fine control, but not when the temperature zone is in a low, hotter, or hottest section. This improves the serviceability of the burners again.

[18]The G-type improved invention in accordance with the present case is advantageous for structure as detailed below.

(1) This system provides a plurality of blinking pilot lamps which indicate the cause or types of trouble in water heaters. Because it provides a plurality of lamps it is easier to select tools to repair the device and convenient to check and repair the system.

(2) By using the display pilot lamp of the temperature setter as an alarm lamp also, there is no need to provide a separate alarm lamp, nor to increase its size, nor to make it more complex; this reduces the complexity of manufacture and in-line assembly.

Figures 37, 37A:
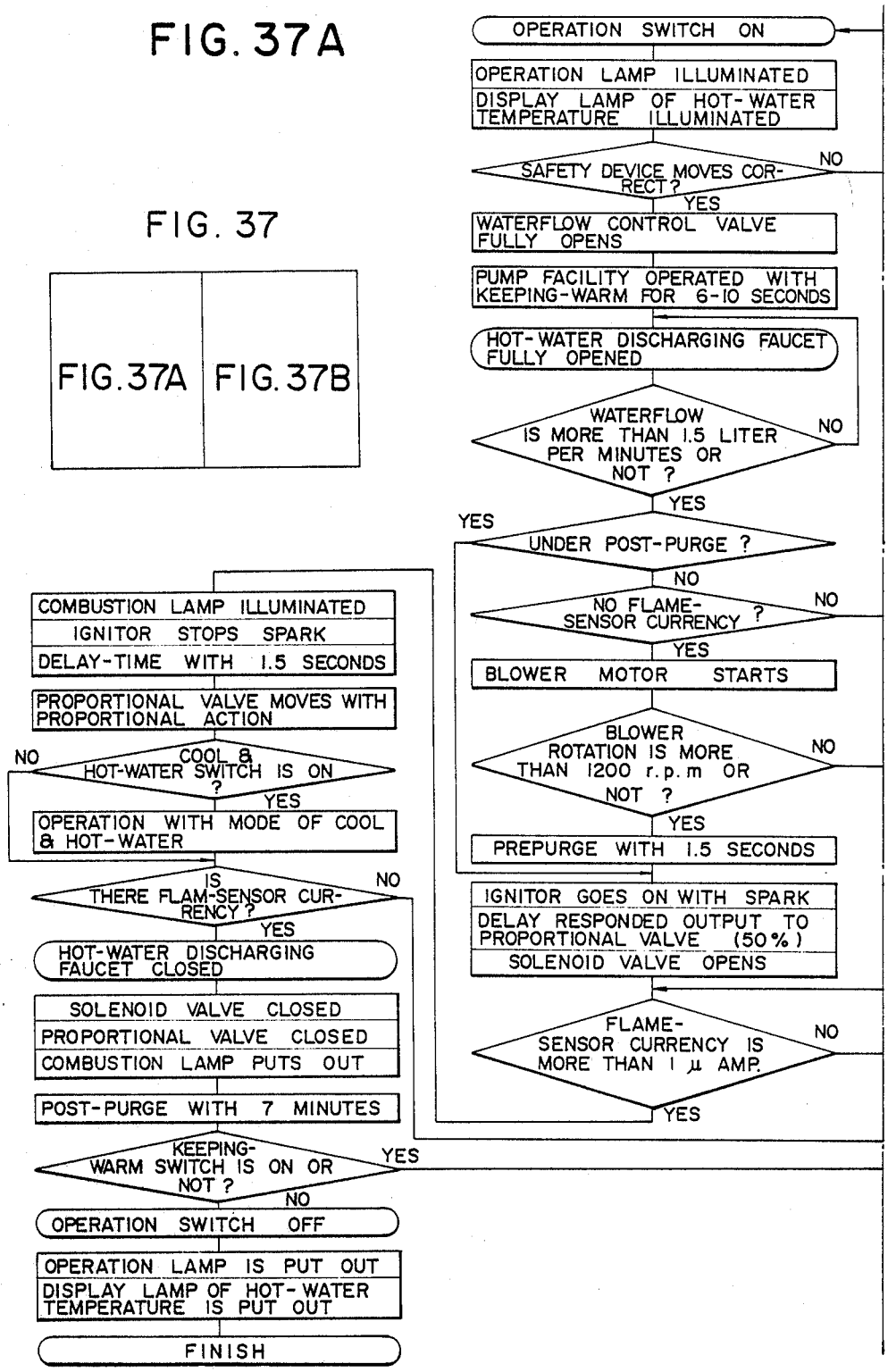
FIG. 37 is a block diagram illustrating the relationship between the detector and an alarm display in another embodiment, e.g., a G-type device, used in accordance with the present invention.
Figure 37B:
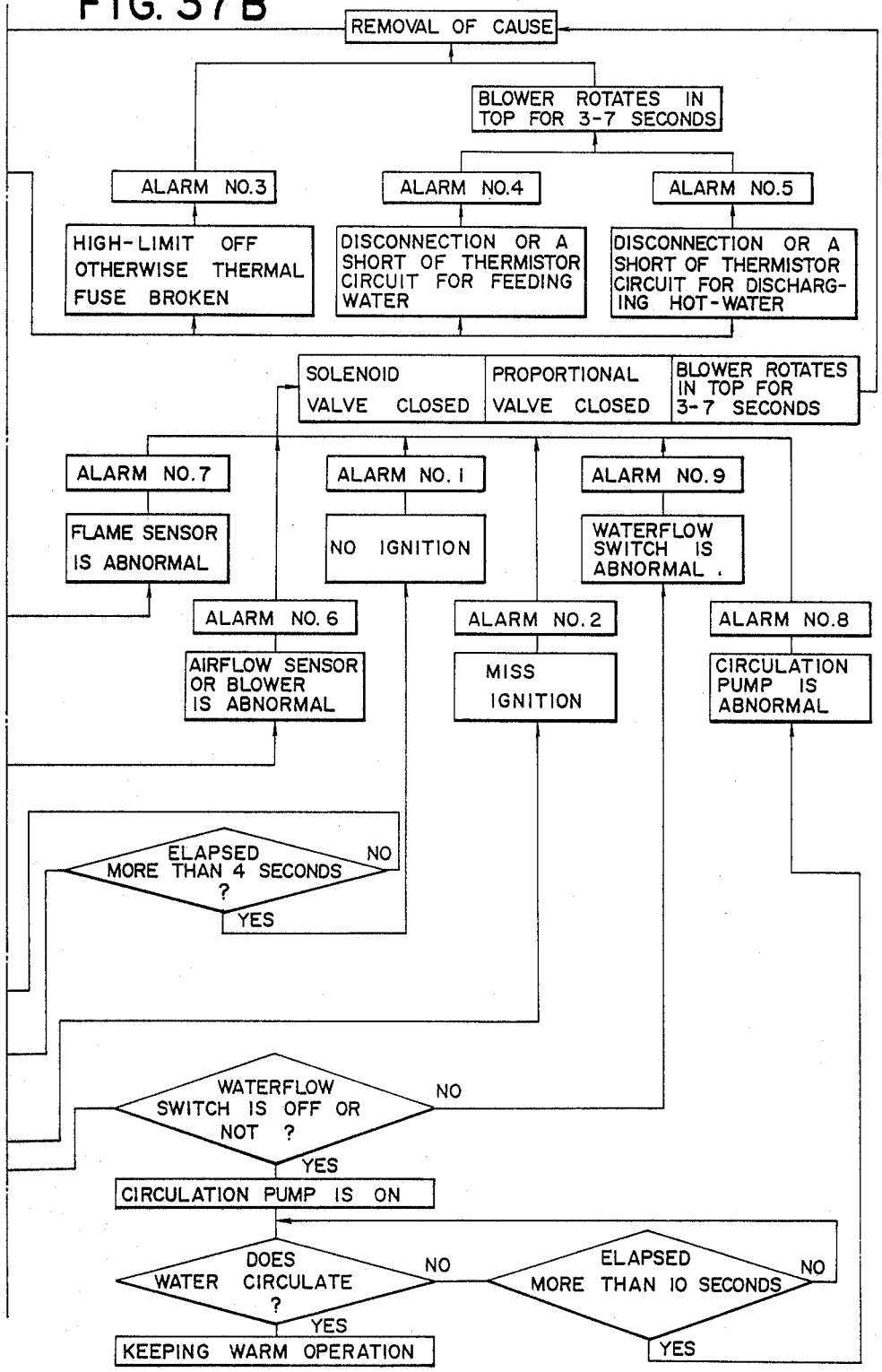

In order to summarize the effects of the present invention, e.g., as shown in FIG. 37, the system is capable of providing a burner having a maximum ability in the form of a multiple-purpose instantaneous gas water heater. When all of the software and hardware are provided as above, even if a partial section is not included, it is safe to say that the present invention has increased the practical utility of the invention beyond that which was contemplated previously for instantaneous gas water heaters.

A multiple purpose instantaneous gas water heater comprises a combination of a larger combustion capacity type

We claim:

1. A multiple-purpose instantaneous gas water heater comprising:

(a) a first burner;

(b) a second burner;

(c) a heat exchanger positioned adjacent said first burner and said second burner, said first and second burner being operably connected to selectively heat water contained in said heat exchanger;

(d) means for independent setting of the highest and lowest combustion capacities of said first burner and said second burner, wherein the highest combustion capacity of said second burner is slightly larger than the lowest combustion capacity of said first burner;

(e) means for detecting a water flow rate;

(f) means for detecting the temperature of feeding water;

(g) means for detecting the temperature of hot water, said means for detecting being arranged sequentially, respectively, along a feeding water pipeline channel extending through said heat exchanger;

(h) a control panel including means for setting water temperature;

(i) a microprocessor including:

(i) an arithmetic-logic means for receiving data from each of said means for detecting and said means for setting water temperature; and (ii) means for defining a required heat load in response to said data;

(j) means for selectively operating said first burner and said second burner depending upon the required heat load automatically determined by said microprocessor; and (k) means for selectively generating a combustion-off signal for intermittently operating said second burner;

(l) means for generating a proportional combustion signal for operating said first burner; and (m) means for generating a proportional combustion signal for operating said first burner and said second burner, said means for selectively generating being operable in response to a burner selected by said means for selectively operating a burner;

(n) first and second electrical valves;

(o) first and second proportional control valves; and (p) a fuel gas feeding pipeline, said first and second electrical valves being operable to selectively open said fuel gas feeding pipeline and said first and second proportional valves including means for continuously controlling the fuel gas flow rate through said gas feeding pipeline.

2. A multiple-purpose instantaneous gas water heater in accordance with claim 53 further comprising first and second electrical valves, first and second proportional control valves, and a fuel gas feeding pipeline, said first and second electrical valves being operable to selectively open said fuel gas feeding pipeline in response to receipt of said signals, said first and second proportional valves comprising means for continuously controlling the fuel gas flow rate through said gas feeding pipeline.

3. A multiple-purpose instantaneous gas water heater comprising:

(a) a first burner;

(b) a second burner;

(c) positioned adjacent said first burner and said second burner, said first and second burner being operably connected to selectively heat water contained in said heat exchanger;

(d) for independent setting of the highest and lowest combustion capacities of said first burner and said second burner, wherein the highest combustion capacity of said second burner is sightly larger than the lowest combustion capacity of said first burner;

(e) means for detecting a water flow rate;

(f) means for detecting the temperature of feeding water;

(g) means for detecting the temperature of hot water, said means for detecting being arranged sequentially, respectively, along a feeding water pipeline channel extending through said heat exchanger;

(h) a control panel including means for setting water temperature;

(i) a microprocessor including:

(i) an arithmetic-logic means for receiving data from each of said means for detecting and said means for setting water; and (iii) means for defining a required heat load in response to said data;

(j) means for selectively operating said first burner and said second burner depending upon the required heat load automatically determined by said microprocessor; and (k) feeding water pipeline having a central portion extending through said heat exchanger and connected to a central portion of a hot water discharge pipeline by a return by-pass line, wherein said return by-pass line, said feeding water pipeline, said heat exchanger, and said hot water discharge pipeline form a loop.

4. A gas water heater in accordance with claim 1 wherein water flow rate and temperature sensors are positioned along said loop.

5. An instantaneous gas water heater in accordance with claim 4 further comprising a circulation pump and a heater located along said return by-pass line, and means for calculating said required heat load and means for circulating water at a predetermined temperature in response to receipt of a signal corresponding to the water flow rate flowing within said loop, the temperature of water within said loop, and a set up temperature.

6. An instantaneous gas water heater in accordance with claim 5 wherein said heater is an electrical heater, said gas water heater further comprising means for selectively controlling the current voltage of said electrical heater and the on-off cycle of said heater in response to the calculated required heat load value.

7. A multiple-purpose instantaneous gas water heater comprising:

(a) a first burner;
(b) a second burner;
(c) positioned adjacent said first burner and said second burner, said first and second burner being operably connected to selectively heat water contained in said heat exchanger;
(d) for independent setting of the highest and lowest combustion capacities of said first burner and said second burner, wherein the highest combustion capacity of said second burner is slightly larger than the lowest combustion capacity of said first burner;
(e) means for detecting a water flow rate;
(f) means for detecting the temperature of feeding water;
(g) means for detecting the temperature of hot water, said means for detecting being arranged sequentially, respectively, along a feeding water pipeline channel extending through said heat exchanger;
(h) a control panel including means for setting water temperature;
(i) a microprocessor including:
  (i) an arithmetic-logic means for receiving data from each of said means for detecting and said means for setting water temperature; and
  (ii) means for defining a required heat load in response to said data;
(j) means for selectively operating said first burner and said second burner depending upon the required heat load automatically determined by said microprocessor; and
(k) means for automatically controlling combustion of at least one said burner in response to the calculation of a required heat load.

8. A multiple-purpose instantaneous gas water heater in accordance with claim 7 further comprising a hot water pipeline, a feeding water pipeline, a return bypass line branched from said hot water pipeline and said feeding water pipeline, a circulation pump located along said return by-pass line, and a loop-shaped pipeline adapted to contain a predetermined amount of water, said loop-shaped pipeline comprising said feeding water pipeline, said heat exchanger, said hot water pipeline, and said return by-pass line, said predetermined amount of water adapted to circulate through said pipeline and be heated within said pipeline, and means for heating said water within said loop-shaped pipeline for maintaining said water at a predetermined set up temperature, means for increasing the heat of said circulating water in response to the calculated required heat load in order to increase the heat of said circulating water so that said circulating water will have a temperature equivalent to said set up temperature.

9. A multiple-purpose instantaneous gas water heater in accordance with claim 8 further comprising means for cutting off the operation of said circulation pump when the required heat load exceeds a predetermined value, wherein said predetermined value is greater than the highest combustion capacity expected to be required for maintaining said circulating water at said set up temperature.

10. A multiple-purpose instantaneous gas water heater comprising:

(a) a first burner;
(b) a second burner;
(c) positioned adjacent said first burner and said second burner, said first and second burner being operably connected to selectively heat water contained in said heat exchanger;
(d) for independent setting of the highest and lowest combustion capacities of said first burner and said second burner, wherein the highest combustion capacity of said second burner is slightly larger than the lowest combustion capacity of said first burner;
(e) means for detecting a water flow rate;
(f) means for detecting the temperature of feeding water;
(g) means for detecting the temperature of hot water, said means for detecting being arranged sequentially, respectively, along a feeding water pipeline channel extending through said heat exchanger;
(h) a control panel including means for setting water temperature;
(i) a microprocessor including:
  (i) an arithmetic-logic means for receiving data from each of said means for detecting and said means for setting water temperature; and
  (ii) means for defining a required heat load in response to said data;
(j) means for selectively operating said first burner and said second burner depending upon the required heat load automatically determined by said microprocessor; and
(k) a a hot water discharge pipeline connecting an exit of said heat exchanger with hot water discharge instrument; and
(l) a heating water pipeline connecting an inlet portion of said heat exchanger to a feeding water supply source, said hot water discharge pipeline and said feeding water supply source both being connected to a return by-pass line.

11. A multiple-purpose instantaneous gas water heater in accordance with claim 10 further comprising a circulation pump and a channel formed by said pipelines, said channel comprising means for circulating water when said hot water is not being discharged from said hot water discharge instrument and means for conducting a flow of water, and a water flow movement sensor for detecting periods when hot water is being discharged and periods when hot water is not being discharged.

12. A multiple-purpose instantaneous gas water heater in accordance with claim 11 further comprising means for burning one of said burners intermittently at different on-off cycles during hot water discharge and hot water non-discharge periods, respectively, when the required heat load is less than a predetermined combustion capacity.

13. An instantaneous gas water heater in accordance with claim 11 further comprising means associated with said second burner for maintaining the discharge temperature of hot water at a predetermined level by heating the heat exchanger via continued combustion when the required heat load is greater than a predetermined combustion capacity.

14. An instantaneous gas water heater in accordance with claim 11 wherein said first burner comprises means for maintaining the discharge temperature of hot water at a predetermined temperature by heating the heat exchanger via continued combustion when the necessary heat load exceeds the capacity of the second burner.

15. A multiple-purpose instantaneous gas water heater comprising:

(a) a first burner;

(b) a second burner;

(c) positioned adjacent said first burner and said second burner, said first and second burner being operably connected to selectively heat water contained in said heat exchanger;

(d) for independent setting of the highest and lowest combustion capacities of said first burner and said second burner, wherein the highest combustion capacity of said second burner is slightly larger than the lowest combustion capacity of said first burner;

(e) means for detecting a water flow rate;

(f) means for detecting the temperature of feeding water;

(g) means for detecting the temperature of hot water, said means for detecting being arranged sequentially, respectively, along a feeding water pipeline channel extending through said heat exchanger;

(h) a control panel including means for setting water temperature;

(i) an arithmetic-logic means for receiving data from each of said means for detecting and said means for setting water temperature; and (ii) means for defining a required heat load in response to said data;

(j) means for selectively operating said first burner and said second burner depending upon the required heat load automatically determined by said microprocessor and (k) a temperature sensor positioned along said feeding water pipeline;

(l) arithmetic-logic means for maintaining high temperature hot water and low temperature hot water, said arithmetic-logic means being adapted to receive data corresponding to high and low hot and cold water temperatures, information relating to the water flow rate detected by a water flow sensor, information relating to feeding water temperature determined by a feeding water temperature sensor;

(m) hot water discharge temperature and control means for effecting combustion in response to a required heat load for high and low temperature hot water in an alternating fashion in accordance with a predetermined hot and cold water ratio; and (n) means for discharging high temperature hot water and low temperature hot water in an alternating fashion from hot and cold water shower instruments.

16. A multiple-purpose instantaneous gas water heater in accordance with claim 15 further comprising a first electrical valve and a second electrical valve, each said valve comprising means for selectively opening a fuel gas feed pipeline in response to said selectively generated signals, and first and second proportional valves comprising means for controlling the fuel gas flow rate within said fuel gas feeding pipeline.

17. A cold and hot water showering device which comprises a first burner and a second burner adapted to be arranged adjacent to a heat exchanger unit, means for determining the highest and lowest combustion capacity of said first burner, wherein the highest combustion capacity of the second burner is slightly greater than the lowest combustion capacity of the first burner, means for detecting a water flow rate, means for detecting a feeding water temperature, and means for detecting hot water temperature, all of said detecting means being arranged, respectively, along a feeding water pipeline channel which extends through said heat exchanger, a control panel comprising means for setting a temperature, an arithmetic-logic device in the form of a microprocessor comprising means for calculating a required heat load in accordance with data input from each of said detecting means, means for selecting a usable burner in accordance with the required heat load calculated by said microprocessor, means for selecting the combustion capacity control method of said second burner in accordance with the required heat load calculated when said second burner is selected, and means for selectively generating signals for turning off combustion of said burners, for intermittently combusting said second burner, for proportionally combusting said second burner, for proportionally combusting said first burner, and for proportionally combusting said first and second burners in response to selection of a desired burner by said burner selecting means and in response to the control method selected by said control method selecting means.

18. A method of using a multiple-purpose instantaneous gas water heater, which water heater comprises a first burner, a second burner and a heat exchanger, said first and second burners being positioned adjacent said heat exchanger, said gas water heater further comprising means for setting the highest and lowest combustion capacities of said burners, wherein the highest combustion capacity of said second burner is slightly larger than the lowest combustion capacity of said first burner, means for detecting a water flow rate, means for detecting the temperature of feeding water, and means for detecting the temperature of hot water, all three of said detecting means being arranged, respectively, along a feeding water pipeline channel extending through said heat exchanger, a control panel including means for setting said water temperature, a microprocessor with arithmetic-logic means for receiving data from each of said detecting means and said temperature setting means and for defining a required heat load in response to the data received, and means for selecting at least one of said burners in accordance with the heat load determined by said microprocessor, wherein said method comprises selecting a method for controlling the combustion capacity of said second burner in response to the determination of the required heat load, wherein said method comprises selecting said second burner with said burner selecting means, and generating signals for shutting off combustion of said first and second burners, for generating a signal for intermittent combustion of said second burner, generating a signal to initiate proportional combustion of said second burner, initiating a signal for initiating proportional combustion of said first burner, or initiating a signal for initiating proportional combustion of said first and second burners, each of said signals being generated in response to selection of a burner and selection of said control method by said burner selection means and a control method selection device, respectively

19. A method in accordance with claim 18, wherein said burner further comprises first and second electrical valves and said method further comprises operating said first and second electrical valves to selectively open a fuel gas feeding pipeline, said device further comprising first and second proportional valves and said method further comprising continuously controlling the fuel gas flow rate through said gas feeding pipeline with said first and second proportional valves.

20. A method in accordance with claim 19 further comprising sending the signal for intermittently combusting said second burner when the necessary heat load is lower than a predetermined standard value, fixing said second proportional valve in a predetermined open position and turning said second electrical valve on and off intermittently in a cyclical fashion in response to the necessary heat load.

21. A method in accordance with claim 19 further comprising selectively sending the proportional combustion control signal to said second burner, said proportional combustion signal to said first burner, and said proportional combustion control signal to said first and second burners when the necessary heat load is larger than a predetermined standard value, further opening at least one of said first and second electrical valves in response to the determination of said necessary heat load, and opening one of said proportional control valves to a suitable degree for the heat load determined.

22. A method in accordance with claim 18 wherein said device further comprises first and second electrical valves and said method comprises selectively opening a fuel gas feeding pipeline with said electrical valves, said method further comprising continuously controlling the fuel gas flow rate through said fuel gas feeding pipeline with said first and second proportional valves, and selecting which burner will effect combustion in accordance with the patterns of combustion of said first and second burners, said patterns having been predetermined by the required heat load calculated in response to said set up temperature, said feeding water temperature, and said water flow rate.

23. A method in accordance with claim 22 further comprising determining the combustion capacity of the burner which is selected in accordance with a final value of said required heat load which is determined by adding said final heat load to an initial heat load calculated in response to receipt of signals representing said set up temperature, said hot water temperature, and a proportional gain.

24. A method in accordance with claim 23 further comprising selecting the first burner and controlling the combustion capacity of the first burner in a variable fashion by controlling the fuel gas rate to said first burner by the first proportional control valve.

25. A method in accordance with claim 23 further comprising selecting both burners and controlling the combustion capacity of the selected burners by varying the gas fuel rate under the control of the proportional control valves of both of said burners.

26. A method in accordance with claim 23 further comprising selecting the second burner, having a smaller capability, said method including controlling the combustion capacity of said burner in an intermittent combustion fashion and operating the burner in an on-off cycle when the combustion capacity of the burner is lower than a predetermined combustion capacity.

27. A method in accordance with claim 26 further comprising controlling the combustion capacity of said burner by varying the fuel gas rate with the second proportional control valve when the combustion capacity of the second burner is greater than a predetermined combustion capacity value.

* * * * *

UNITED STATES PATENT AND TRADEMARK OFFICE

CERTIFICATE OF CORRECTION

PATENT NO. : 4,819,587

DATED : April 11, 1989

INVENTOR(S) : O. TSUTSUI et al.

It is certified that error appears in the above-identified patent and that said Letters Patent is hereby corrected as shown below:

At column 1, line 5, delete [1. Field of].

At column 1, line 6, insert ---1. Field of--- before "the".

At column 1, line 19, change "if" to ---it---.

At column 1, line 57, insert ---,--- after "controlled".

At column 5, line 23, change "TAILED" to ---DETAILED---.

At column 6, line 59, change "a" to ---as--- after "well".

At column 8, line 32, delete [in] after "phase".

At column 8, line 53, change "F1 No. 8" to ---F1<No. 8---.

At column 8, line 54, change "proportionally" to ---proportional---.

At column 8, line 64, change "No. O. to ---No. o.1---.

At column 8, line 67, change "F1 No. 4" to ---F1<No. 4---.

At column 9, line 4, change "10F1 to ---10≤F1---.

At column 9, line 48, change "sources" to ---source---.

At column 10, line 56, change "Water" to ---water---.

At column 11, line 48, change "burner 1" to ---burner 2---.

At column 11, line 50, change "burner" to ---burners---.

At column 12, line 31, change "second burner 2" to ---first burner 2---.

At column 12, line 41, change "th" to ---the---.

At column 13, line 55, insert ---is--- after "which".

At column 13, line 61, change "six" to ---five---.

At column 14, line 9, change "(5)" to ---(4)---.

At column 14, line 13, change "(6)" to ---(5)---.

At column 16, line 24, change "ga" to ---gas---.

At column 16, line 58, change "firs" to ---first---.

UNITED STATES PATENT AND TRADEMARK OFFICE

CERTIFICATE OF CORRECTION

PATENT NO. : 4,819,587

DATED : April 11, 1989

INVENTOR(S) : O. TSUTSUI et al.

It is certified that error appears in the above-identified patent and that said Letters Patent is hereby corrected as shown below:

At column 18, line 3, change "switch source switch 8" to ---source switch 18---.

At column 18, line 4, change "pump 3" to ---pump 35---.

At column 18, line 17, change "pulses" to ---pulse---.

At column 18, line 46, change "timeratio" to ---time ratio---.

At column 19, line 66, change "b" to ---by---.

At column 20, line 46, delete [switch] after "power".

At column 21, line 67, change "way" to ---ways---.

At column 23, line 58, change "apparata" to ---apparatus---.

At column 23, line 59, change "valve ,with" to ---valve, with ---.

At column 24, line 17, change "rate. The" to ---rate, the---.

At column 27, line 19, delete [on] after "off".

At column 29, line 50, change "t" to ---to---.

At column 30, line 5, change "i" to ---in---.

At column 30, line 16, change "th" to ---the---.

At column 31, line 53, change "wa" to ---was---.

At column 32, line 28, change "th" to ---the---.

At column 33, line 14, change "th" to ---the---.

At column 33, line 37, change "a" to ---as--- after "insofar".

At column 37, line 65, change "22." to ---23.---.

At column 38, line 38, change "23." to ---24.---.

At column 39, line 29, change "24." to ---25.---.

At column 40, line 7, change "25." to ---26.---.

At column 40, line 46, change "26." to ---27.---.

At column 41, line 5, change "27." to ---28.---.

At column 42, line 1, change "Qh 250" to ---Qh≤250---.

At column 42, line 15, change "O>F<525" to ---O<F<525---.

At column 42, line 35, change "27." to ---29.---.

UNITED STATES PATENT AND TRADEMARK OFFICE

CERTIFICATE OF CORRECTION

PATENT NO. : 4,819,587

DATED : April 11, 1989

INVENTOR(S) : O. TSUTSUI et al.

It is certified that error appears in the above-identified patent and that said Letters Patent is hereby corrected as shown below:

At column 42, line 43, change "28." to ---30.---.
At column 43, line 10, change "28." to ---31.---.
At column 44, line 38, change "29." to ---32.---.
At column 44, line 56, change "30." to ---33.---.
At column 44, lines 65/66, change "at a of cold water" to ---of cold water at a---.
At column 45, line 1, change "31." to ---34.---.
At column 46, line 4, change "32." to ---35.---.
At column 46, line 11, delete [to] after "not".
At column 47, line 15, change "32." to ---36.---.
At column 47, line 26, delete [a] after "water".
At column 48, line 37, change "33." to ---37.---.
At column 48, line 47, change "34." to ---38.---.
At column 49, line 1, change "35." to ---39.---.
At column 49, line 6, change "36." to ---40.---.
At column 49, line 20, change "34." to ---41.---.
At column 50, line 23, change "35." to ---42.---.
At column 50, line 38, change "36." to ---43.---.
At column 50, line 60, change "37." to ---44.---.
At column 50, line 64, change "on" to ---one---.
At column 51, line 3, change "38." to ---45.---.
At column 51, line 8, change "39." to ---46.---.
At column 51, line 19, change "40." to ---47.---.
At column 52, line 3, after "the" insert ---force of circulating pump 35 when hot water discharged from water---.
At column 54, line 16, change "41." to ---48.---.
At column 54, line 49, change "wit" to ---with---.
At column 55, line 67, change "s" to ---is---.
At column 56, line 67, change "burner" to ---number--- after "highest".
At column 57, line 4, change "th" to ---the---.
At column 57, line 60, change "ben" to ---been---.

UNITED STATES PATENT AND TRADEMARK OFFICE

CERTIFICATE OF CORRECTION

PATENT NO. : 4,819,587

DATED : April 11, 1989

INVENTOR(S) : O. TSUTSUI et al.

It is certified that error appears in the above-identified patent and that said Letters Patent is hereby corrected as shown below:

At column 59, line 4, change "zones" to ---zone--- (second occurrence).

At column 60, line 20 (claim 1, line 2), change "claim 53" to ---claim 1---.

At column 61, line 1 (claim 4, line 1), change "claim 1" to ---claim 3---.

At column 62, line 46 (claim 10, line 34), change "a a" to ---a---.

At column 63, line 48 (claim 15, line 32), insert ---;--- before "and".

Signed and Sealed this

Nineteenth Day of October, 1993

*Attest:*

*Attesting Officer*

Bruce Lehman

BRUCE LEHMAN

*Commissioner of Patents and Trademarks*